US010745187B1

(12) United States Patent
Vincent et al.

(10) Patent No.: US 10,745,187 B1
(45) Date of Patent: Aug. 18, 2020

(54) EXPANDABLE SHIPPING CONTAINER

(71) Applicant: TemperPak Technologies Inc., Richmond, VA (US)

(72) Inventors: Charles-Alexandre Vincent, St. Bruno de Montarville (CA); James McGoff, Silver Spring, MD (US)

(73) Assignee: TEMPERPACK TECHNOLOGIES, INC., Richmond, VA (US)

( * ) Notice: Subject to any disclaimer, the term of this patent is extended or adjusted under 35 U.S.C. 154(b) by 0 days.

(21) Appl. No.: 15/964,927

(22) Filed: Apr. 27, 2018

Related U.S. Application Data

(60) Provisional application No. 62/491,651, filed on Apr. 28, 2017.

(51) Int. Cl.

| | |
|---|---|
| ***B65D 81/38*** | (2006.01) |
| ***B65D 33/02*** | (2006.01) |
| ***B65D 33/10*** | (2006.01) |
| ***B65D 65/46*** | (2006.01) |
| ***B65D 5/36*** | (2006.01) |
| ***B65D 81/09*** | (2006.01) |
| *B65D 81/18* | (2006.01) |

(52) U.S. Cl.
CPC ..... *B65D 81/3858* (2013.01); *B65D 5/3635* (2013.01); *B65D 81/09* (2013.01); *B65D 81/386* (2013.01); *B65D 81/18* (2013.01)

(58) Field of Classification Search
CPC .. B65D 81/3858; B65D 5/3635; B65D 81/09; B65D 81/386; B65D 5/3678; B65D 5/36; B65D 5/3628; B65D 81/38; A45C 7/0036; A45F 3/46; A45F 4/02; B31B 2120/302; B65B 67/1205
USPC ..... 229/103.11, 117.06, 117.07, 117.05, 229/117.08, 164.1; 220/4.28, 666, 4.08, 220/9.2; 383/120, 110; 206/216
See application file for complete search history.

(56) References Cited

U.S. PATENT DOCUMENTS

| | | | | |
|---|---|---|---|---|
| 2,271,962 | A | 2/1942 | Weiner | |
| 3,067,923 | A | 12/1962 | Thiets | |
| 3,565,325 | A | 2/1971 | Pugsley | |
| 3,726,469 | A | 4/1973 | Koehler | |
| 3,945,561 | A * | 3/1976 | Strebelle | B65B 63/04 229/117.06 |
| 4,094,458 | A | 6/1978 | Nelson, Jr. | |

(Continued)

*Primary Examiner* — Christopher R Demeree
(74) *Attorney, Agent, or Firm* — Troutman Sanders LLP; Christopher J. Forstner; John A. Morrissett

(57) ABSTRACT

An expandable shipping container may be selectively expandable from a collapsed configuration to an expanded configuration by applying pressure to the sides of the container. The shipping container may include an inner structure having mirroring halves, each having a central rectangular face panel with bendable rectangular top, left, right, and bottom partial face panels extending from its sides and a square-shape corner panel positioned between each pair of partial face panels. The expandable shipping container may also include a flexible barrier covering an exterior of the inner structure and forming seams between one or more pairs of partial face panels of each half of the inner structure. The corner panels and left and right partial face panels of each half may include diagonal scorelines that, in conjunction with other scorelines, allow the container to be folded in a manner that facilitates convenient expansion.

24 Claims, 40 Drawing Sheets

(56) References Cited

U.S. PATENT DOCUMENTS

| | | | | | |
|---|---|---|---|---|---|
| 4,471,904 | A | * | 9/1984 | Cassidy | B65D 5/3628 229/104 |
| 4,622,693 | A | | 11/1986 | Mykleby | |
| 5,094,547 | A | | 3/1992 | Graham | |
| 5,195,829 | A | * | 3/1993 | Watkins | B65D 81/3469 383/100 |
| 5,292,093 | A | | 3/1994 | Shumake | |
| 5,582,343 | A | * | 12/1996 | Dalvey | B65D 5/0005 229/101 |
| 5,685,450 | A | | 11/1997 | Uda | |
| 5,897,084 | A | | 4/1999 | Judge | |
| 6,155,479 | A | * | 12/2000 | Wellner | B65D 5/2047 229/117.08 |
| 8,297,491 | B2 | | 10/2012 | Kwok et al. | |
| 9,701,435 | B2 | * | 7/2017 | Piechocinski | B65D 5/3685 |
| 2007/0071368 | A1 | | 3/2007 | Becker et al. | |

* cited by examiner

EXPANDABLE SHIPPING CONTAINER

CROSS-REFERENCE TO RELATED APPLICATION

This application claims priority under 35 U.S.C. § 119 to U.S. Provisional Patent Application No. 62/491,651, filed Apr. 28, 2017, the entire contents of which are incorporated fully herein by reference.

FIELD

The presently disclosed subject matter generally relates to shipping containers and systems and methods for producing and using the same, particularly an expandable insulated shipping container and systems and methods for producing and using the same.

BACKGROUND

Online and brick-and-mortar retailers alike increasingly rely on insulated shipping containers to provide desired or required thermal environments when shipping goods, particularly perishable goods (e.g., refrigerated meals), thereby increasing the longevity of the goods and in turn the shipping area of the customer base. High quality insulated shipping containers can be critical to achieving commercial success, though they are often difficult and expensive to produce, ship, and return, and inconvenient and expensive to store. For example, although unassembled insulated shipping containers often require a small amount of space to store, they can be time-consuming, difficult, and expensive to assemble. Conversely, pre-assembled insulated shipping containers that are ready for use without adjustment are more convenient, but require increased storage space and expense on the front end. Additionally, while retailers may be equipped with skilled employees to prepare the insulated shipping containers for use, customers may find the time and expense even more burdensome. Further, environmentally conscious retailers and consumers are faced with limited environmentally friendly and responsible options for disposing insulated shipping containers following use.

Accordingly, there is a need for an improved insulated shipping container and systems and methods for producing and using improved insulated shipping containers to address the above-mentioned limitations. Embodiments of the present disclosure are directed to this and other considerations.

SUMMARY

Briefly described, embodiments of the presently disclosed subject matter relate to an expandable shipping container. Specifically, in some embodiments, the expandable shipping container may include a unitary inner structure having a plurality of scorelines defining a plurality of rigid panels that are bendable relative to one another along one or more of the scorelines. The plurality of scorelines may include a bisecting scoreline that divides the inner structure into mirroring halves in some embodiments. In other embodiments, the bisecting scoreline may be replaced by a bisecting cut that divides the inner structure into separate, mirroring halves. In either case, each half may have a plurality of face panels (e.g., a central rectangular face panel, a top rectangular partial face panel, a left rectangular partial face panel, a right rectangular partial face panel, a bottom rectangular partial face panel) and a plurality of corner panels (e.g., four square-shaped corner panels). The central rectangular face panel may have top, left, right, and bottom sides, with the top rectangular partial face panel extending from the top side to an outermost top edge of the respective half, the left rectangular partial face panel extending from the left side to an outermost left edge of the respective half, the right rectangular partial face panel extending from the right side to an outermost right edge of the respective half, and the bottom rectangular partial face panel extending from the bottom side to the bisecting scoreline. Each of the four square-shaped corner panels (e.g., first, second, third, and fourth corner panels) may be positioned adjacent two of the partial face panels and have a bisecting diagonal scoreline aligned towards the center of the central face panel. The left and right partial face panels may have diagonal scorelines that parallel diagonal scorelines of the top left (e.g., first) and top right (e.g., second) corner panels to separate a triangular panel portion from a remainder panel portion. The expandable shipping container may also include a flexible barrier covering an entire exterior surface of the inner structure. The barrier may form a closed left face seam between the pairs of left partial face panels, first corner panels, and third corner panels of each half of the inner structure and a closed right face seam between the pairs of right partial face panels, second corner panels, and fourth corner panels of each half of the inner structure such that the container forms an enclosure having a single aperture defined between the pairs of top partial face panels, first corner panels, and second corner panels of each half of the inner structure. Further, the expandable shipping container may be easily expandable between a collapsed configuration and an expanded configuration.

In other embodiments, the expandable shipping container may include an inner structure having a plurality of rigid panels that are bendable relative to one another. The plurality of panels may include a first side panel, a second side panel, and first and second bottom panels. The first and second side panels may each have a bendable top flap and an opposing pair of bendable flaps (e.g., first and second side flaps for the first side panel and third and fourth side flaps for the second side panel). The first and second bottom panels may be positioned adjacent to the first and second side panels, respectively, such that the first and second bottom panels are separated by an inwardly foldable bottom boundary. The expandable shipping container may also include a flexible barrier encasing the inner structure. Together, the barrier and the first and second side flaps may form a third side panel, and the barrier and the third and fourth side flaps may form a fourth side panel. The third and fourth side panels may each have a bendable top flap (e.g., third and fourth bendable top flaps) such that the first, second, third, and fourth bendable top flaps together define a single opening of the expandable shipping container. Further, the expandable shipping container may be expandable from a collapsed configuration to an expanded configuration in response to inwardly directed pressure on the third and fourth side panels.

In further embodiments, the expandable shipping container may include an inner structure having a plurality of rigid panels that are bendable relative to one another. The plurality of panels may include a first side panel, a second side panel, and a bottom panel. The first and second side panels may each have a bendable top flap and opposing bendable first and second side flaps. The expandable shipping container may also include a flexible barrier encasing the inner structure. Together, the barrier and the pair of first side flaps may form a third side panel, and the barrier and the pair of second side flaps may form a fourth side panel such that the container defines a single opening between the pair of top flaps. Further, the expandable shipping container may be expandable from a collapsed configuration to an expanded configuration in response to inwardly directed pressure on the third and fourth side panels.

In other embodiments, an expandable insulated shipping container may include an inner structure having a plurality of rigid insulated panels including a first panel and a second panel. The first and second panels may each have a plurality of flaps including a first side flap, a second side flap, and a third side flap. The expandable insulated shipping container may also include a flexible barrier covering an exterior surface of the inner structure. The barrier may form a closed first side seam between the pair of first flaps, a closed second side seam between the pair of second flaps, an open third side seam between the pair of third flaps, and a fourth side seam opposite the open third side seam such that the container forms an enclosure having a single aperture defined by the open third side seam. Further, the expandable insulated shipping container may be expandable between a collapsed configuration and an expanded configuration.

In further embodiments, a method for expanding an insulated shipping container may include receiving an insulated shipping container in a collapsed configuration. The container may include an inner structure enclosed by a flexible barrier. The inner structure may have a plurality of rigid insulation panels and a plurality of rigid flaps. The flexible barrier may form an open seam between a first pair of the bendable flaps and two or more closed seams between two or more additional pairs of the bendable flaps such that the container forms an enclosure having a single aperture defined by the open seam. The method may also include applying an inwardly directed pressure to at least two of the two or more closed seams to expand the container into an expanded configuration.

The foregoing summarizes only a few aspects of the presently disclosed subject matter and is not intended to be reflective of the full scope of the presently disclosed subject matter as claimed. Additional features and advantages of the presently disclosed subject matter are set forth in the following description, may be apparent from the description, or may be learned by practicing the presently disclosed subject matter. Moreover, both the foregoing summary and following detailed description are exemplary and explanatory and are intended to provide further explanation of the presently disclosed subject matter as claimed.

BRIEF DESCRIPTION OF THE DRAWINGS

Reference will now be made to the accompanying drawings, which are not necessarily drawn to scale, and which are incorporated into and constitute a portion of this disclosure, illustrate various implementations and aspects of the disclosed technology and, together with the description, serve to explain the principles of the disclosed technology. In the drawings:

FIG. 1A is a top rear isometric view, FIG. 1B is a bottom rear isometric view, and FIG. 1C is a top front isometric view of the collapsed shipping container, in accordance with some exemplary embodiments;

FIG. 2A is a top front isometric view and FIG. 2B is a bottom rear isometric view of the expanded shipping container in a closed position, and FIG. 2C is a top front isometric view of an exemplary expanded shipping container in an open position, in accordance with some exemplary embodiments;

FIG. 11A is a top rear isometric view, FIG. 11B is a bottom rear isometric view, FIG. 11C is a top front isometric view of the collapsed, unassembled shipping container, in accordance with some exemplary embodiments;

FIG. 11D is a front view of the collapsed, assembled shipping container, in accordance with some exemplary embodiments, and FIG. 11E is a bottom rear isometric view of the assembled shipping container in a slightly expanded configuration, in accordance with some exemplary embodiments;

FIG. 12A is a top front isometric view and FIG. 12B is a bottom rear isometric view of the expanded shipping container in a closed position, and FIG. 12C is a top front isometric view of an exemplary expanded shipping container in an open position, in accordance with some exemplary embodiments;

DETAILED DESCRIPTION

Figure 1A:
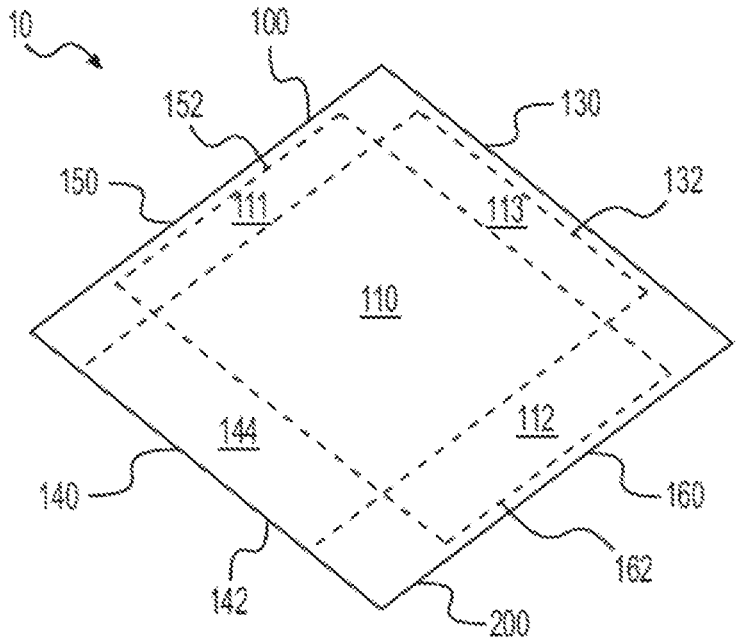
FIGS. 1A-1C show an expandable shipping container in a collapsed configuration, in accordance with an exemplary embodiment. Specifically.

To facilitate an understanding of the principals and features of the disclosed technology, illustrative embodiments are explained below. The components described hereinafter as making up various elements of the disclosed technology are intended to be illustrative and not restrictive.

Embodiments of the disclosed technology include a shipping container that may be easily transformed from a storage configuration that enables efficient storage of the shipping container to an in-use configuration that enables the shipping container to be used to hold or store items. This transformation may be easily executed by a lay person with no training or experience by simply applying pressure to opposing sides of the shipping container to transform the shipping container from a generally flat shape to a three-dimensional polygonal shape. The shipping container may have an inner structure constructed from rigid pieces of material divided by scorelines that allow some pieces to bend relative to other pieces (e.g., by folding along one of the scorelines). For example, the inner structure may include a plurality of panels and a plurality of flaps that may be joined to the panels at scoreline. The ability of some pieces to bend relative to other pieces may enable the shipping container to easily transform from the storage configuration to the expanded configuration, while the inner structure provides rigidity strength to the container. Further, the inner structure may be scored and folded in a manner that enables the container to conveniently fully expand and remain expanded to make it even easier and more convenient to place items inside of the container.

The inner structure may include material that may provide thermal insulation to allow the shipping container to better maintain a desired temperature. For example, in some embodiments, the inner structure may include a plurality of inner cells forming a repeating geometric pattern (e.g., a honeycomb pattern) with insulation materials being housed within one or more of the cells. In other embodiments, the inner structure may include an insulation panel (e.g., the insulation panel disclosed in the U.S. Provisional Patent Application No. 62/491,666, filed Apr. 28, 2017, the subject matter of which is incorporated herein by reference) that is affixed (e.g., via an adhesive or another chemical or mechanical bond) to a structural backing (e.g., corrugated backing) to increase rigidity and strength, particularly if the insulation panel is thin or fragile. Regardless of its composition or design, the inner structure may be encased in a flexible material, such as kraft paper for example, that may assist the shipping container in easily transitioning from the storage configuration to the in-use configuration, and may further provide additional benefits such as water resistance and thermal insulation. When the storage container is in the expanded configuration, it may be sealed on all sides except for a top side, which has top flaps that may be selectively opened or closed. The top flaps may be sealed to close the shipping container prior to shipping. The shipping container may be made from materials that are repulpable, recyclable, and/or compostable, providing an environmental-friendly solution for disposal of the insulated packaging materials following use.

Reference will now be made in detail to example embodiments of the disclosed technology, examples of which are illustrated in the accompanying drawings and disclosed herein. Wherever convenient, the same references numbers will be used throughout the drawings to refer to the same or like parts.

Figure 1B:
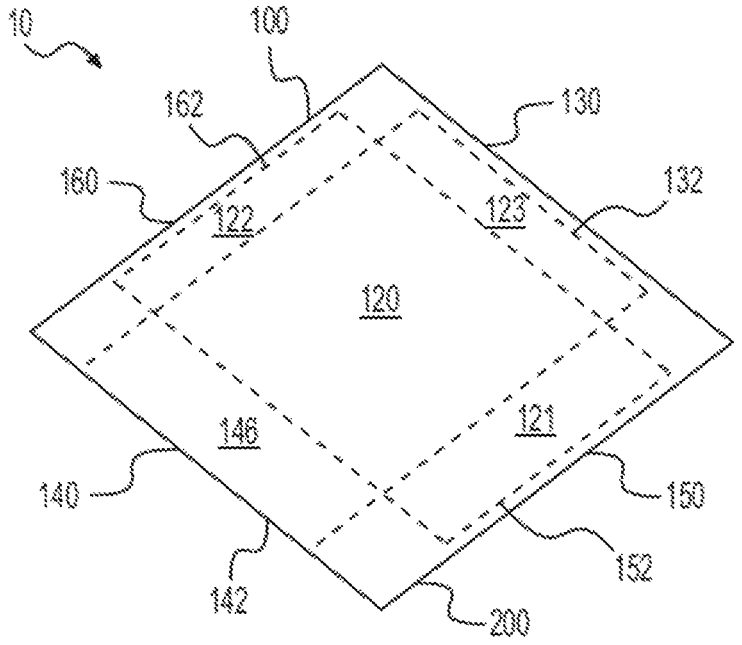
Figure 1C:
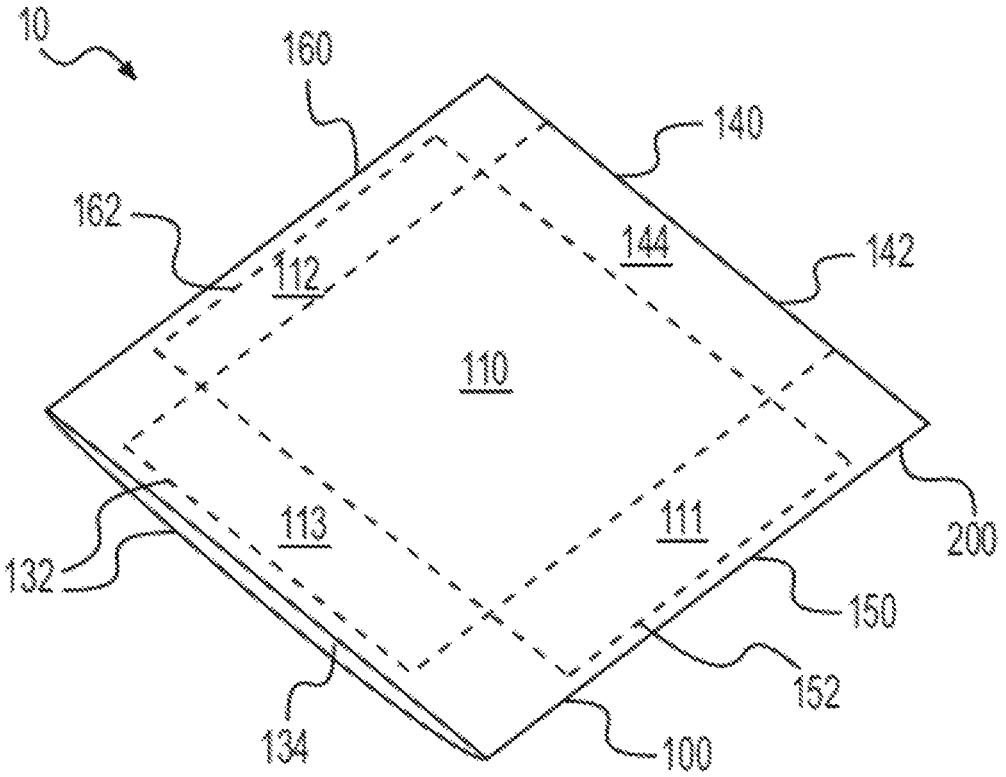

FIGS. 1A-1C are illustrations of an exemplary expandable shipping container 10 in a collapsed configuration, in accordance with some embodiments. When in the collapsed configuration, expandable shipping container 10 has a reduced volume to allow for more efficient storage and shipment of expandable shipping container 10. It is contemplated that expandable shipping container 10 may have one or more desired dimensions in the collapsed configuration making it particularly sized and shaped for storage and/or stacking with other shipping containers or packaging materials. According to some embodiments, when in a collapsed configuration, expandable shipping container 10 may be substantially flat (e.g., it has a thickness, in the smallest dimension, of about 0.25" to about 3.0" or less than about 6% of the smaller of the length and height dimensions), with a width of about 10" to about 50" and a length of about 10" to about 60". In some embodiments, expandable shipping container 10 includes an inner structure 100 and a flexible barrier 200. According to some embodiments, inner structure 100 and/or flexible barrier 200 may be made from renewable and/or environmentally-friendly materials. For example, inner structure 100 and/or flexible barrier 200 may be made from materials that can be readily recycled in one or more single stream collection systems with recyclable paper or plastic materials. In some embodiments, flexible barrier 200 entirely encloses inner structure 100 such that it encloses all exposed surfaces of inner structure 100. In other embodiments, flexible barrier 200 covers only the outer surfaces of inner structure 100.

As will be described in greater detail below, according to some embodiments, inner structure 100 may include a first side panel 110, a second side panel 120, a third side panel 130 (which may be referred to as a top panel 130), a fourth side panel 140 (which may be referred to as a bottom panel 140), a fifth side panel 150, and a sixth side panel 160 to form a rectangular or cubic six-sided figure, though other three-dimensional polygonal shapes are contemplated. According to some embodiments, first side panel 110 and second side panel 120 are each formed by a rigid piece of material having a square or rectangular shape. Each panel of the inner structure 100 may constitute one side (or "face") of a 6-sided box formed by the inner structure 100 when expandable shipping container 10 is in the expanded configuration. Structure 100 may be formed from a single unitary blank with the panels separated by scorelines or one or more of the panels may be attached to the blank along its edges.

As shown in FIG. 1A, according to some embodiments, first side panel 110 may have or be attached to a first side flap 111, a second side flap 112, and a top flap 113. Each flap 111, 112, 113 may extend from (e.g., if part of the same unitary blank that is cut and scored) or be attached to a different edge of first side panel 110, with first side flap 111 and second side flap 112 positioned opposite one another relative to first side panel 110. In some embodiments, a half 144 of the bottom panel 140 may extend from or be attached to a fourth edge of first side panel 110 opposite the top flap 113.

As shown in FIG. 1B, according to some embodiments, second side panel 120 may have or be attached to a first side flap 121, a second side flap 122, and a top flap 123. Each flap 121, 122, 123 may extend from or be attached to a different edge of second side panel 120, with first side flap 121 and second side flap 122 positioned opposite one another relative to second side panel 120. In some embodiments, another half 146 of the bottom panel 140 may extend from or be attached to a fourth side of second side panel 120 opposite the top flap 123.

Figure 3B:
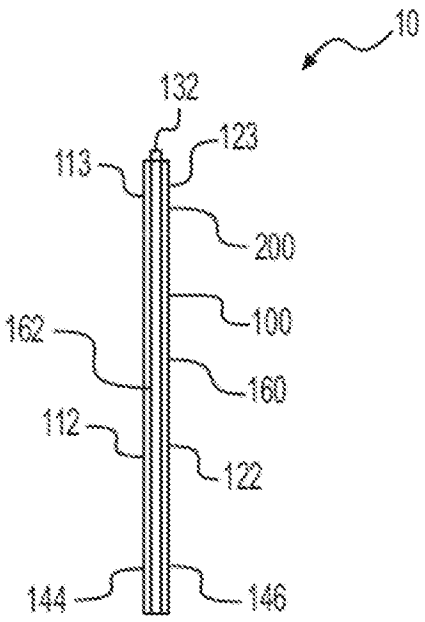
FIGS. 3A-3F show the transition of the expandable shipping container from a collapsed configuration (front view in FIG. 3A, right side view in FIG. 3B) to a partially expanded configuration (front view in FIG. 3C, right side view in FIG. 3D) to an expanded configuration (front view in FIG. 3E, right side view in FIG. 3F), in accordance with the exemplary embodiment shown in FIGS. 1A-2C.

As shown in FIGS. 1A-1B, and more clearly in FIG. 3B, when expandable shipping container 10 is in the collapsed configuration, the expandable shipping container 10 is substantially flat such that first side panel 110 may be adjacent to or touching second side panel 120. According to some embodiments, first side panel 110 and second side panel 120 may always be substantially parallel to another, regardless of whether the expandable shipping container 10 is in a collapsed configuration, an expanded configuration, or in an intermediate configuration between a collapsed and an expanded configuration. As shown in FIGS. 1A-1B, in some embodiments, when expandable shipping container 10 is in a collapsed configuration, first side panel 110 and its flaps 111, 112, 113, mirror second side panel 120 and its flaps 121, 122, 123 such that first side flap 111 of first side panel 110 opposes first side flap 121 of second side panel, second side flap 112 of first side panel 110 opposes second side flap 122 of second side panel 120, and top flap 113 of first side panel 110 opposes top flap 123 of second side panel 120. According to some embodiments, when expandable shipping container 10 is in a collapsed configuration, the pairs of first and second side flaps 111, 112, 121, 122 are substantially parallel to the first and second side panels 110, 120.

As shown in FIG. 1C, in some embodiments, when expandable shipping container 10 is in a collapsed configuration, the edges of the pair of top flaps 113, 123 may be adjacent to one another so as to form a top seam 132, which may be selectively opened and closed. When opened, the top seam 132 of the expandable shipping container 10 defines an opening 134 that facilitates access to the internal enclosure of the expandable shipping container 10. In some embodiments, opening 134 serves as the only access to the internal enclosure of expandable shipping container 10, as the remaining edges of expandable shipping container 10 are sealed by flexible barrier 200. In other embodiments, expandable shipping container 10 has additional openings (not shown) to provide access to its internal enclosure of expandable shipping container 10.

Figure 2A:
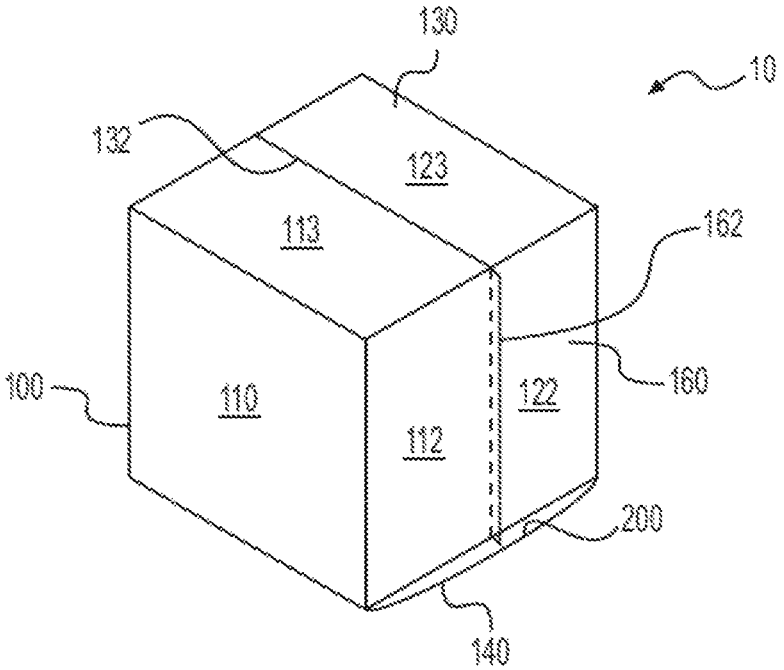
FIGS. 2A-2C show the expandable shipping container in an expanded configuration, in accordance with the exemplary embodiment shown in FIGS. 1A-1C. Specifically.
Figure 2B:
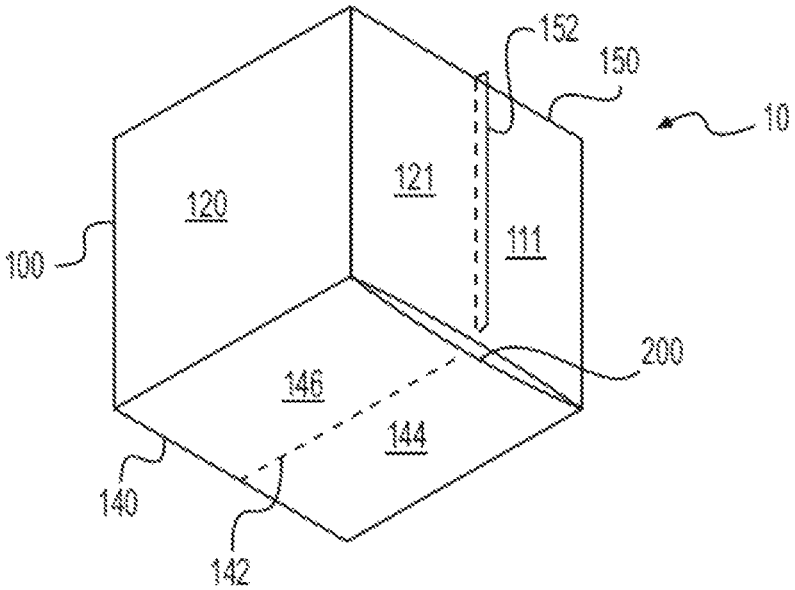
Figure 2C:
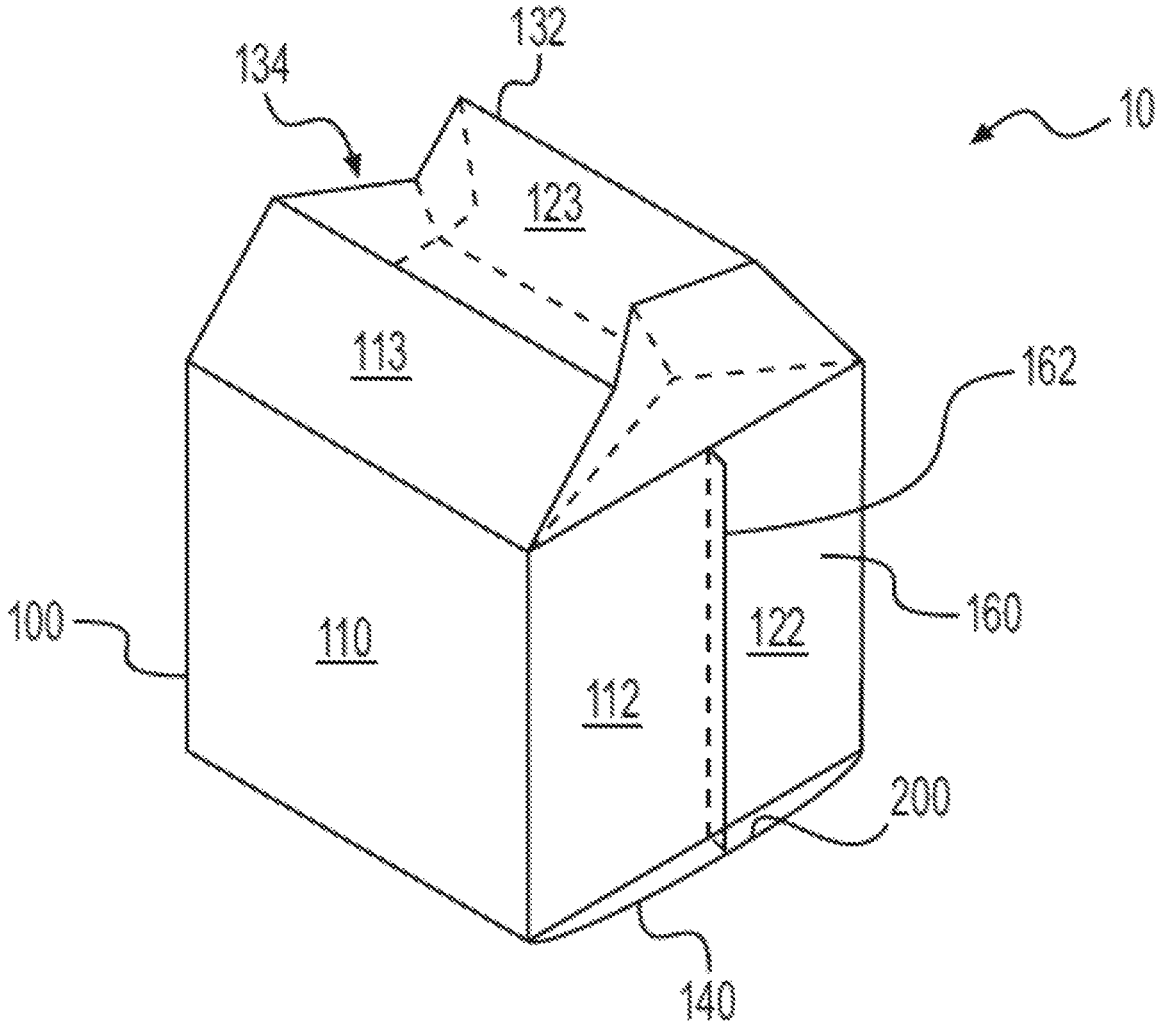

FIGS. 2A-2C are illustrations of expandable shipping container 10 in an expanded configuration, in accordance with some embodiments. When in the expanded configuration, expandable shipping container 10 forms a receptacle for holding one or more items for storage or shipment. FIGS. 2A-2B illustrate the expandable shipping container 10 in a closed position (e.g., with top seam 132 closed to seal off opening 134). Expandable shipping container 10 may be in a closed position when the pair of top flaps 113, 132, are positioned such that they are substantially perpendicular to first side panel 110 and second side panel 120 such that the edge of top flap 113 of first side panel 110 is adjacent to the edge of top flap 123 of second side panel 120, forming top seam 132. Although this description refers to the top flaps 113, 123 forming top seam 132, it should be understood that in some embodiments, because the flexible barrier 200 encloses the top flaps, the top seam 132 may actually be formed by portions of the flexible barrier 200 that contour the edges of the top flaps 113, 123. When the pair of top flaps 113, 123 are positioned in the closed position, top seam 132 may be sealed to securely close the expandable shipping container 10. According to some embodiments, top seam 132 may be sealed by being glued (or adhered via any type of adhesive), stitched, stapled, taped, or any other known means or method of sealing two flaps, alone or in combination. According to some embodiments, when expandable shipping container 10 is in an expanded configuration, first side panel 110, second side panel 120, fourth side panel 140, fifth side panel 150, and sixth side panel 160 may each comprise a substantially flat, rectangular shape that together form a set-up box. As will be described in greater detail below, fifth side panel 150 may be formed from first side flap 111 of first side panel 110 and first side flap 121 of second side panel, and sixth side panel 160 may be formed from second side flap 112 of first side panel 110 and second side flap 122 of second side panel. As shown in FIG. 2C, which illustrates expandable shipping container 10 in an open position (e.g., with top seam 132 open to allow access to opening 134), the third side (i.e., top) panel 130 may comprise two top flaps 113, 123 that may be selectively moved relative to one another to open or close top seam 132, thereby selectively opening and closing expandable shipping container 10. When in an open position, as shown in FIG. 2C, top flaps 113, 123 may be in a position that is non-perpendicular to first side panel 110 and second side panel 120, respectively, thereby providing an opening 134 at the top end of expandable shipping container 10 that provides access to the internal chamber of expandable shipping container 10.

Figure 3A:
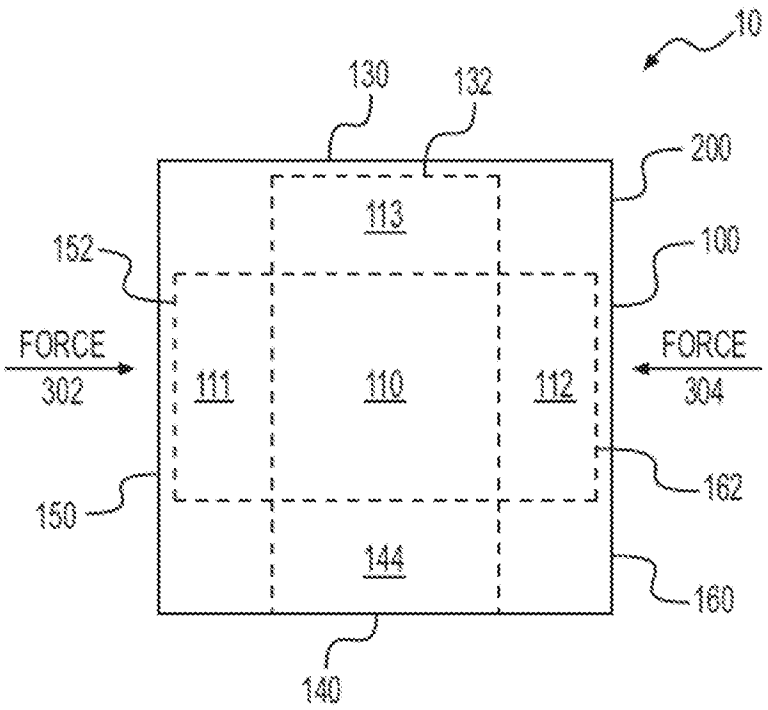
Figure 3D:
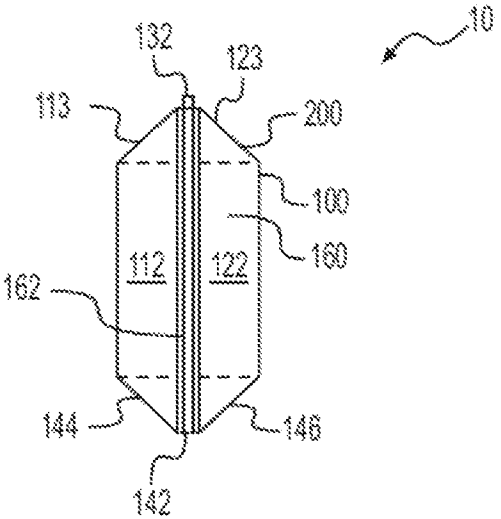
Figure 3C:
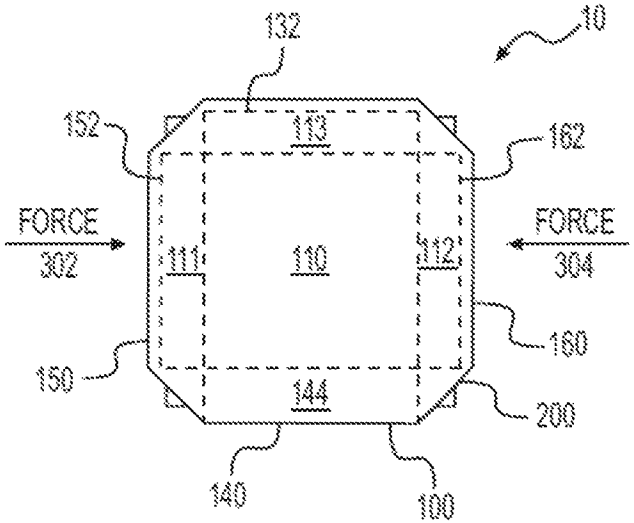
Figure 3F:
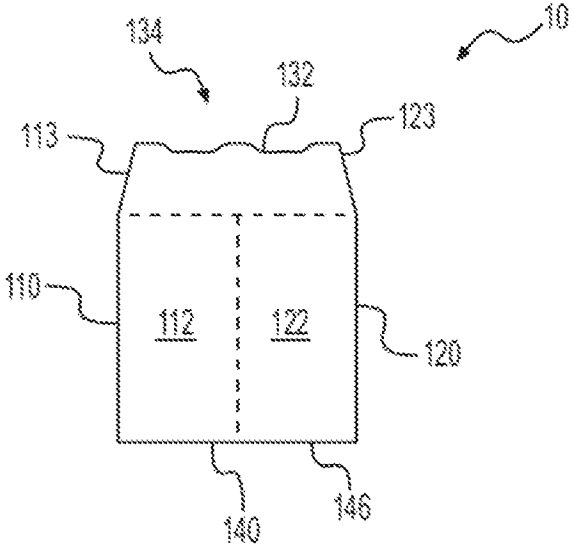
Figure 3E:
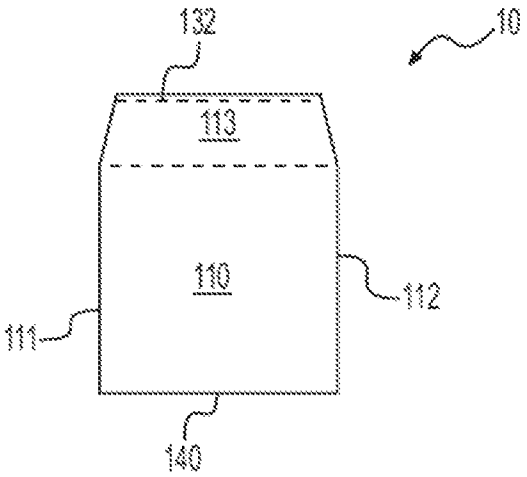

FIGS. 3A-3F are illustrations of expandable shipping container 10 as it transitions from the collapsed configuration to the expanded configuration, in accordance with some embodiments. FIGS. 3A-3B show expandable shipping container 10 in a collapsed configuration, FIGS. 3C-3D show expandable shipping container 10 in a partially expanded configuration, and FIGS. 3E-3F show expandable shipping container 10 in an expanded configuration. Expandable shipping container 10 may be transformed from the collapsed configuration into the expanded configuration in a matter of seconds and without the use of tools by applying force 302, 304 to two opposite sides of the expandable shipping container 10. For example, if opposing, inward forces 302, 304 are applied to fifth side panel 150 and sixth side panel 160, the applied force 302, 304 causes expandable shipping container 10 to expand from a substantially flat collapsed "storage" configuration to a substantially box-like expanded "in use" configuration. Forces 302, 304 may be most effective if directed proximate middle central area of the fifth and sixth side panels 150, 160, where, as described in further detail below, seams 152, 162 allow for fifth and sixth side panels 150, 160 to bend. In other embodiments, suction devices may outwardly pull on faces 110, 120 to expand expandable shipping container 10 into the expanded configuration. In further embodiments, an inflatable module (e.g., an inflatable bag) may be inserted within expandable shipping container 10 and configured to form an expanded cavity whose expanded outer surfaces outwardly pushes the inner sidewalls of expandable foam container 10 until expandable foam container 10 enters the expanded configuration. The inflatable module may then deflate (e.g., by being popped or having a discharge valve opened) to return expandable foam container 10 to a collapsed configuration.

According to some embodiments, when force 302 is applied to fifth side panel 150, it causes the pair of first side flaps 111, 121 to bend inwardly such that the outer edges of the pair of first side flaps 111, 121 move towards the center of expandable shipping container 10. Likewise, when force 304 is applied to sixth side panel 160, it causes the pair of second side flaps 112, 122, to bend inwardly such that the outer edges of the pair of second side flaps 112, 122 move towards the center of expandable shipping container 10. Thus, upon application of opposing inward forces 302, 304 to the sides of expandable shipping container 10, the pairs of first side flaps 111, 121 and second side flaps 121, 122 bend from a position that is substantially parallel to first side panel 110 and second side panel 120 to a position that is substantially perpendicular to first side panel 110 and second side panel 120. Additionally, in some embodiments, application of opposing inward forces 302, 304 to the sides of expandable shipping container 10 pulls on the flexible barrier 200 and in turn causes the two halves 144, 146 of the bottom panel 140 to bend from a position that is substantially parallel to first side panel 110 and second side panel 120 to a position in the collapsed configuration to a position that is substantially perpendicular to first side panel 110 and second side panel 120 in the expanded configuration.

Figure 4B:
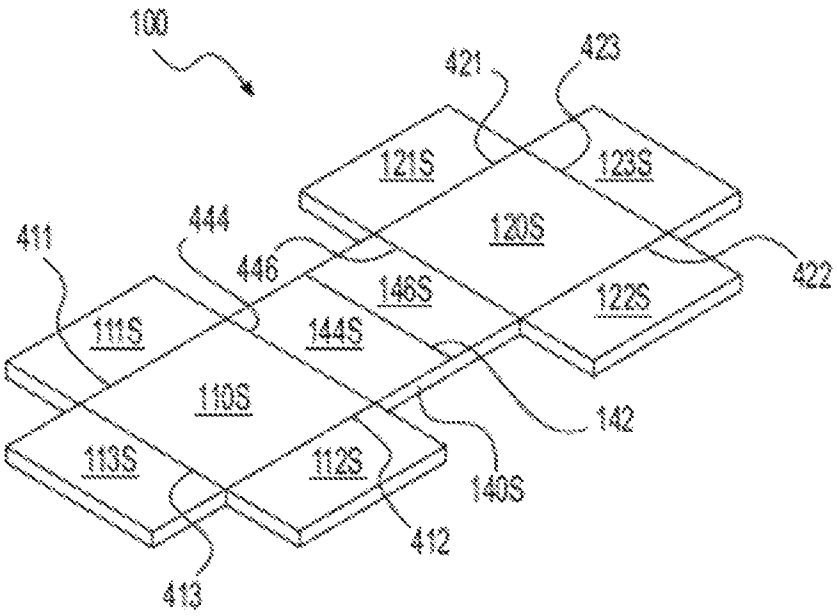
FIGS. 4A-4E show top isometric views of an inner structure of an expandable shipping container that is cut (FIG. 4A), scored (FIG. 4B), partially folded (FIG. 4C), fully folded (FIG. 4D) to form the structure of the shipping container in an open position, and covered in a flexible barrier (FIG. 4E), in accordance with some exemplary embodiments.
Figure 4A:
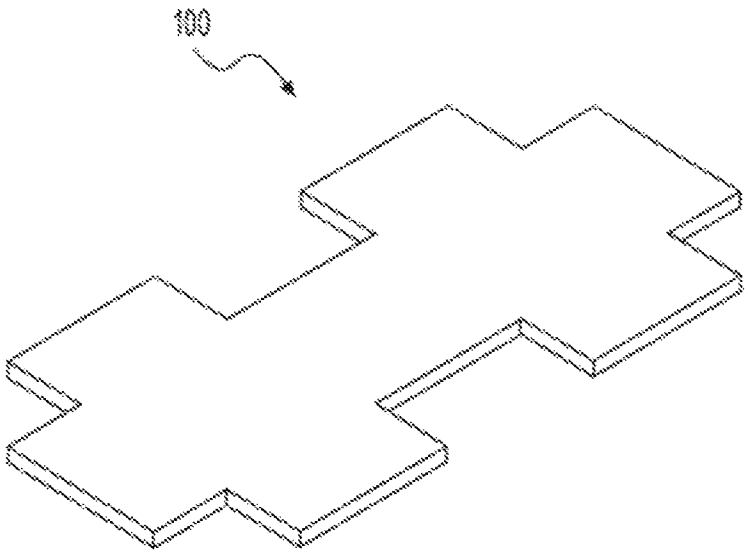
Figure 4D:
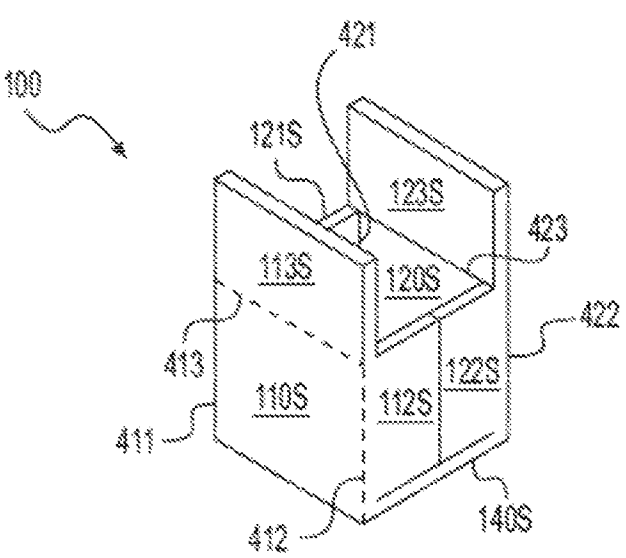
Figure 4C:
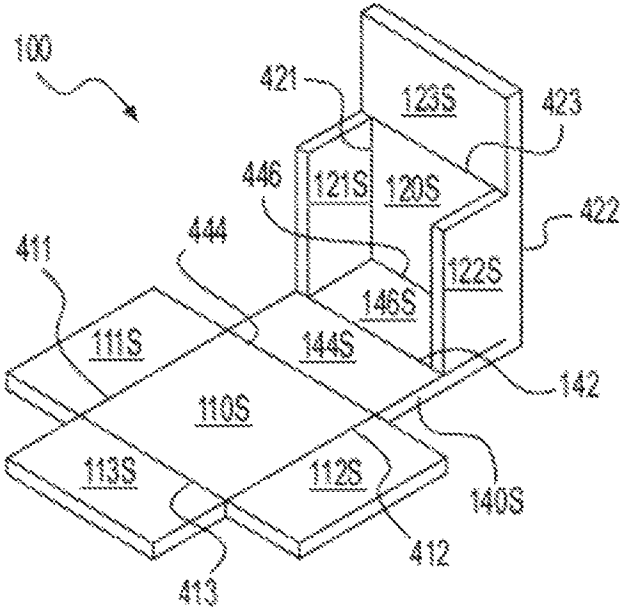
Figure 4E:
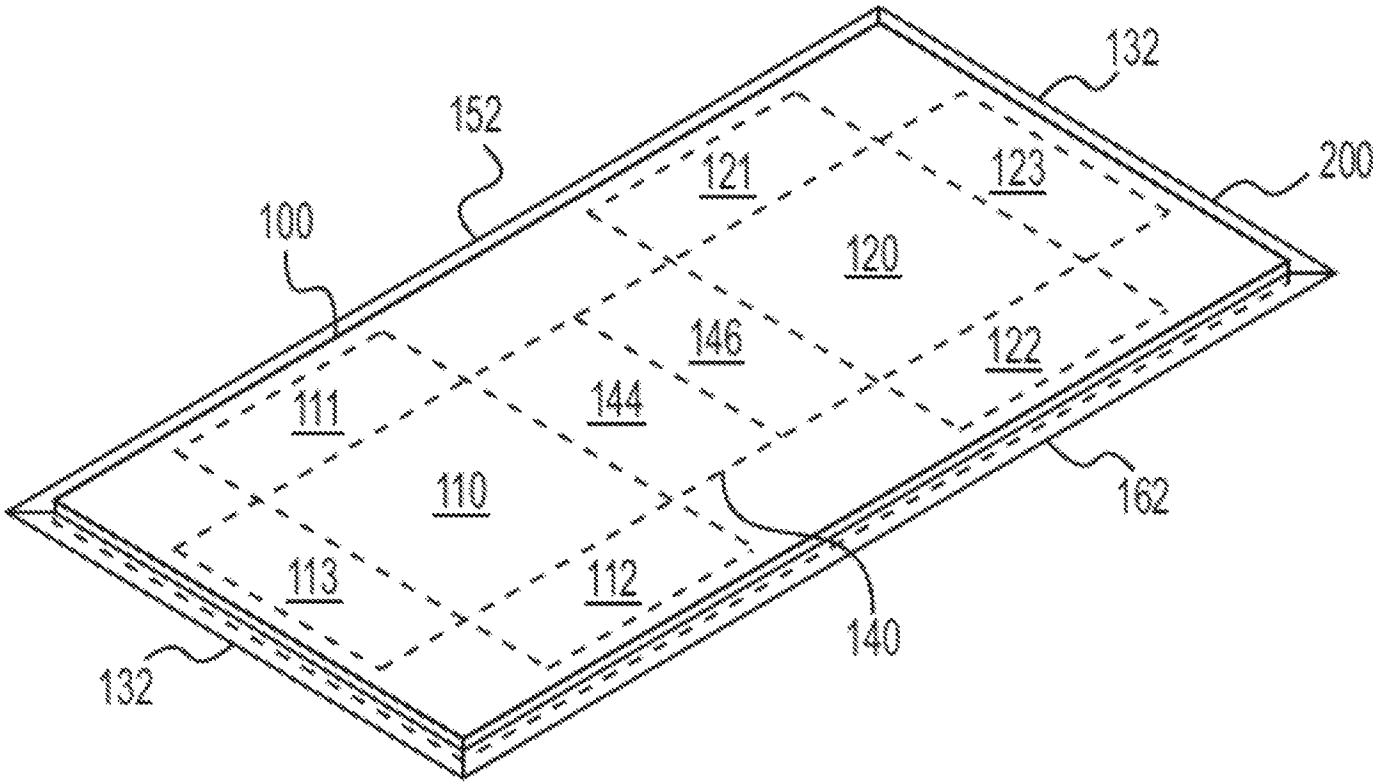

FIGS. 4A-4E are illustrations of inner structure 100 for expandable shipping container 10 in various states of assembly, in accordance with some embodiments. Inner structure 100 may be formed by one or more layers of insulation materials or mediums. In some embodiments, inner structure 100 may be made from an insulating medium that may range from 0.125 inches to 3.0 inches in thickness. Inner structure 100 may have a density ranging from 1 ounces per square yard (OPSY) to 10 OPSY in some embodiments, and from 1 OPSY to 50 OPSY in other embodiments. FIG. 4A shows inner structure 100 after being initially cut, before it has been scored or folded. It is contemplated that inner structure 100 may be made from a single, integrated piece of material, such as a single piece of curbside recyclable cornstarch panel, cardboard, wood, or insulation materials (e.g., the insulation panel disclosed in the U.S. Provisional Patent Application No. 62/491,666). Alternatively, as discussed in more detail in FIGS. 5A-5E, inner structure 100 may include multiple sub-structures. According to some embodiments, the single piece of material forming the inner structure 100 may have a shape similar to that shown in FIG. 4A, and include a first side panel 110S connected to a second panel 120S via a bottom panel 140S (corresponding to respective panels 110, 120, 140 of expandable container 10 once inner structure 100 is enclosed by flexible barrier 200, as shown in FIG. 4E). First side panel 110S may have a portion that extends from a side opposite bottom panel 140S that may be used as a top flap 113S, and may have portions extending from the other two opposing sides that may be used as a first side flap 111S and a second side flap 112S (corresponding to respective panels and flaps of expandable container 10 once inner structure 100 is enclosed by flexible barrier 200, as shown in FIG. 4E). In some embodiments, second side panel 120S may be a similar configuration to first side panel 110, having portions that may be used as a first side flap 121S, a second side flap 122S, and a top flap 123S (corresponding to respective panels and flaps of expandable container 10 once inner structure 100 is enclosed by flexible barrier 200, as shown in FIG. 4E).

As shown in FIG. 4B, inner structure 100 that is made from a single piece of material is scored to form bendable pieces, such as flaps. For example, first side panel 110S has a first side flap scoreline 411 to form first side flap 111S, a second side flap scoreline 412 to form second side flap 112S, a top flap scoreline 413 to form top flap 113S, and a bottom scoreline 444 between first side panel 110S and bottom panel 140S that may allow first side panel 110S to bend relative to bottom panel 140S. Likewise, second side panel 120S has a first side flap scoreline 421 to form first side flap 121S, a second side flap scoreline 422 to form second side flap 122S, a top flap scoreline 423 to form top flap 123S, and a bottom scoreline 446 between second side panel 120S and bottom panel 140 that may allow second side panel 110S to bend relative to bottom panel 140S. Bottom panel 140S may have a bisecting scoreline 142 that divides bottom panel 140S into a half 144S extending from first side panel 110 and a half 146S extending from second side panel 120. Bisecting scoreline 142 may enable one half 144S of bottom panel 140S to be bendable relative to the other half 146S of bottom panel 140. As will be appreciated by those of skill in the art, each scoreline may be an impression or cut in inner structure 100 that allows a portion of the inner structure 100 to bend about the scoreline, and each scoreline may be angled to allow pieces of inner structure 100 to bend at the desired angle (e.g., at about 90°). For example, top flap scoreline 413 is scored to form angles greater than 30° in inner structure 100 to allow top flap 113S to bend about 90° relative to first side panel 110. Similarly, bisecting scoreline 142 may be scored to form angles greater than 60° in inner structure 100 to allow half 144S to bend about 180° relative to the other half 146S of bottom panel 140S. It is contemplated that inner structure 100 will have between five and ten scorelines in some embodiments, and between eight and nine scorelines in other embodiments. Scorelines may be formed by any known means, such as, for example, by a die cut or a flexo folder process.

FIG. 4C illustrates inner structure 100 in a partially assembled position. As shown, second side panel 120S may bend about 90° along bottom scoreline 446 so that second side panel 120S is perpendicular to bottom panel 140S. First side flap 121S and second side flap 122S may bend along first side flap scoreline 421 and second side flap scoreline 422, respectively, such that the first side flap 121S and second side lap 122S are perpendicular to both second side panel 120S and bottom panel 140S. As shown in FIG. 4D, first side panel 110S and its side flaps 111S, 112S may bend in a mirror image fashion to that of second side panel 120S such that the edge of both first side flaps 111S, 121S meet to form a seam 152 and the edge of both second side flaps 112, 122 meet to form a seam 162. The pairs of first side flaps 111S, 121S and second side flaps 122S may then be sealed together at their respective seams 152, 162 to form a fifth side panel 150S and a sixth side panel 160S, respectively. In some embodiments, the seams 152, 162 between the flaps may be sealed by heat sealing, being glued together, wire stitched together, stapled, taped, or joined in any other suitable fashion.

FIG. 4D shows inner structure 100 in an assembled position as described above. According to some embodiments, an assembled inner structure 100 may include rigid first panel 110S, rigid second panel 120S, bottom panel 140S that may bend about bisecting scoreline 142, fifth side panel 150S that may bend about seam 152S, sixth side panel that may bend about seam 162S, and top panel 130S comprising a pair of top flaps 113S, 123S that may bend about top flap scorelines 413, 423 to enable the assembled, expanded container 10 to be selectively open or closed. In some embodiments, side seams 152S, 162S of the fifth and sixth side panels 150S, 160S and bisecting scoreline 142 of bottom panel 140S may enable inner structure 100 to bend to such that it may change between a collapsed configuration and an expanded configuration as shown in FIGS. 1A-2C.

As shown in FIG. 4E, flexible barrier 200 encloses the cut and scored inner structure 100 from FIG. 4B. Once enclosed by barrier 200, inner structure 100 can be folded as shown and described with respect to FIGS. 4C-4D to form the shape of expandable shipping container 10. In some embodiments, flexible barrier 200 is shrink-wrapped onto inner structure 100.

Figure 4G:
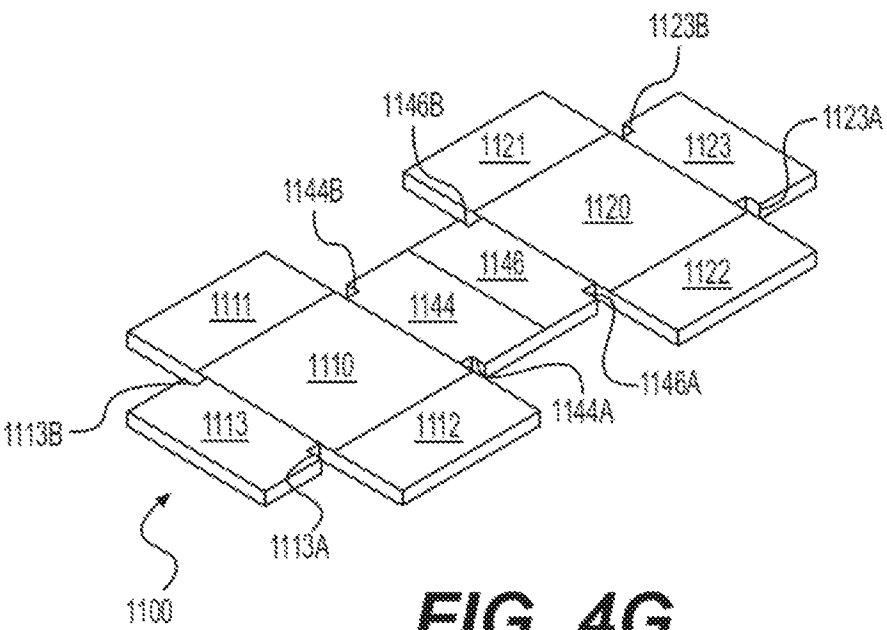
FIGS. 4F-4I show top isometric views of an inner structure of an expandable shipping container configured for use with an insulation panel (FIG. 4F), a notched insulation panel (FIGS. 4G and 4H), and the insulation panel attached to the inner structure (FIG. 4I), in accordance with other exemplary embodiments.
Figure 4F:
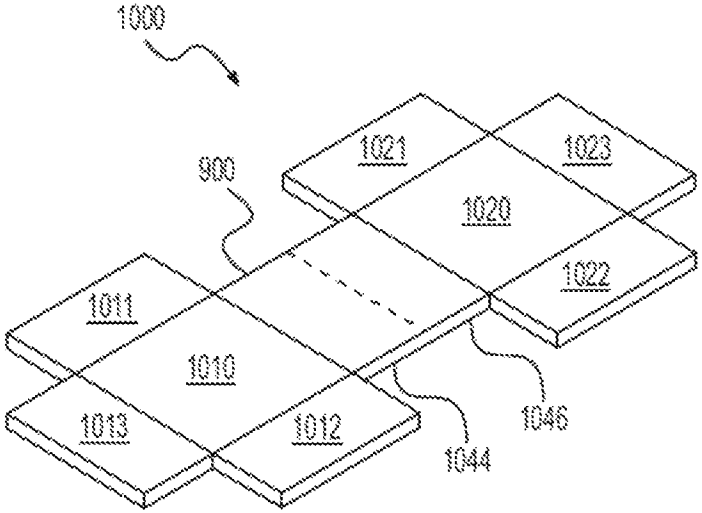
Figure 4H:
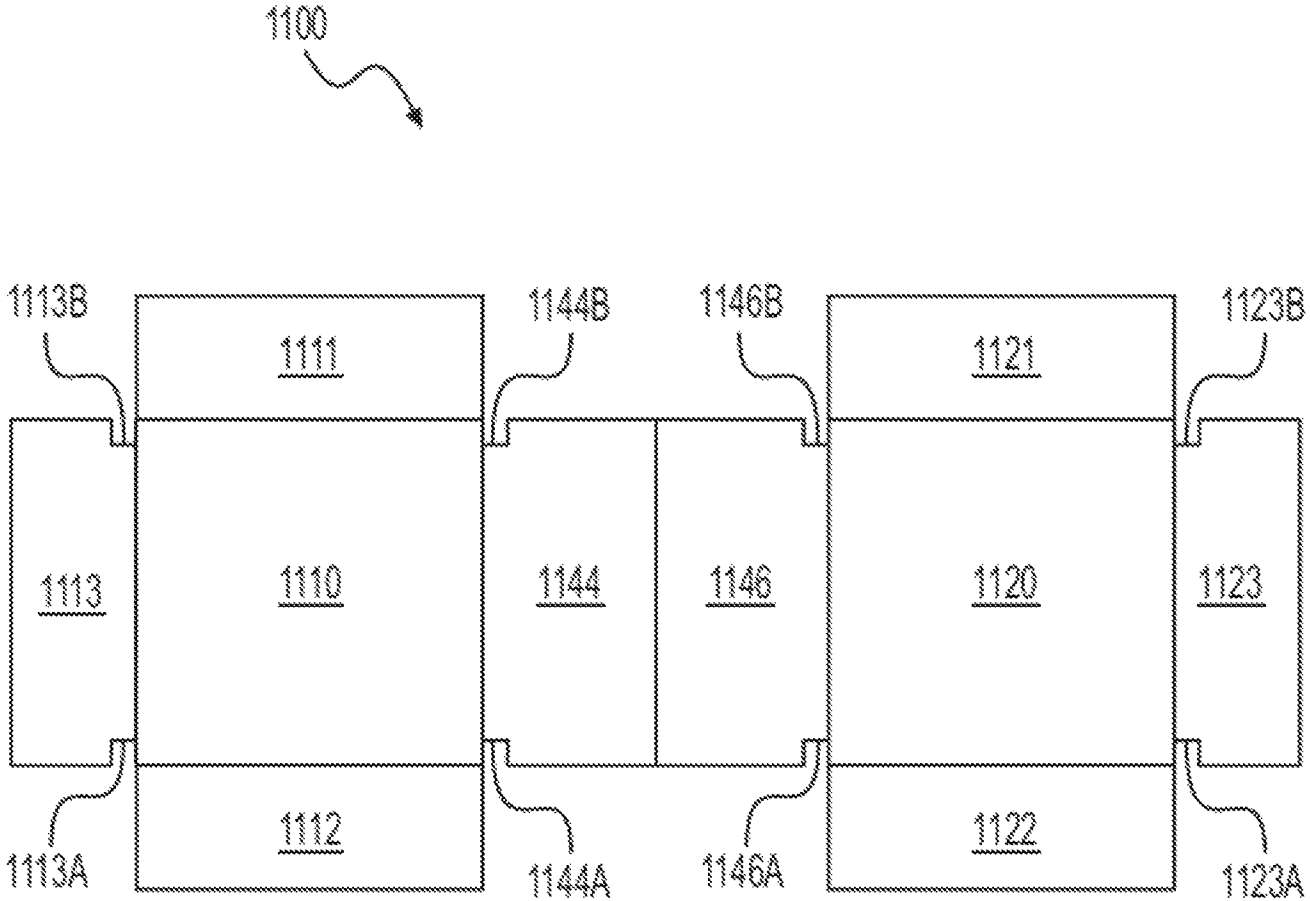
Figure 4I:
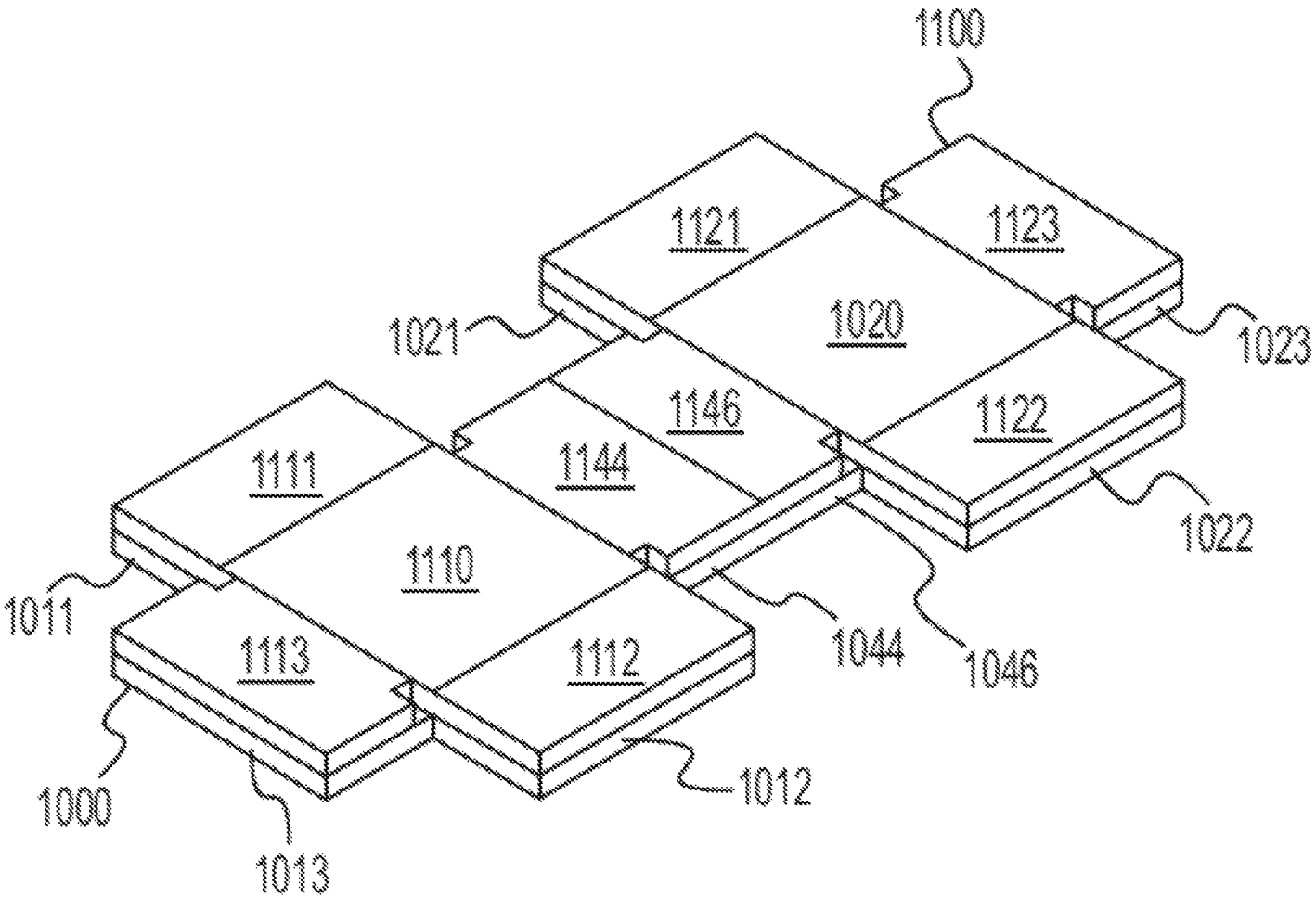

FIGS. 4F-4H show an alternate embodiment of an inner structure 1000 configured for use with an insulation panel 1100. Inner structure 1000, shown more clearly in FIG. 4F, can be a rigid corrugated backing (e.g., corrugated fiberboard) that is cut and scored in the same manner described above with respect to inner structure 100 of FIG. 4B to generate corresponding panels 1010 and 1020, flaps 1011, 1012, 1013, 1021, 1022, 1023, 1044, and 1046, and scorelines. Inner structure 1000 further includes an adhesive layer 900 that is applied to a portion of the top surface of inner structure 1000 (e.g., over flaps 1044 and 1046, as shown). In other embodiments, adhesive layer 900 is applied to other panels and/or flaps of inner structure 100. Insulation panel 1100, shown more clearly in FIGS. 4G-4H, can be made from an insulation material (e.g., the insulation panel disclosed in the U.S. Provisional Patent Application No. 62/491,666). Insulation panel 1100 is cut and scored in a manner similar to inner structure 1000 to generate corresponding panels 1110, 1120, flaps 1111, 1112, 1113, 1121, 1122, 1123, and scorelines. As shown in FIGS. 4G and 4I, insulation panel 1100 is further cut to include a plurality of notches 1113A, 1113B, 1144A, 1144B, 1146A, 1146B, 1123A, and 1123B positioned at the edges of respective flaps 1111, 1112, 1113, 1121, 1122, and 1123. These notches allow for improved folding of the combined inner structure 1000 and insulation panel 1100 into shapes similar to those shown in FIGS. 4C and 4D, particularly in embodiments where inner structure 1000 exceeds a minimum thickness threshold. FIG. 4I shows the pairing of the insulation panel 1100 to the top surface of inner structure 1000 via adhesive layer 900. When paired, inner structure 1000 may provide structural rigidity, strength, and durability to insulation panel 1100.

As an alternative embodiment of the single-piece inner structure 100 as shown in FIGS. 4A-4E, FIGS. 5A-5E provide illustrations of a multi-piece inner structure 500 for an expandable shipping container 10 in various states of assembly. As shown, inner structure 500 may include a first sub-structure 502 and a second sub-structure 504. First sub-structure 502 and second sub-structure 504 may be identical, allowing for more efficient manufacturing. In some embodiments, when placed adjacent to one another, such that the outer edge of the half 144S extending from first side panel 110S aligns with the outer edge of the half 146S extending from second side panel 120S, first sub-structure 502 and second sub-structure may collectively have the same shape and/or dimensions as the single piece of material used for an inner structure 100 shown in FIGS. 4A-4E. Further, expandable shipping container 10 may be assembled from first sub-structure 502 and second sub-structure 504 in the substantially the same manner described above with respect to inner structure 100 of FIGS. 4A-4E, except that the halves 144, 146 of the bottom panel 140 have to be sealed together at the bottom seam 240. According to some embodiments, bottom seam 240 may be sealed in a manner similar to that described above with respect to the sealing of seams 152, 162.

Figure 5B:
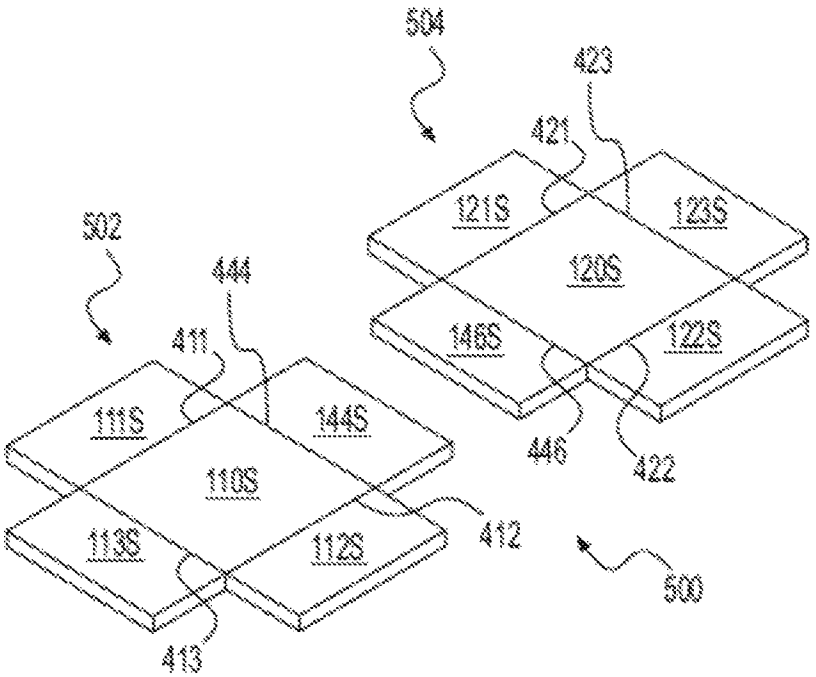
FIGS. 5A-5E show top isometric views of an inner structure of an expandable shipping container having two sub-structures that are cut (FIG. 5A), scored (FIG. 5B), partially folded (FIG. 5C), fully folded (FIG. 5D) to form the structure of the shipping container in an open position, and covered in a flexible barrier (FIG. 5E), in accordance with other exemplary embodiments.
Figure 5A:
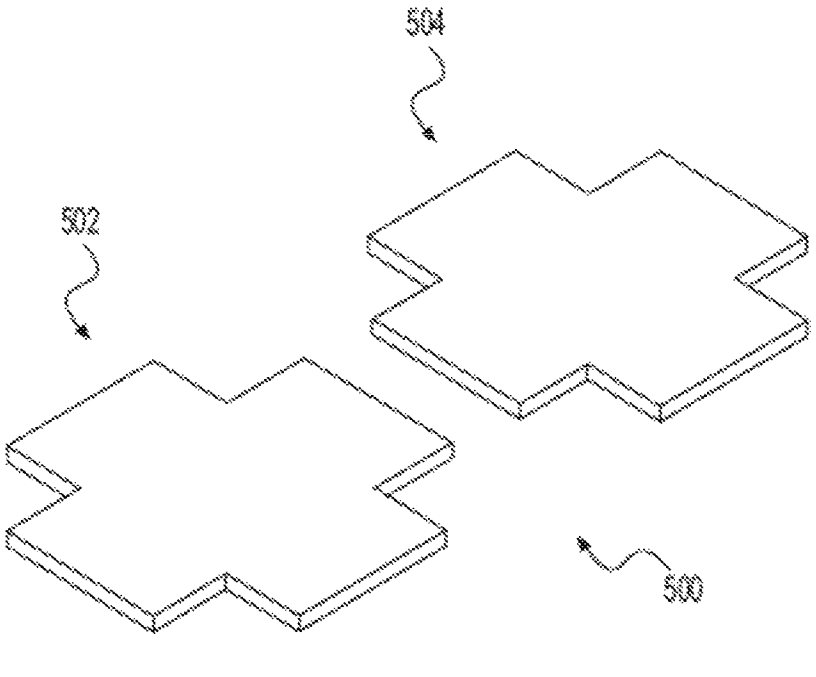
Figures 5C, 5D:
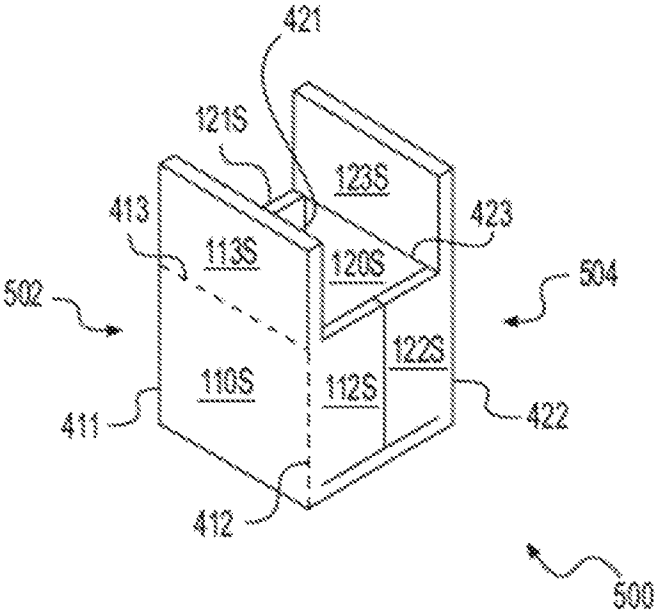
Figure 5E:
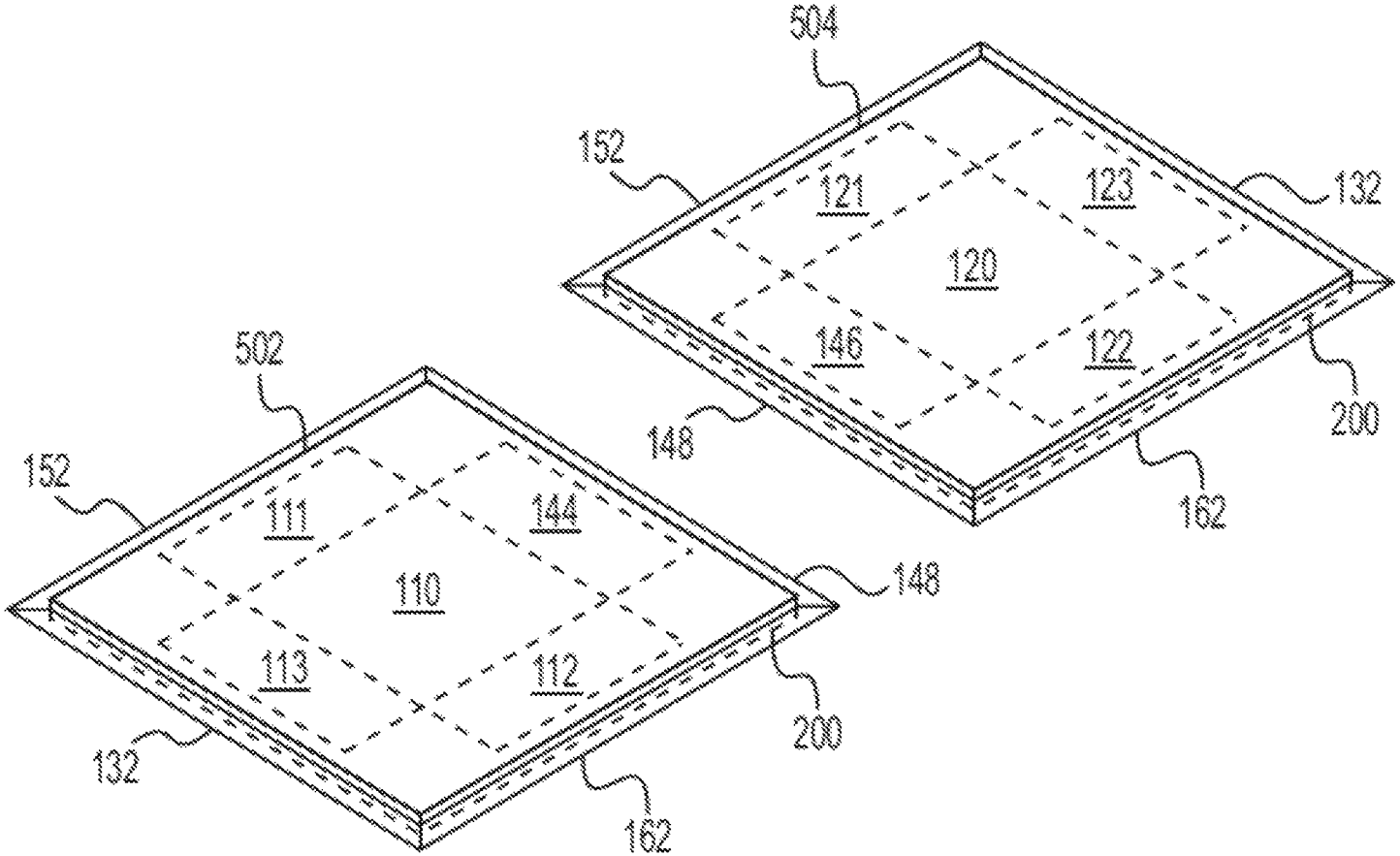
Figure 5G:
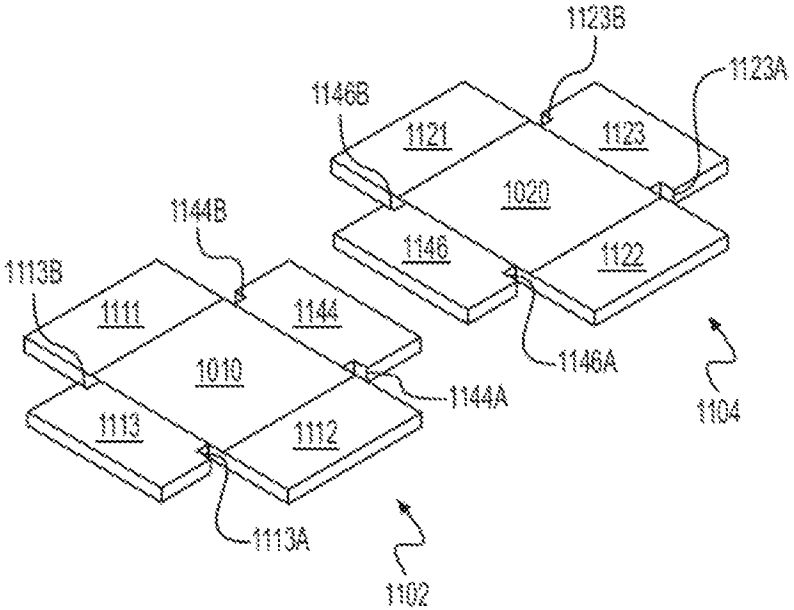
FIGS. 5F-5I show top isometric views of an inner structure of an expandable shipping container having two sub-structures (FIG. 5F) for use with an insulation panel having two notched sub-structures (FIGS. 5G and 5H), and the insulation panel attached to the inner structure (FIG. 5I), in accordance with other exemplary embodiments.
Figure 5F:
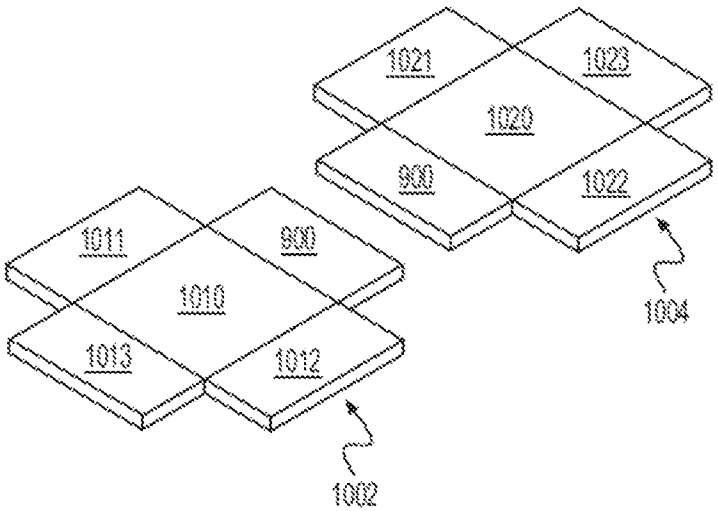
Figure 5H:
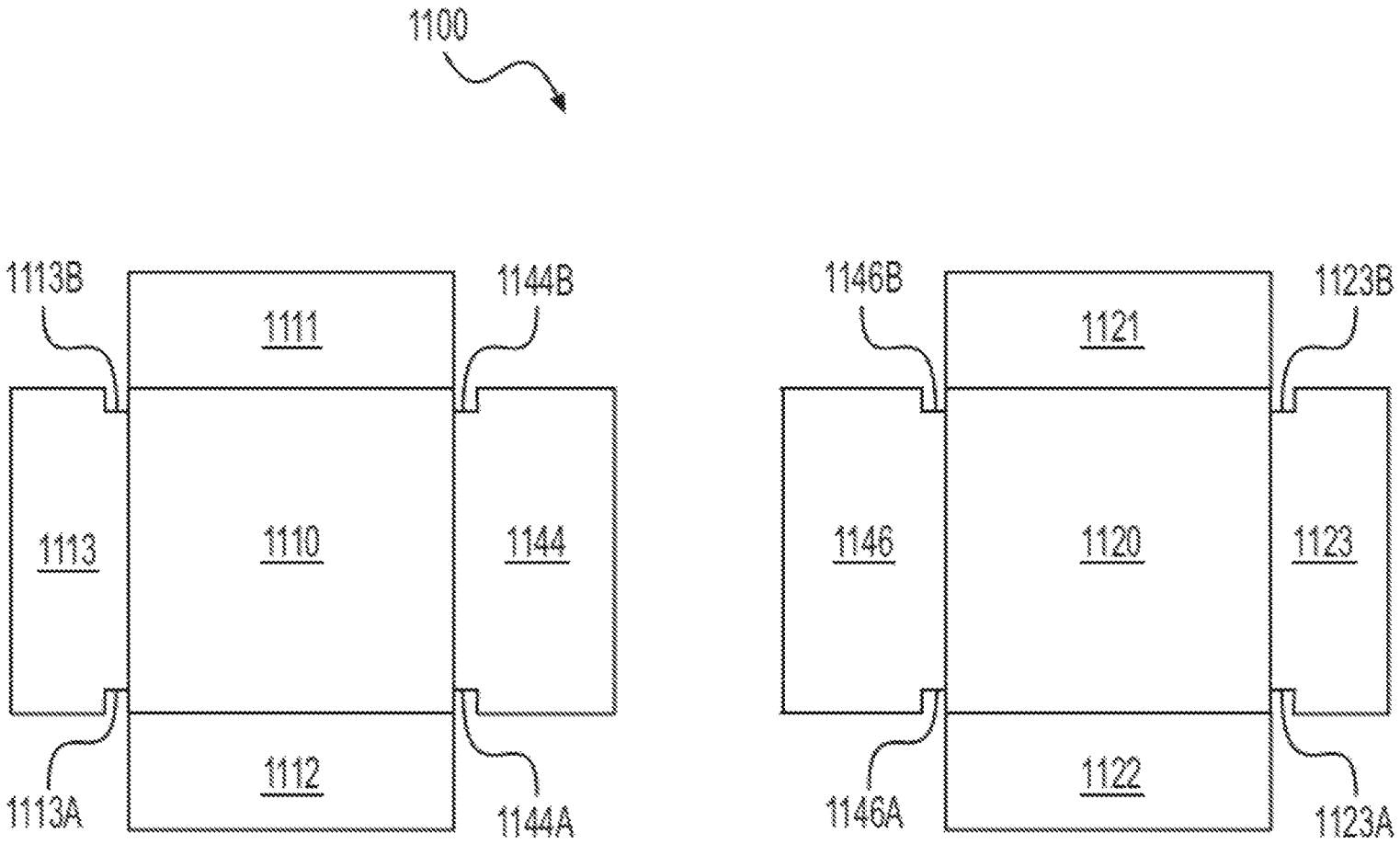
Figure 5I:
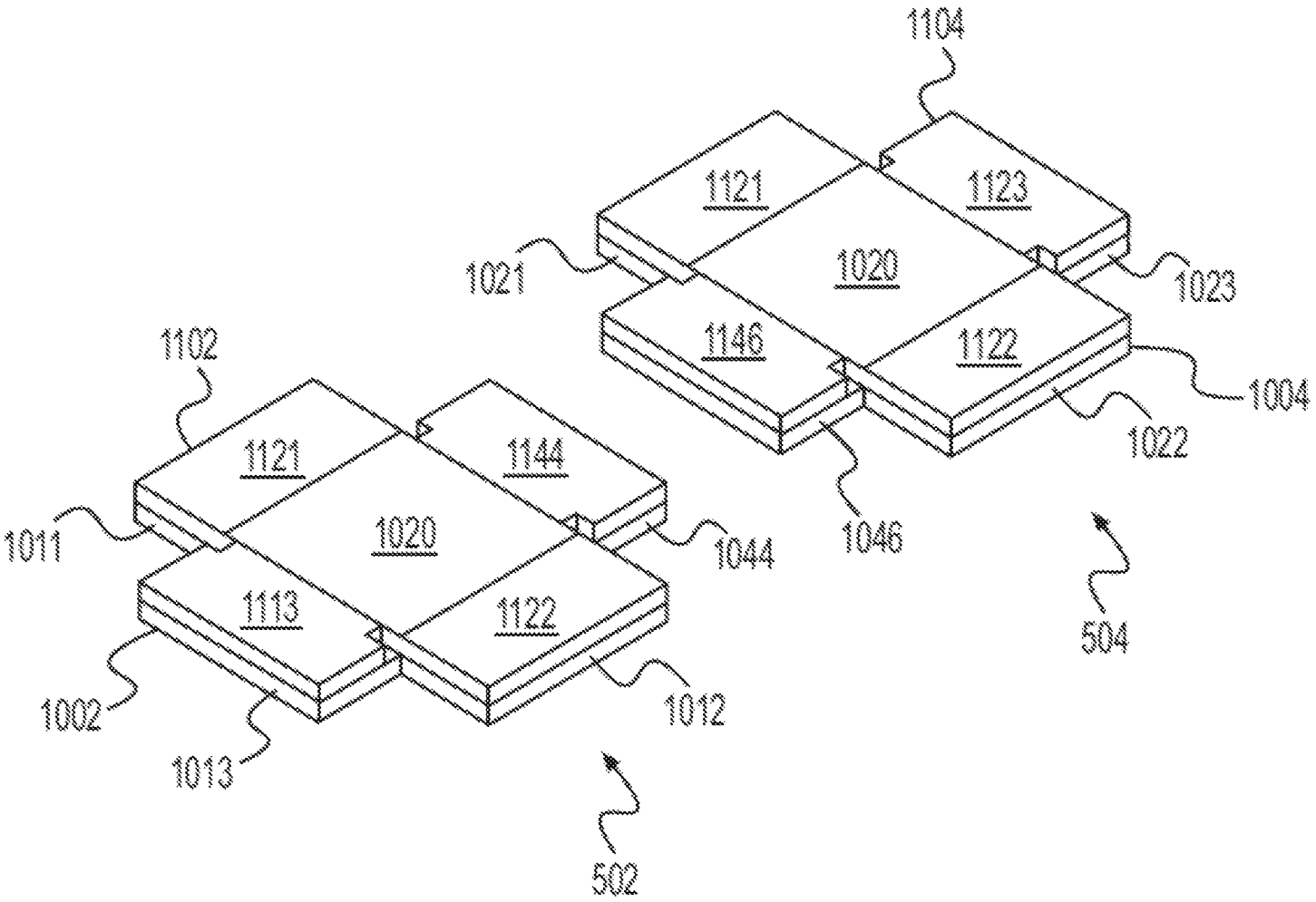

FIGS. 5F-5I illustrate an alternative embodiment to the multi-piece inner structure 500 shown in FIGS. 5A-5E, having a first sub-structure 1002 and a second sub-structure 1004 each having a rigid corrugated backing (e.g., corrugated fiberboard) configured to be affixed to (e.g., via adhesive layer 900) corresponding insulation panel sub-structures 1102, 1104 (e.g., the insulation panel disclosed in the U.S. Provisional Patent Application No. 62/491,666) in a manner that is similar to that described above with respect to FIGS. 4F-4I. The inner sub-structures 1002, 1004 are cut and scored similar to the sub-structures 412, 422 in FIG. 5B and adhesive layer 900 is applied to the top surface of each. As shown in FIGS. 5G and 5H, insulation panel sub-structures are cut, scored, and notched in a manner similar to that of FIG. 4G. As shown in FIG. 5I, the notched sub-structures 1102, 1104 of the insulation panel may then be joined with the sub-structures 1002, 1004 of the inner structure via adhesive layer 900.

Figure 6A:
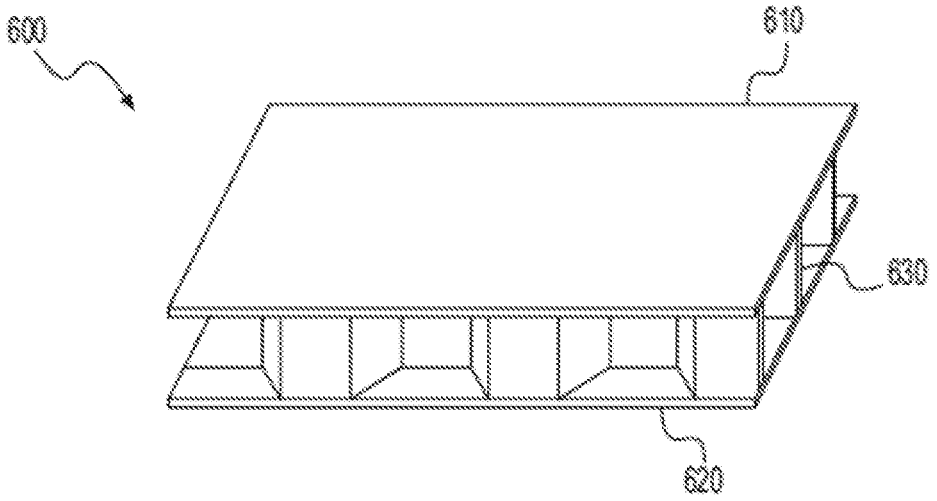
FIGS. 6A-6B show a top isometric view (FIG. 6A) and an exploded view (FIG. 6B) of a panel structure of an inner structure of an expandable shipping container, in accordance with some exemplary embodiments.
Figure 6B:
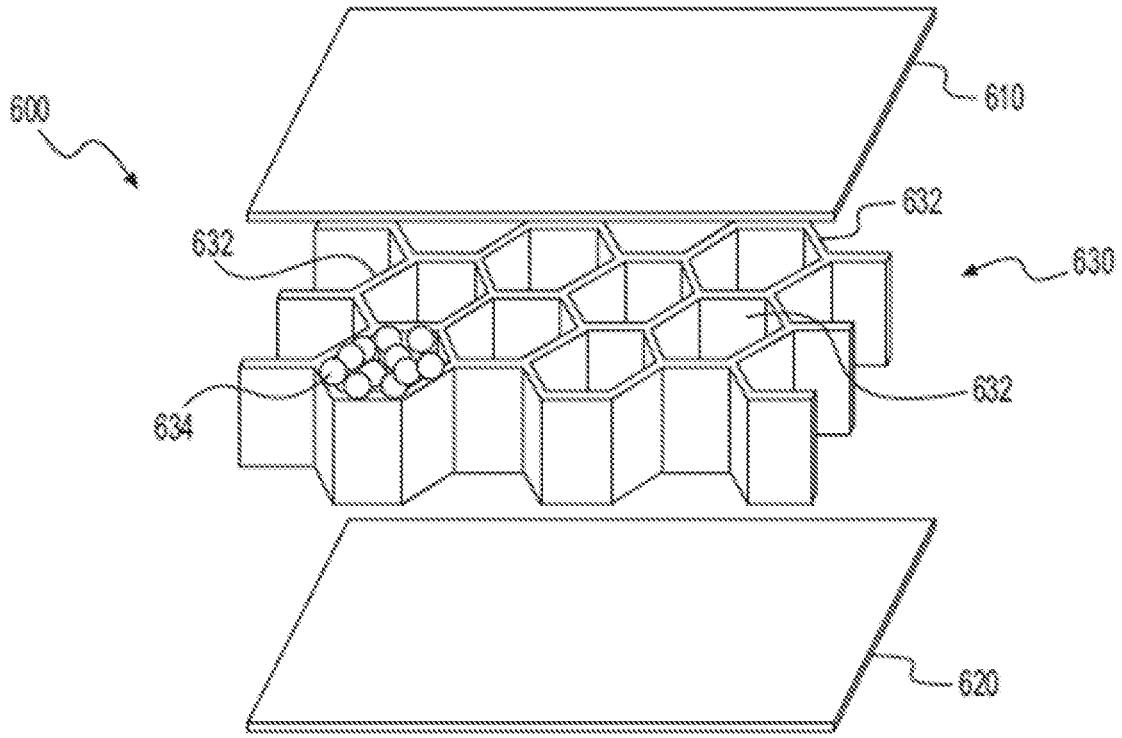

FIGS. 6A-6B are illustrations of a panel structure 600 that may form the inner structure of expandable shipping container 10, in accordance with some embodiments. It should be understood that panel structure 600 can be used in any of the embodiments described herein, such as those depicted in FIGS. 1A-5I, 7-8B, and 11A-16. Panel structure 600 may include a top linerboard 610 (which may also be referred to as a top liner or top facing), a bottom linerboard 620, and an internal core 630 positioned between the top linerboard 610 and bottom linerboard 620. In some embodiments, internal core 630 is made from paper or paper based materials, which may be repulpable, recyclable, compostable, and water resistant similar to other paper based materials described herein. As shown more clearly in FIG. 6B, internal core 630 may form a honeycomb structure having a plurality of cells 632. Although cells 632 may be of any shape or size, in some embodiments cells 632 have a diameter of 0.25 inches to 3.0 inches. One or more of cells 632 may be serve to hold particulate 634, which may provide thermal insulation for expandable shipping container 10 without inhibiting expandable shipping container 10 from being curbside recyclable. For example, in some embodiments, particulate 634 is made from materials such as cellulose (which may be in shredded form) or puffed vegetable starch (e.g., corn-starch) particles, or a combination thereof. Additionally, to be curbside recyclable, internal core 630 may be paper-based and have a paper gauge between #25 and #60. The thickness of internal core 630 may be tailored to a desired characteristic of panel structure 600 (e.g., a thicker internal core 630 may provide better insulation properties).

Cells 632 may be sized, shaped, and designed based on desired characteristics of panel structure 600. For example, one or more of cells 632 may be devoid of particulate 634 such that they only contain ambient air. Additionally, all of cells 632 may contain a homogenous blend of particulate material in some embodiments while one or more cells 632 may contain different types of materials, such that a first subset of cells 632 contains particulate 634 of a first material and a second subset of cells 632 contains particular 634 of a second material, in other embodiments. Although FIG. 6B shows internal core 630 having a honeycomb structure comprising a plurality of hexagonal cells 632, it should be understood that internal core 632 may comprise a variety of different shapes (e.g., triangular), sizes (and also varying or uniform sizes), and designs of cells 632 capable of holding particulate 634. For example, larger cells 632 may be better suited for housing particulate 634 and thereby providing insulation, but are often weaker than smaller cells 632.

In other embodiments, an insulation panel as fully described in the U.S. Provisional Patent Application No. 62/491,666 may form the inner structure of expandable shipping container 10.

Figure 7:
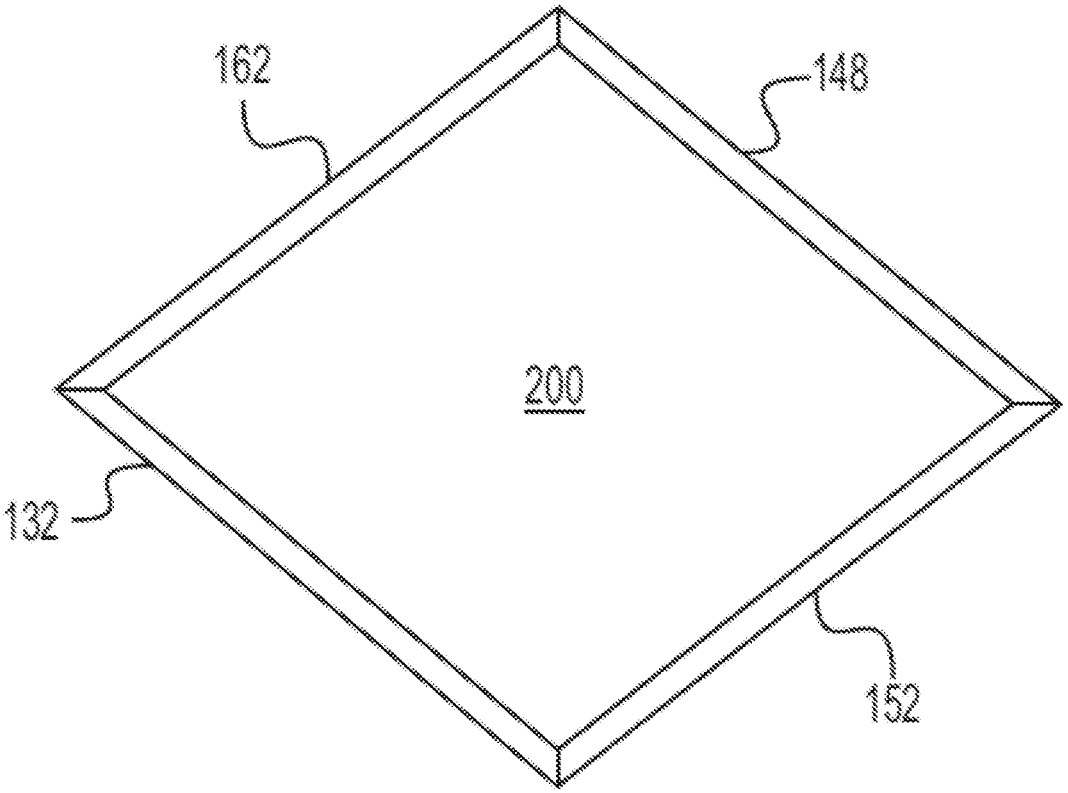
FIG. 7 shows a top isometric view of a flexible barrier of an expandable shipping container, in accordance with some exemplary embodiments.

FIG. 7 is an illustration of flexible barrier 200 of an expandable shipping container 10, in accordance with some embodiments. As shown, when devoid of inner structure 100 or 500, flexible barrier 200 may be substantially flat and have an approximately square or rectangular shape, though flexible barrier 200 may take on other shapes to match the desired shape of expandable shipping container 10. After flexible barrier 200 encloses inner structure 100, as shown in FIGS. 4E and 5E, the combined structure 100 and barrier 200 may be folded in half (FIG. 4E) or the combined structures 502, 504 and respective barriers 200 may be paired (FIG. 5E) and one or more outer edges of flexible barrier 200 may be sealed (e.g., heat sealed or stitched) to form the expandable shipping container shown in FIGS. 1A-2C. Shown in more detail in FIG. 7, the resulting seals along the outer edges of flexible barrier 200 may include top seam 132, fifth side seam 152, sixth side seam 162, and, as shown for exemplary purposes in FIG. 7 further to the embodiment shown in FIG. 5E, a fourth side seam 148 (which may be referred to as a bottom seam 148). As will be appreciated by one of skill in the art, seams 132, 152, 162, and 148 can be sealed by any known sealing means, including heat sealing and stitching. Top seam 132 may be an open seam forming opening 134 as shown in FIG. 2C. Bottom seam 148 may align with bisecting scoreline 142, fifth side seam 152 may be aligned between the pair of first side flaps 111, 121, and sixth side seam 162 may be aligned between the pair of second side flaps 112, 122. In some embodiments, flexible barrier 200 may be sealed on all sides but one, thereby forming an enclosure that may be accessed via opening 134. According to some embodiments, flexible barrier 200 may be entirely made from kraft paper, such as laminated kraft paper. In some embodiments, flexible barrier 200 may be laminated or coated with one or more coating materials (e.g., a repulpable and curbside recyclable heat-activated coating or any hydrophobic coating that is repulpable and curbside recyclable) to provide water resistance properties. For example, kraft paper used to make flexible barrier 200 may be coated with a repulpable and curbside recyclable heat-activated coating in some embodiments or any organic hydrophobic coating that is repulpable and curbside recyclable in other embodiments. In some embodiments, the sealing of flexible barrier 200 on all sides, except the opening that may be sealed after packing, provides for a leak resistant enclosure, and in some cases, a leak proof enclosure. In some embodiments, flexible barrier 200 may be made of a material that is repulpable, recyclable, compostable, and/or water resistant. In some embodiments, flexible barrier 200 may be made of a material that may be heat sealed.

Figure 8B:
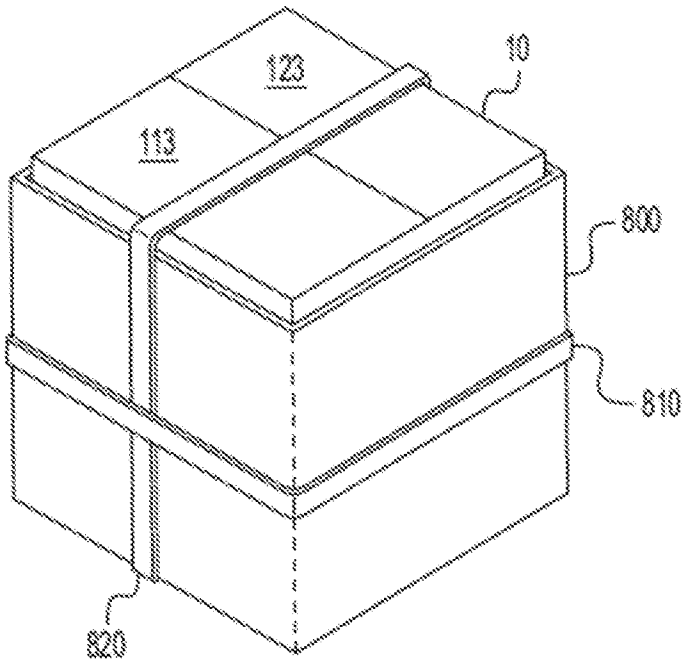
FIGS. 8A-8B show top isometric views of a sleeve for an expandable shipping container alone (FIG. 8A) and assembled with an expandable shipping container (FIG. 8B), in accordance with some exemplary embodiments.
Figure 8A:
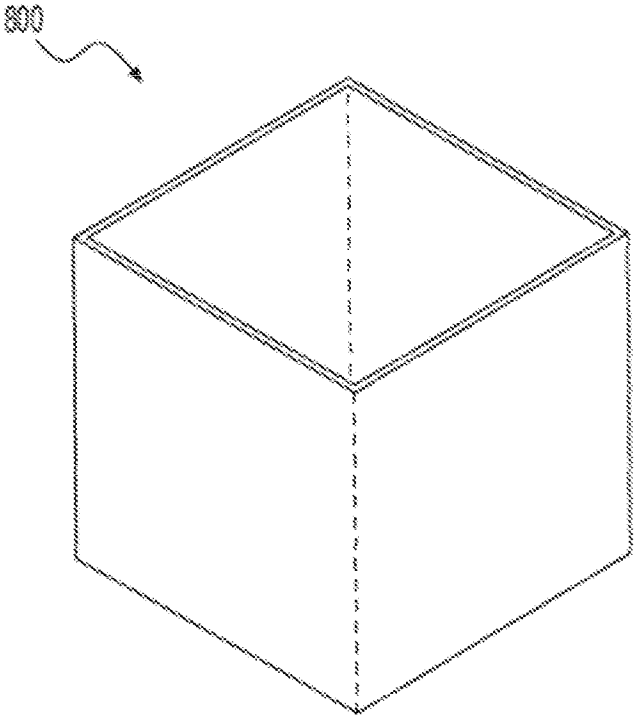

FIG. 8A is an illustration of a sleeve 800 for an expandable shipping container 10, in accordance with some embodiments. It should be understood that sleeve 800 can be used in any of the embodiments described herein, such as those depicted in FIGS. 1A-7 and 11A-16. Sleeve 800 may have the shape of a hollow box with one or more sides open (e.g., open top or bottom face). Accordingly, sleeve 800 may be sized and shaped to slidably receive, and secure by an interference fit, expandable shipping container 10, as shown in FIG. 8B. That is, the gap between the inner walls of sleeve 800 is slightly larger than the distance between the outer walls of expandable shipping container 10 when it is in the expanded configuration. Alternatively, in other embodiments, sleeve 800 is secured in place relative to expandable shipping container 10 mechanically (e.g., via poly-straps, fasteners, clips, or tabs) or chemically (e.g., via adhesive such as tape), or by other known means. In some embodiments, sleeve 800 provides a customizable surface for printing a single or repeating logo, design, name, or message, as desired, thereby allowing for expandable shipping container 10 to be customized for a particular retailer or customer and then re-used and re-customized for another retailer or customer by swapping one sleeve 800 for another and without altering expandable shipping container 10. As shown in FIG. 8B, in some embodiments, sleeve 800 is secured around expandable shipping container 10 with a first poly-strap 810 that may be positioned, for example, around the horizontal perimeter of the shipping container 10 and/or a second poly-strap 820 that may be positioned around the vertical perimeter of the shipping container. In this manner, second poly-strap 820 may also be used to secure top flaps 113 and 123 in a closed position. With or without poly-straps, sleeve 800 may provide expandable shipping container 10 with additional insulation and strength and/or absorb the wear and tear that may otherwise damage the exterior of expandable shipping container 10. Additionally, sleeve 800 may provide a convenient indication of an "up" direction for shipping companies, which can be of particular importance for certain goods.

Figure 9:
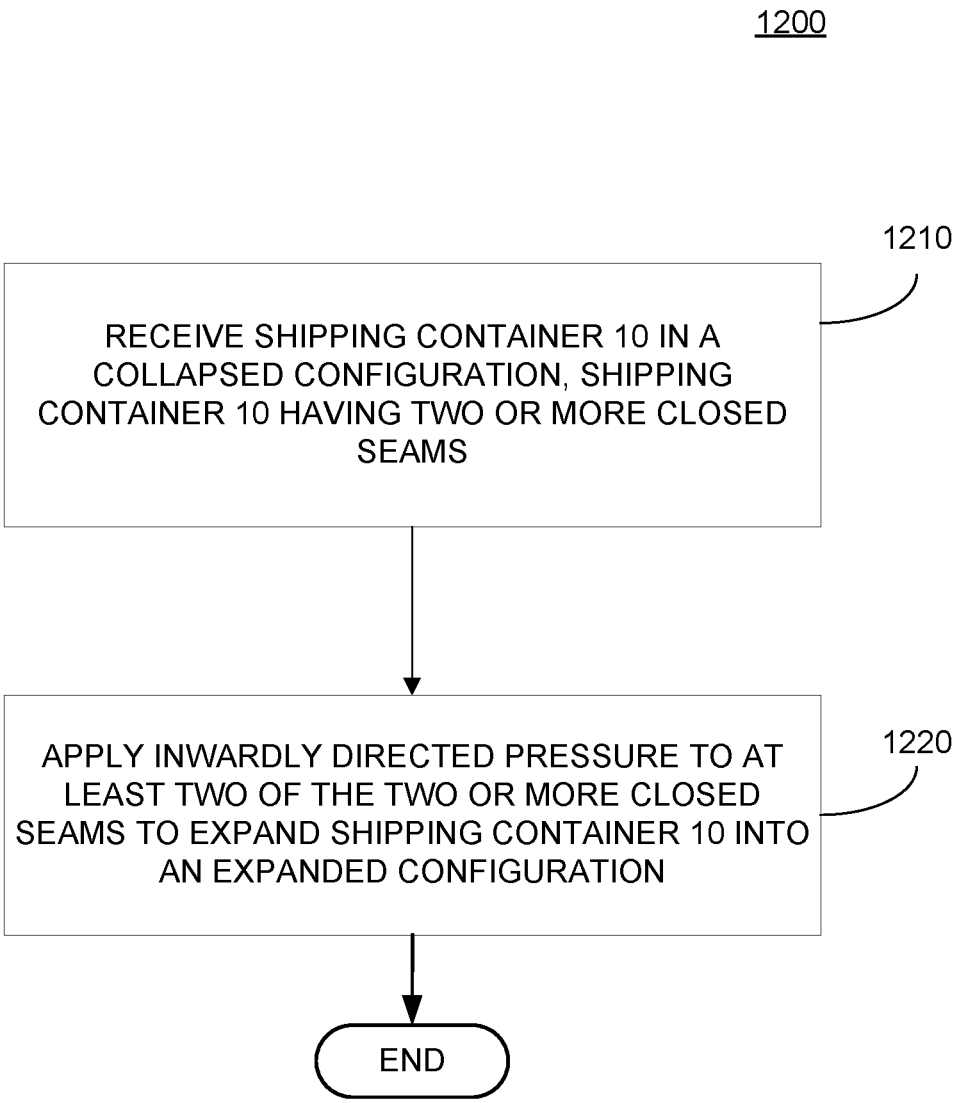
FIG. 9 is a flowchart of a method of expanding an expandable shipping container, in accordance with some exemplary embodiments.

FIG. 9 shows a flowchart of an exemplary method 1200 for expanding shipping container 10 (for the embodiments shown in FIGS. 1A-5I and/or FIGS. 11A-15E). In block 1210, the method may include receiving expandable shipping container 10, which may be insulated, in the collapsed configuration. Expandable shipping container 10 may include inner structure 100 enclosed by flexible barrier 200. Inner structure 100 may have a plurality of rigid insulation panels (such as panel structure 600) and a plurality of rigid flaps. Flexible barrier 200 may form open seam 132 between a first pair of the bendable flaps (e.g., top flaps 113, 123 and two or more closed seams between two or more additional pairs of bendable flaps (e.g. pairs of first side flaps 111, 121 and second side flaps 112, 122) such that expandable shipping container 10 forms an enclosure having a single aperture defined by open seam 132.

At block, 1220, the method may include applying an inwardly directed pressure or force, such as a compressive force, to at least two (e.g., an opposing pair) of the two or more closed seams (e.g., seams 152 and 162) to expand shipping container 10 into an expanded configuration.

Figure 10:
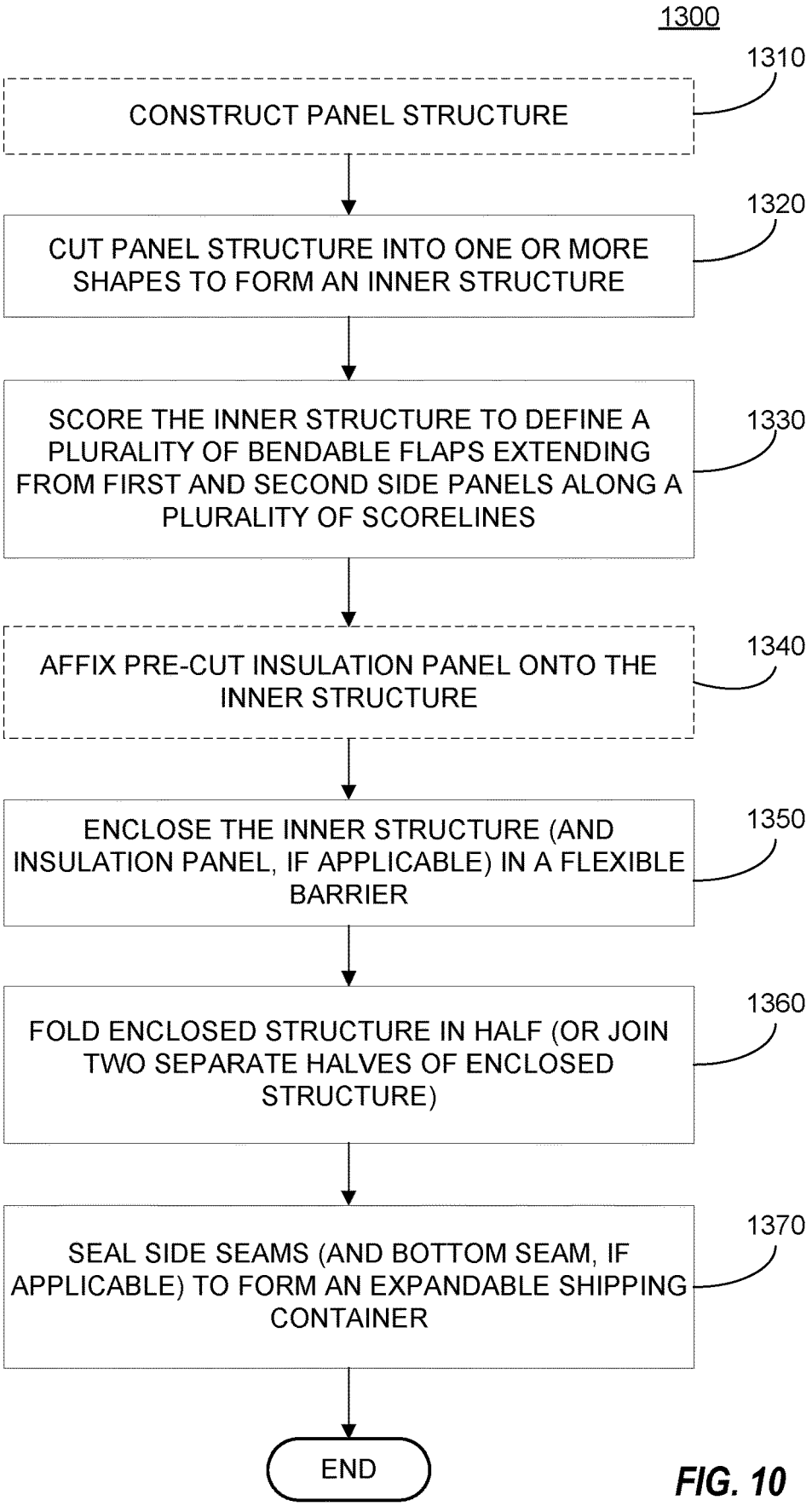
FIG. 10 is a flowchart of a method of manufacturing an expandable shipping container, in accordance with some exemplary embodiments.

FIG. 10 illustrates a method 1300 of for manufacturing expandable shipping container 10 (for the embodiments shown in FIGS. 1A-5I and/or FIGS. 11A-15E). In block 1310, the method may include constructing panel structure 600. As shown in FIG. 6, panel structure 600 may be constructed by attaching top liner 610 to a top face of internal core 630 and bottom liner 620 to a bottom face of internal core 630. One or more cells 632 of internal core 630 may include particulate 634 that may provide thermal insulation to panel structure 600. Alternatively, block 1310 may be optional and instead involve receiving a constructed panel structure such as a structural backing (e.g., corrugated backing) as shown in FIGS. 4F and 5F.

In block 1320, the method may include cutting panel structure (e.g., panel structure 600 or corrugated backing) into one or more shapes to form inner structure 100 or 500 of the shipping container 10, such as the shapes shown in FIGS. 4A,5A, 14A, and 15A, or inner structure 1000 or 1002 and 1004, as shown in FIGS. 4F and 5F. It is contemplated that the panel structure may be cut into any shape (e.g., using die cutting) based on the desired shape of expandable shipping container 10 in both the storage configuration and the in-use configuration.

Figure 14A:
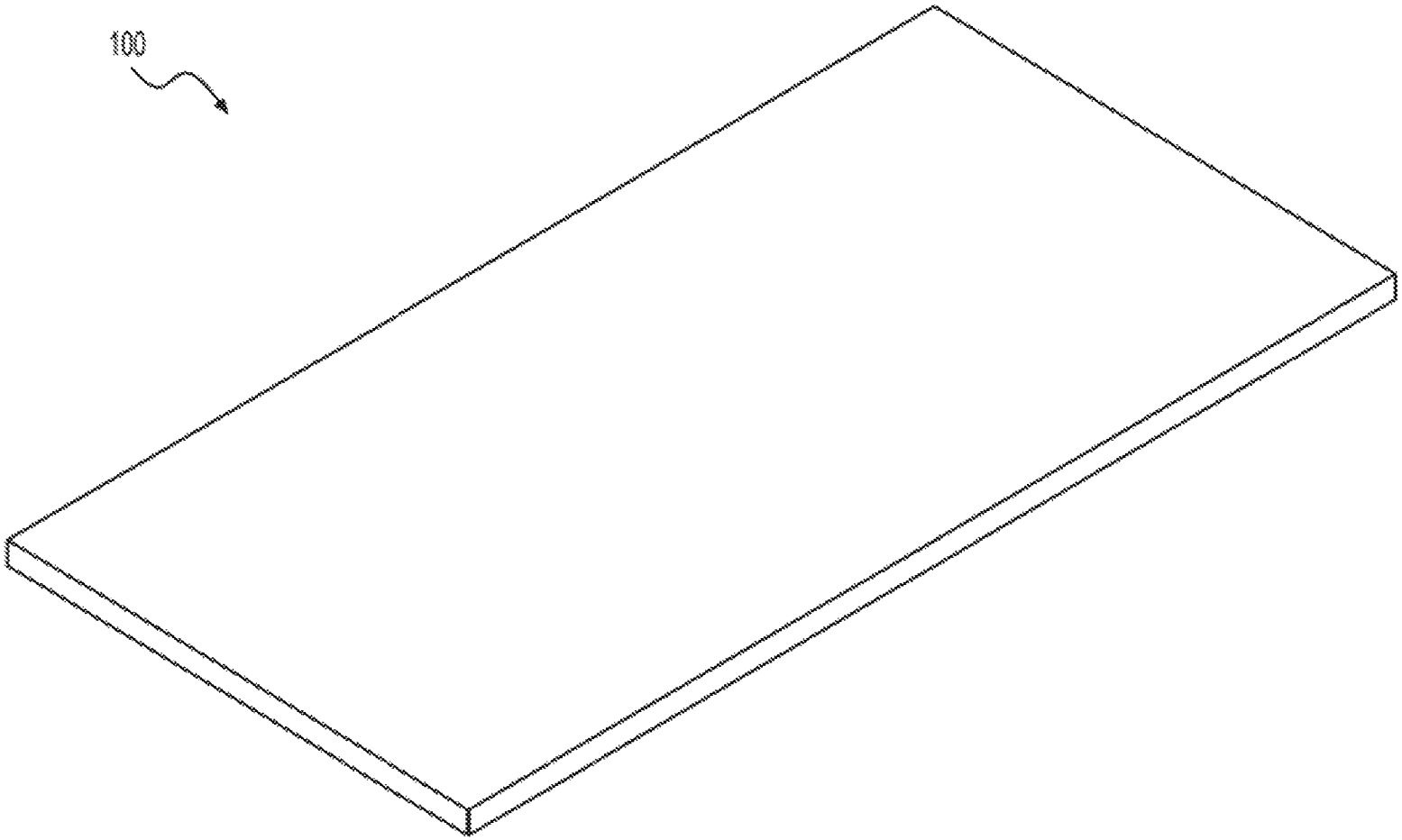
FIGS. 14A-14E show top isometric views of an inner structure of an expandable shipping container that is cut (FIG. 14A), scored (FIG. 14B), partially folded (FIG. 14C), fully folded (FIG. 14D) to form the structure of the shipping container in an open position, and covered in a flexible barrier (FIG. 14E), in accordance with some exemplary embodiments.
Figure 14B:
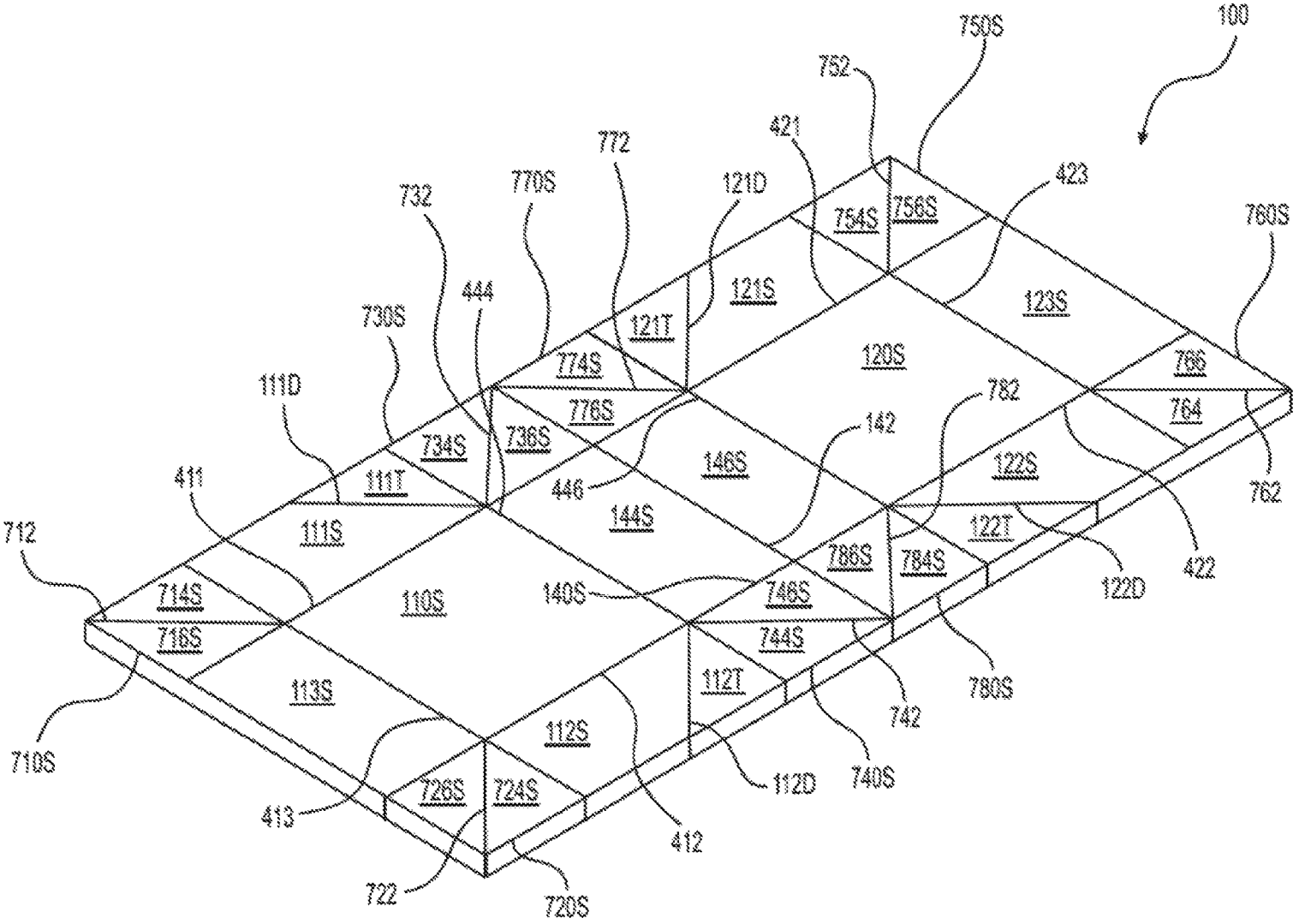
Figure 15A:
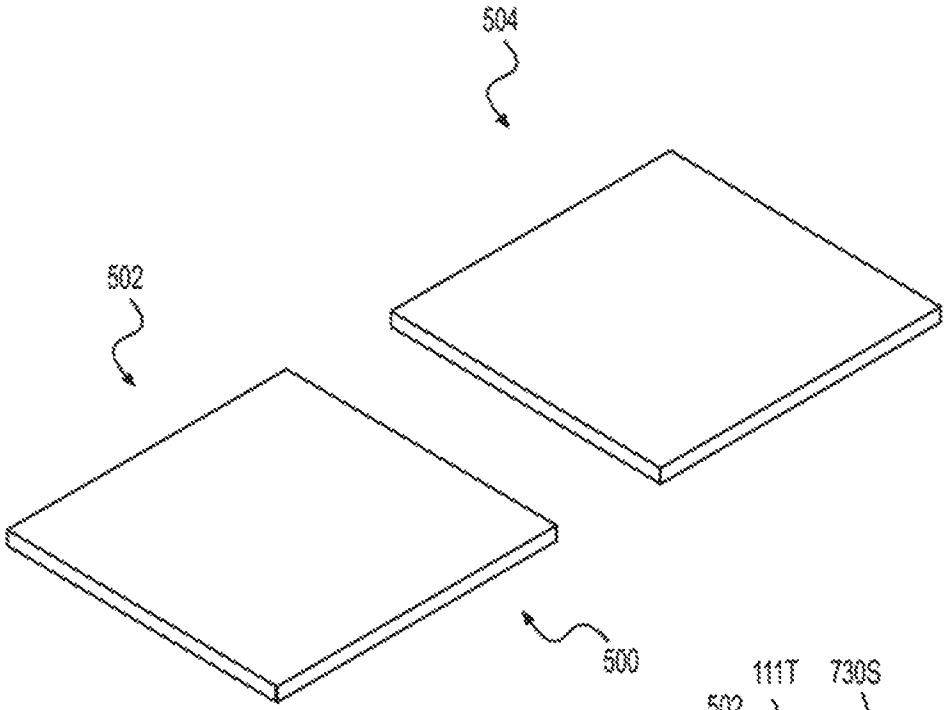
FIGS. 15A-15E show top isometric views of an inner structure of an expandable shipping container having two sub-structures that are cut (FIG. 15A), scored (FIG. 15B), partially folded (FIG. 15C), fully folded (FIG. 15D) to form the structure of the shipping container in an open position, and covered in a flexible barrier (FIG. 15E), in accordance with other exemplary embodiments.
Figure 15B:
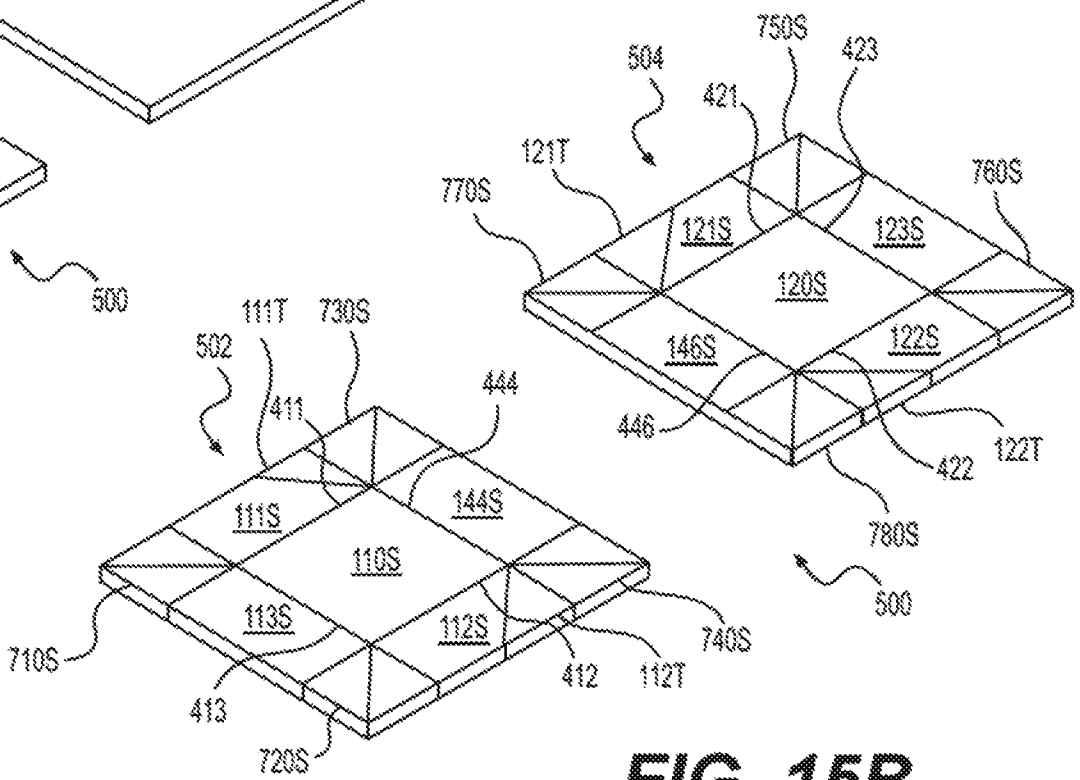
Figure 15D:
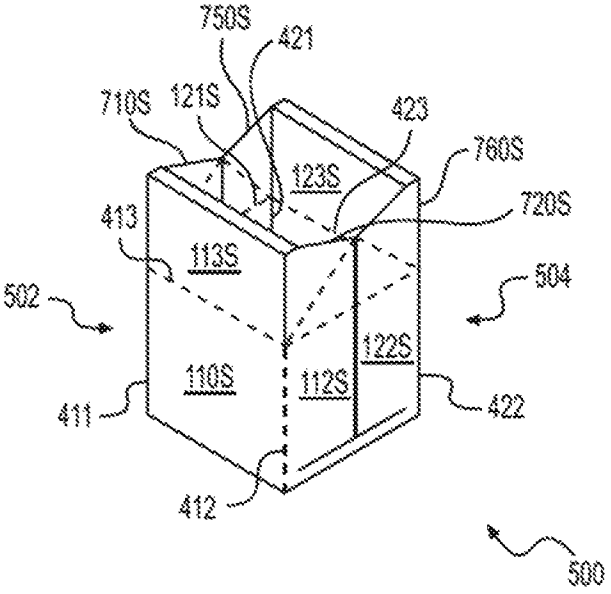
Figure 15C:
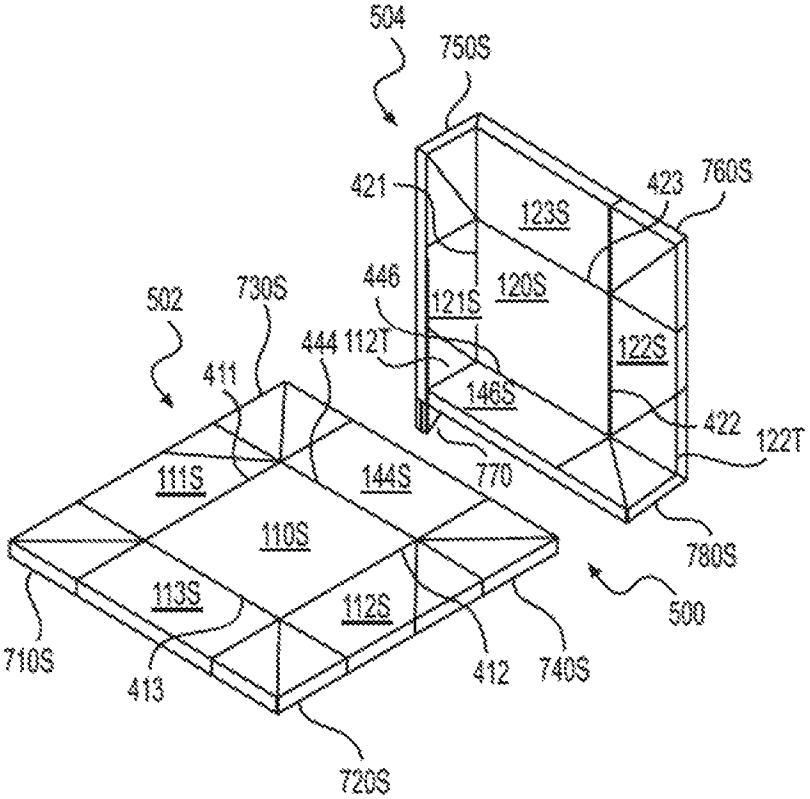

In block 1330, the method may include scoring the cut inner structure 100, 500, 1000, or 1002 and 1004 to create one or more scorelines (e.g., scorelines 411, 412, 413, 421, 422, 423, 142, 444, 446) to define one or more bendable flaps (e.g., flaps 111, 112, 113, 121, 122, 123) that extend from side panels 110, 120, and a bendable bottom panel 140, as shown in FIGS. 4B, 4F, 5B, and 5F, for example. Alternatively, inner structure 100, 500 may be cut and scored as shown in FIG. 14B or 15B.

Optionally, in embodiments with a structural backing (e.g., corrugated backing), the method may include, at block 1340, affixing an insulation panel, such as the one disclosed in the U.S. Provisional Patent Application No. 62/491,666, as shown in FIGS. 4G-4I and 5G-5I, to the structural backing (e.g., via adhesive layer 900). If the insulation panel has not yet been pre-cut, pre-scored, or notched, this step may involve cutting, scoring, and/or cutting notches into insulation panel as shown in FIGS. 4G-4I and 5G-5I.

In block 1350, the method may include enclosing the inner structure 100, 500, 1000, or 1002 and 1004 in flexible barrier 200, as shown in FIGS. 2C, 4E, 5E, 14E, and 15E, for example. Flexible barrier 200 may be sealed around inner structure 100 or 500 so that all surfaces of inner structure 100 or 500 are enclosed by flexible barrier 200. For example, flexible barrier 200 may be shrink-wrapped over inner structure 100, 500, 1000, or 1002 and 1004. In some embodiments, flexible barrier 200 may alternatively cover only the outer surfaces of inner structure 100, 500, 1000, or 1002 and 1004 such that surfaces of the inner structure are exposed within the internal chamber of the expandable shipping container 10. Optionally, the method may include bending flaps 111, 112, 113, 121, 122, 123 and/or panels 110, 120, 140, along scorelines 411, 412, 413, 421, 422, 423, 444, 446 to create a fully folded inner structure, as shown in FIGS. 4D and 5D, for example, either before or after enclosing/covering the inner structure via barrier 200 as part of block 1350. Additionally, enclosing/covering the inner structure within flexible barrier 200 may involve sealing the inner structure within flexible barrier 200 (e.g., via an adhesive or heat-activated coating). For example, the inner structure may be laminated between two paper barriers forming flexible barrier 200 and exposed to a heated pressure roll, which in turn activates a heat-activated coating and binds both surfaces of the insulated panel.

Figure 14D:
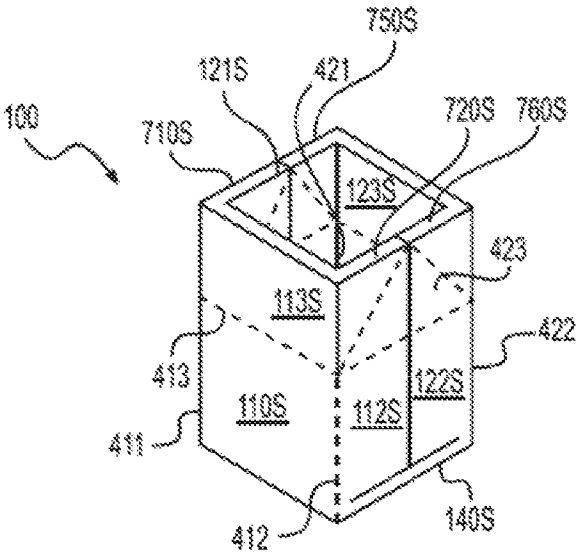
Figure 14C:
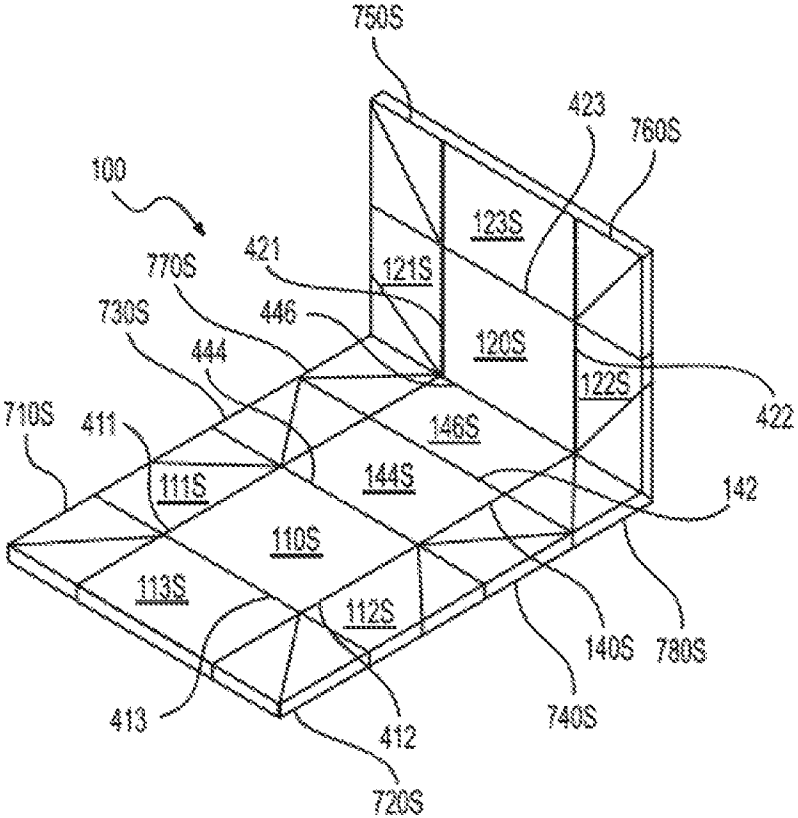
Figure 14E:
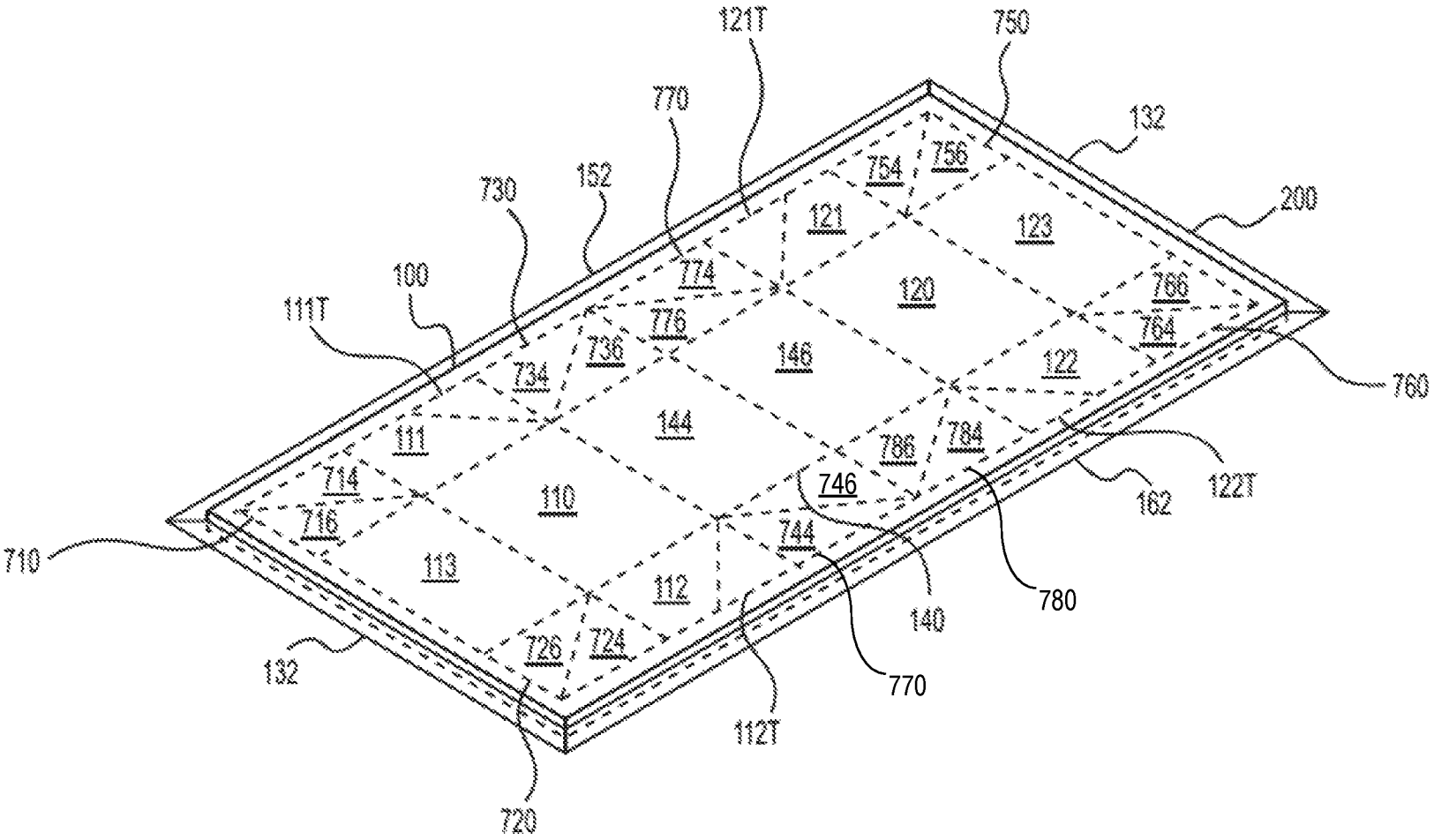
Figure 15E:
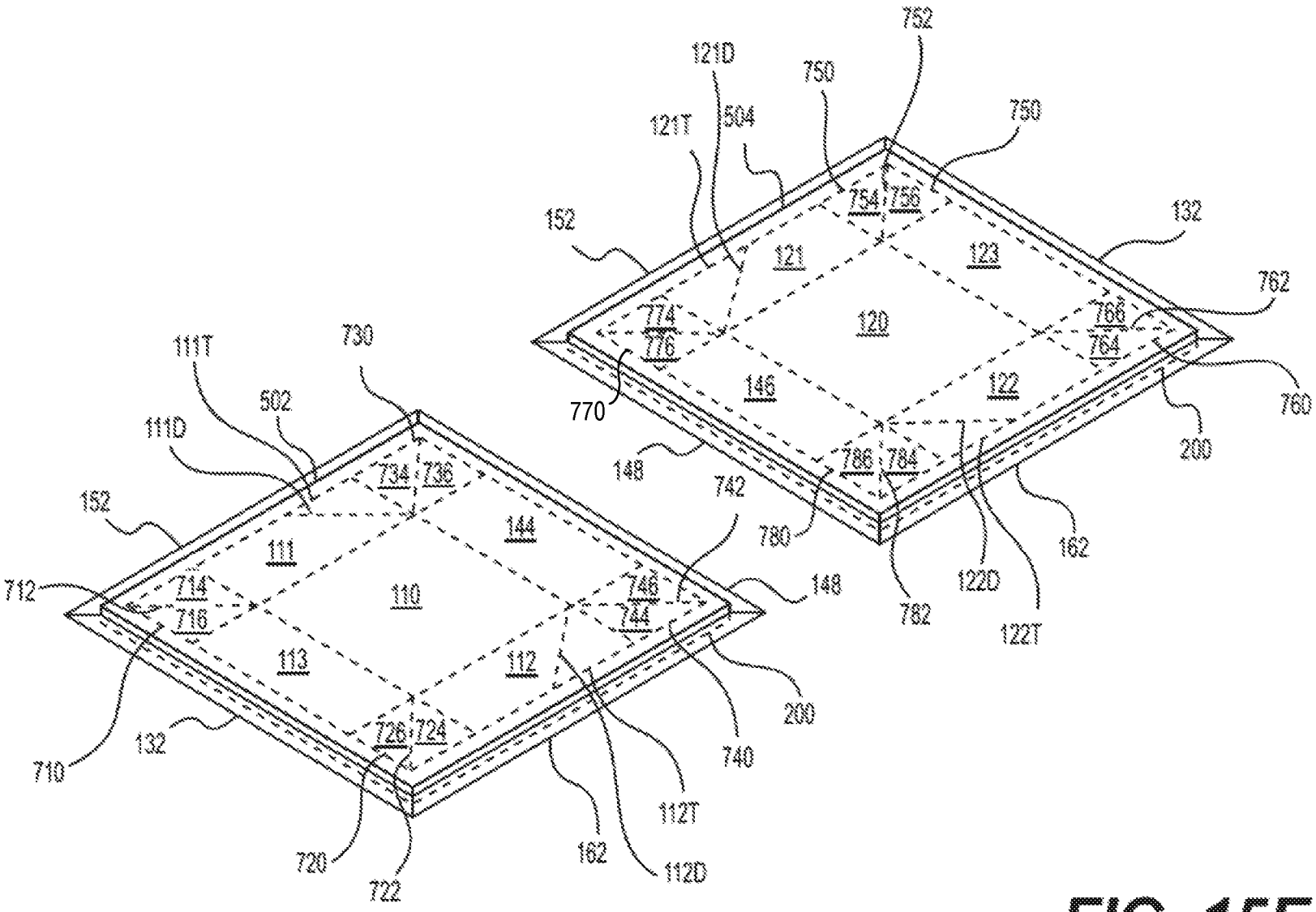

In block 1360, the method may include folding the enclosed/covered structure shown in FIG. 4E or 14E in half, as shown in FIGS. 1A-1C, 3A, 11A-C or, in other embodiments, joining two sections of the enclosed/covered inner structure shown in FIGS. 5E and 15E, for example.

In block 1360, the method may include sealing (e.g., heat sealing or stitching) pairs of edges of flexible barrier 200 to form side seams 152 and 162. Additionally, in embodiments as shown in FIGS. 5A-5I and 7, block 1360 may also include sealing bottom seam 148.

After inner structure 100 has been enclosed in flexible barrier 200, expandable shipping container 10 may be placed in the in-use configuration for holding one or more items for shipping and/or storage, or placed in the collapsed configuration for storage or shipment from the manufacturer to a merchant or customer (referred to in the rest of this example as the sender) for later use. The sender may receive one or more expandable shipping containers 10 in the collapsed configuration, and may store, for example, a plurality of expandable shipping containers 10 at their home or business until the one or more items are ready for storage or shipping. When the sender decides to use expandable shipping container 10, they may push on opposing side seams 152, 162 of the expandable shipping container 10 in the collapsed configuration to transform the expandable shipping container 10 into the expanded configuration, as shown in FIGS. 3A-3F for example. After expandable shipping container 10 is in the expanded configuration, as shown in FIG. 2C, the sender may insert one or more items into the chamber of expandable shipping container 10 through opening 134 between the pair of top flaps 113, 123. If the one or more items require refrigeration, the sender may optionally insert a cooling agent, such as an ice pack into the chamber along with the items. The sender may then close top flaps 113, 123, as shown in FIG. 2A, and seal top seam 132 by, for example taping using a hand tape-dispenser or a commercially available case sealer or applying an adhesive (e.g., via a sticker) to secure flaps 113, 123 together. In some embodiments, the sender may use elastic bands 820 to secure the closed top flaps 113, 123, as shown in FIG. 8B. Once expandable shipping container(s) 10 is closed and secured, the sender may ship expandable shipping container(s) 10 to a recipient (e.g., a customer or another merchant).

The recipient may then access the items inside of expandable shipping container 10 after opening the top seam 132 by, for example, removing an elastic band 820 and breaking top seam 132 by cutting it or tearing it (e.g., by forcefully pulling top flaps 113, 123 apart). The recipient may then either reuse expandable shipping container 10 to ship another item by resealing top seam 132, transform expandable shipping container 10 into the collapsed configuration (e.g., as shown in FIG. 1A) for storage and future reuse by applying force to side panels 110, 120, or discard expandable shipping container 10. Expandable shipping container 10 may be discarded by, for example, placing expandable shipping container 10 in a collection area (such as a curbside) to be collected in a single stream recycling process. Thus, because expandable shipping container 10 may be made from recyclable materials, it may be discarded in a single stream recycling process without requiring any disassembly.

Figure 11A:
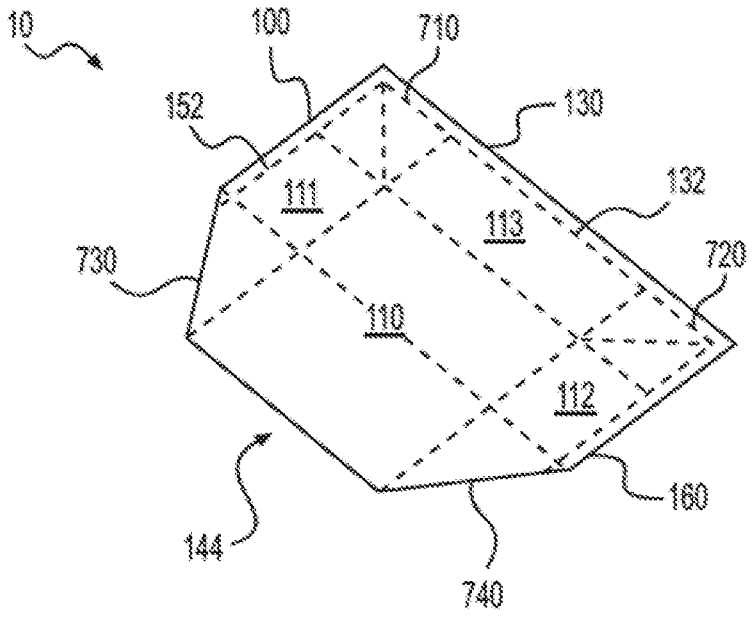
FIGS. 11A-11C show an expandable shipping container in a collapsed, unassembled configuration, in accordance with an exemplary embodiment. Specifically.
Figure 11B:
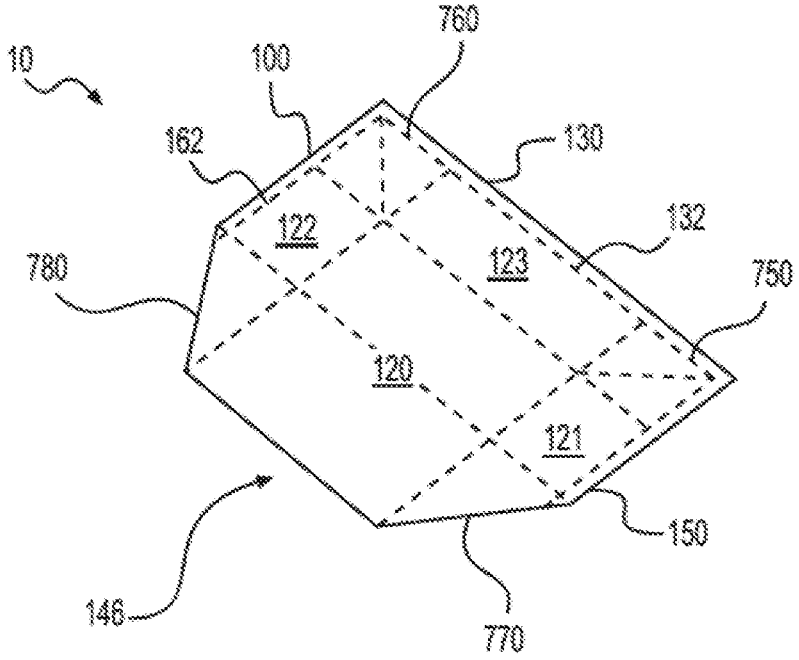
Figure 11C:
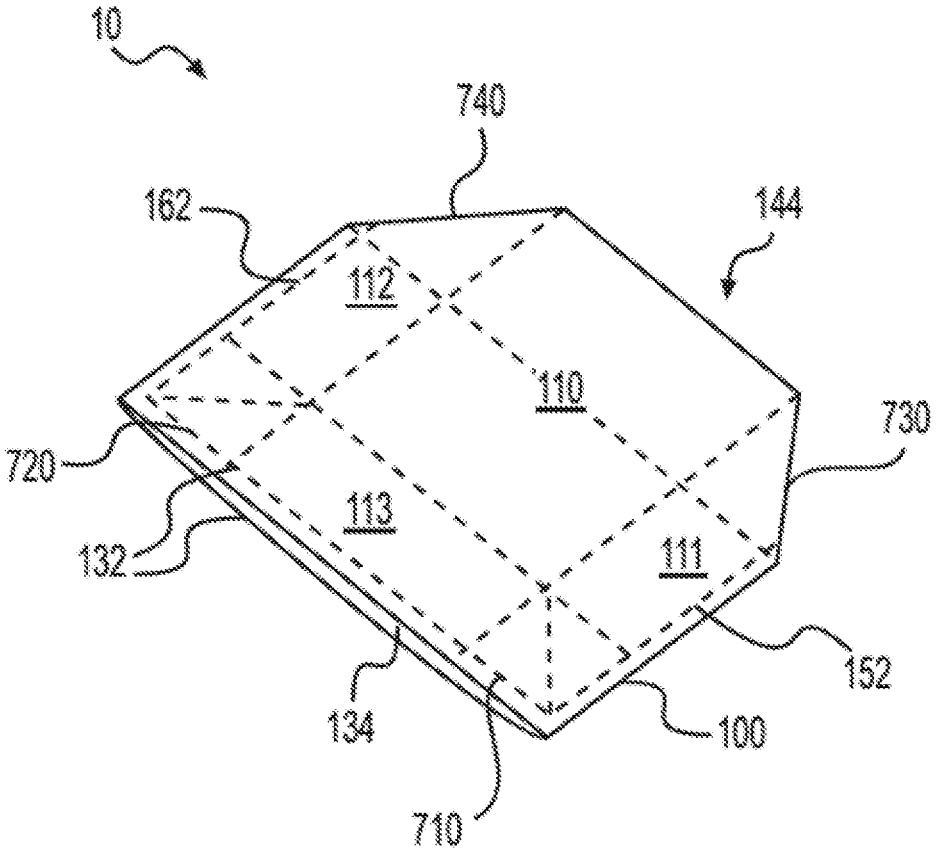
Figure 11D:
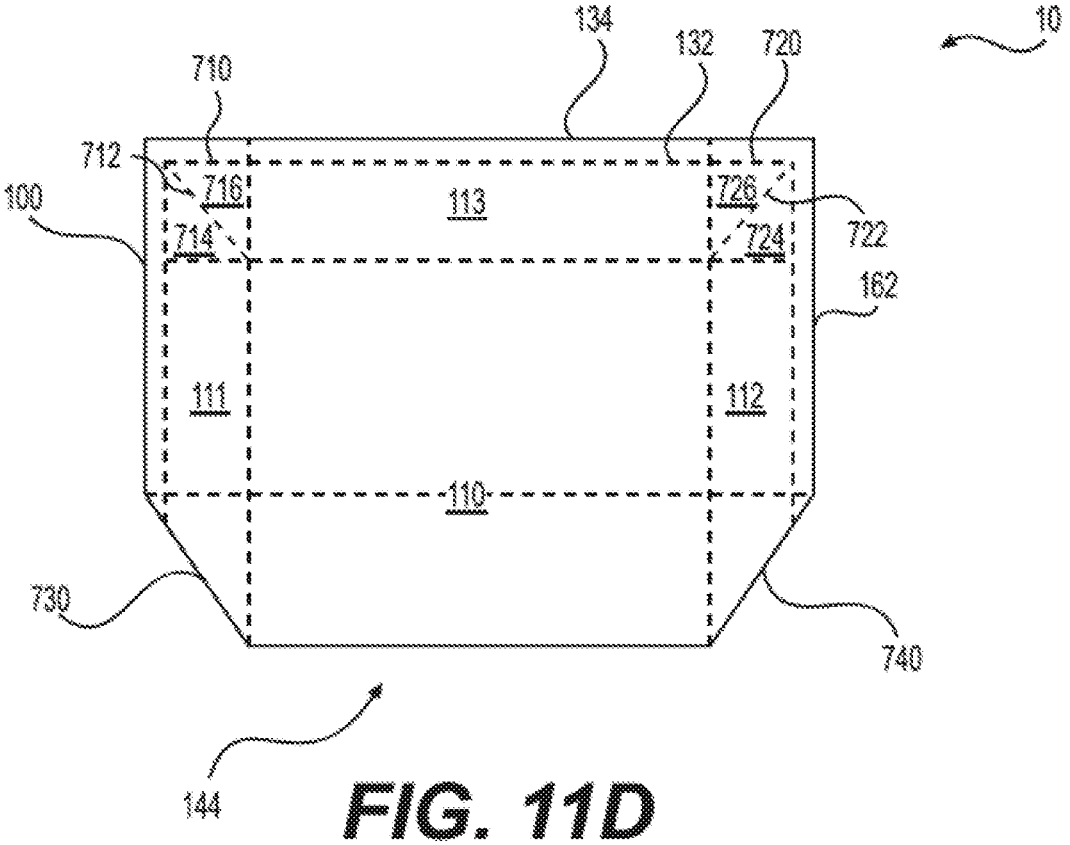
FIGS. 11D-11E show the expandable shipping container in a collapsed, assembled configuration, in accordance with an exemplary embodiment. Specifically.
Figure 11E:
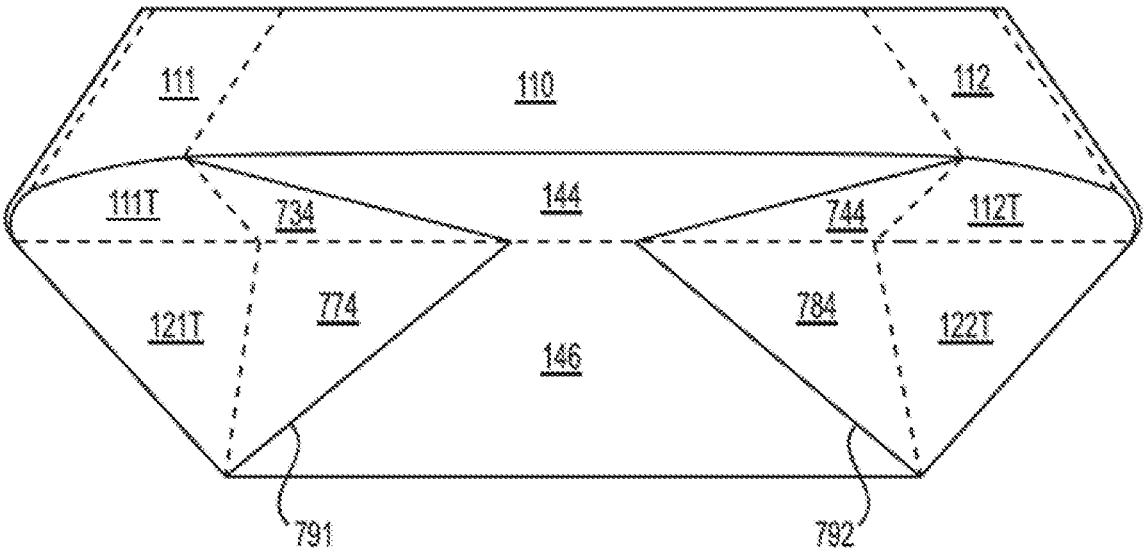

FIGS. 11A-11E are illustrations of another exemplary embodiment of expandable shipping container 10 in a collapsed configuration. According to some embodiments, shipping container 10 can have a collapsed, unassembled configuration, as shown in FIGS. 11A-11C, and can have a collapsed, assembled configuration, as shown in FIGS. 11D-11E. In some embodiments, shipping container 10 can have a substantially rectangular cross-sectional shape when in the collapsed, unassembled configuration and can have a substantially irregular hexagonal cross-sectional shape when in the collapsed, assembled configuration. When in the collapsed configuration, expandable shipping container 10 has a reduced volume to allow for more efficient storage and shipment of expandable shipping container 10. It is contemplated that expandable shipping container 10 may have one or more desired dimensions in the collapsed configuration making it particularly sized and shaped for storage and/or stacking with other shipping containers or packaging materials. According to some embodiments, when in a collapsed configuration, expandable shipping container 10 may be substantially flat (e.g., it has a thickness, in the smallest dimension, of about 0.25" to about 3.0" or less than about 6% of the smaller of the length and height dimensions), with a width of about 10" to about 50" and a length of about 10" to about 60". In some embodiments, expandable shipping container 10 includes an inner structure 100 and a flexible barrier 200. According to some embodiments, inner structure 100 and/or flexible barrier 200 may be made from renewable and/or environmentally-friendly materials. For example, inner structure 100 and/or flexible barrier 200 may be made from materials that can be readily recycled in one or more single stream collection systems with recyclable paper or plastic materials. In some embodiments, flexible barrier 200 entirely encloses inner structure 100 such that it encloses all exposed surfaces of inner structure 100. In other embodiments, flexible barrier 200 covers only the outer surfaces of inner structure 100.

As will be described in greater detail below, according to some embodiments, inner structure 100 may include a first side panel 110, a second side panel 120, a third side panel 130 (which may be referred to as a top panel 130), a fourth side panel 140 (which may be referred to as a bottom panel 140), a fifth side panel 150, and a sixth side panel 160 to form a rectangular prism or cubic six-sided figure when in the expanded configuration, though other three-dimensional polygonal shapes are contemplated. According to some embodiments, first side panel 110 and second side panel 120 are each formed by a rigid piece of material having a square or rectangular shape. Each panel of the inner structure 100 may constitute one side (or "face") of a 6-sided box formed by the inner structure 100 when expandable shipping container 10 is in the expanded configuration. Structure 100 may be formed from a single unitary blank with the panels separated by scorelines or one or more of the panels may be attached to the blank along its edges.

As shown in FIG. 11A, first side panel 110 may have or be attached to a first side flap 111, a second side flap 112, and a top flap 113. Each flap 111, 112, 113 may extend from (e.g., if part of the same unitary blank that is cut and scored) or be attached to a different edge of first side panel 110, with first side flap 111 and second side flap 112 positioned opposite one another relative to first side panel 110. Certain embodiments may include a first corner panel 710 adjacent to first side flap 111 and top flap 113 and a second corner panel 720 adjacent to second side flap 112 and top flap 113. In some embodiments, either corner panel may include a diagonal scoreline 712, 722 (shown more clearly in FIGS. 11D and 14B) extending inwardly toward a center of first side panel 110 such that the diagonal scoreline 712, 722 each separate the respective corner panel 710, 720 into two sections. For example, diagonal scoreline 712 may separate corner panel 710 into sections 714, 716, and diagonal scoreline 722 may separate corner panel 720 into sections 724, 726. Either corner panel 710, 720 may extend from (e.g., if part of the same unitary blank that is cut and scored) or be attached to a different edge of first side flap 111, second side flap 112, and/or top flap 113.

As will be discussed more fully below, in some embodiments, a half 144 of the bottom panel 140 may extend from or be attached to a fourth, bottom edge of first side panel 110 opposite the top flap 113. In some embodiments, half 144 of bottom panel 140 can fold inwardly inside inner structure 100 such that half 144 is between first side panel 110 and second side panel 120. Certain embodiments may include a third corner panel 730 adjacent to first side flap 111 and the half 144 of bottom panel 140 and a fourth corner panel 740 adjacent to second side flap 112 and the half 144 of bottom panel 140. As discussed more fully below, in some embodiments, corner panels 730, 740 may be positioned opposite corner panels 710, 720 respectively, and each include a diagonal scoreline 732, 742 (shown more clearly in FIG. 14B) extending inwardly toward a center of first side panel 110. Either corner panel 730, 740 may extend from or be attached to a different edge of first side flap 111, second side flap 112, and/or the half 144 of bottom panel 140. In some embodiments, first side flap 111 may include a diagonal scoreline 111D extending diagonally in parallel to diagonal scoreline 712 (e.g., outwardly, from the junction of diagonal scoreline 732 of corner panel adjacent 730 to first side flap 111 and half 144 of bottom panel 140, toward an outer edge of first side flap 111, as shown more clearly in FIG. 14B). Similarly, in some embodiments, second side flap 112 may include a diagonal scoreline 112D extending diagonally in parallel to diagonal scoreline 722 (e.g., outwardly, from the junction of diagonal scoreline 742 of corner panel 740 adjacent to first side flap 112 and the half 144 of bottom panel 140, toward an outer edge of first side flap 112, as shown more clearly in FIG. 14B).

As shown in FIG. 11B, second side panel 120 may have or be attached to a first side flap 121, a second side flap 122, and a top flap 123, and may mirror first side panel 110 shown in FIG. 11A. Each flap 121, 122, 123 may extend from or be attached to a different edge of second side panel 120, with first side flap 121 and second side flap 122 positioned opposite one another relative to second side panel 120. Certain embodiments may include a first corner panel 750 adjacent to first side flap 121 and top flap 123 and a second corner panel 760 adjacent to second side flap 122 and top flap 123. In some embodiments, either corner panel 750, 760 may include a diagonal scoreline 752, 762 extending inwardly toward a center of second side panel 120 such that the diagonal scoreline 752, 762 each separate the respective corner panel 750, 760 into two sections. For example, diagonal scoreline 752 may separate corner panel 750 into sections 754, 756, and diagonal scoreline 762 may separate corner panel 760 into sections 764, 766. Either corner panel 750, 760 may extend from or be attached to a different edge of first side flap 121, second side flap 122, and/or top flap 123.

In some embodiments, another half 146 of the bottom panel 140 may extend from or be attached to a fourth, bottom side of second side panel 120 opposite the top flap 123. Certain embodiments may include corner panels 770, 780 adjacent to first side flap 121 and the half 146 of bottom panel 140 and to second side flap 122 and the half 146 of bottom panel 140, respectively. As discussed more fully below, in some embodiments, corner panels 770, 780 may be positioned opposite corner panels 750, 760 respectively, and each include a diagonal scoreline 772, 782 extending inwardly toward a center of second side panel 120. Either corner panel 770, 780 may extend from or be attached to a different edge of first side flap 121, second side flap 122, and/or the half 146 of bottom panel 140. In some embodiments, first side flap 121 may include a diagonal scoreline 121D extending diagonally in parallel to diagonal scoreline 752 (e.g., outwardly, from the junction of diagonal scoreline 772 of corner panel 770 adjacent to first side flap 121 and half 146 of bottom panel 140, toward an outer edge of first side flap 121, as shown more clearly in FIG. 14B). Similarly, in some embodiments, second side flap 122 may include a diagonal scoreline 122D extending diagonally in parallel to diagonal scoreline 762 (e.g., outwardly, from the junction of diagonal scoreline 782 of corner panel 780 adjacent to first side flap 122 and the half 146 of bottom panel 140, toward an outer edge of first side flap 122, as shown more clearly in FIG. 14B).

Figure 13B:
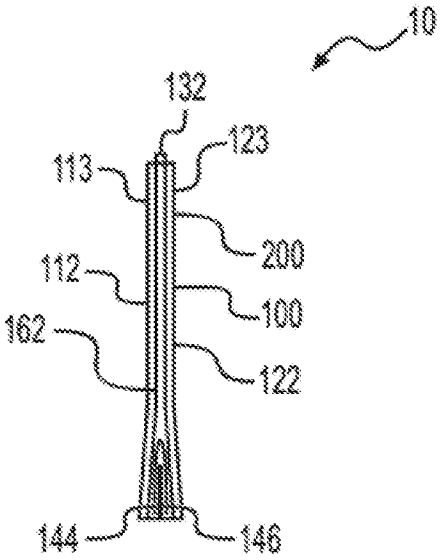
FIGS. 13A-13F show the transition of the expandable shipping container from a collapsed configuration (front view in FIG. 13A, right side view in FIG. 13B) to a partially expanded configuration (front view in FIG. 13C, right side view in FIG. 13D) to an expanded configuration (front view in FIG. 13E, right side view in FIG. 13F), in accordance with the exemplary embodiment shown in FIGS. 11A-12C.

As shown in FIGS. 11A-11D, and more clearly in FIG. 13B, when expandable shipping container 10 is in the collapsed configuration, the expandable shipping container 10 is substantially flat such that first side panel 110 may be adjacent to or touching second side panel 120. According to some embodiments, first side panel 110 and second side panel 120 may always be substantially parallel to another, regardless of whether the expandable shipping container 10 is in a collapsed configuration, an expanded configuration, or in an intermediate configuration between a collapsed and an expanded configuration. As shown in FIGS. 11A-11B, in some embodiments, when expandable shipping container 10 is in a collapsed, unassembled configuration, first side panel 110 and its flaps 111, 112, 113, mirror second side panel 120 and its flaps 121, 122, 123 such that first side flap 111 of first side panel 110 opposes first side flap 121 of second side panel, second side flap 112 of first side panel 110 opposes second side flap 122 of second side panel 120, and top flap 113 of first side panel 110 opposes top flap 123 of second side panel 120. According to some embodiments, when expandable shipping container 10 is in a collapsed configuration, the pairs of first and second side flaps 111, 112, 121, 122 are substantially parallel to the first and second side panels 110, 120.

As shown in FIG. 11C, in some embodiments, when expandable shipping container 10 is in a collapsed, unassembled configuration, the edges of the pair of top flaps 113, 123 (and any adjacent corner panels) may be adjacent to one another so as to form a top seam 132, which may be selectively opened and closed. When opened, the top seam 132 of the expandable shipping container 10 defines an opening 134 that facilitates access to the internal enclosure of the expandable shipping container 10. In some embodiments, opening 134 serves as the only access to the internal enclosure of expandable shipping container 10, as the remaining edges of expandable shipping container 10 are sealed by flexible barrier 200. In other embodiments, expandable shipping container 10 has additional openings (not shown) to provide access to its internal enclosure of expandable shipping container 10.

FIG. 11D depicts expandable shipping container 10 in a collapsed, assembled configuration, according to some embodiments. Halves 144, 146 of bottom panel 140 can be folded inwardly and inside shipping container 10 such that halves 144, 146 of bottom panel 140 are disposed between first side panel 110 and second side panel 120. In some embodiments, some or all of corner panels 730, 740, 770, 780 can be folded inwardly and inside shipping container 10 such that, when expandable shipping container 10 is in the collapsed, assembled configuration, the diagonal scoreline(s) 111D, 121D, 112D, 122D of first side flaps 111, 121 and/or second side flaps 112, 122 form an angled lowermost edge of first side flaps 111, 121 and/or second side flaps 112, 122.

FIG. 11E depicts shipping container 10 in a slightly expanded configuration. According to some embodiments, a lower triangular portion 111T, 121T of first side flaps 111, 121 (i.e., the triangular portion of first side flap 111, 121 below diagonal scoreline 111D, 121D of corresponding first side flap 111, 121 that is proximate half 144 of bottom panel 140) and a lower triangular portion 112T, 122T of second side flaps 112, 122 (i.e., the triangular portion of second side flap 112, 122 below diagonal scoreline 112D, 122D of corresponding second side flap 112, 122 and that is proximate half 146 of bottom panel 140) may fold inwardly such that the lower portions 111T, 121T of first side flaps 111, 121 are disposed between the upper portions of first side flaps 111, 121 (i.e., the portion of first side flap 111, 121 above diagonal scoreline 111D, 121D of corresponding first side flap 111, 121 and that is proximate top flap 113, 123) and the lower portions 121T, 122T of second side flaps 121, 122 are disposed between the upper portions of second side flaps 121, 122 (i.e., the portion of second side flap 112, 122 below the diagonal scoreline of corresponding second side flap 112, 122 that is proximate top flap 113, 123). Corner panels 730, 770 adjacent to first side flaps 111, 121 and half 144 may meet to form a substantially triangular first bottom flap 791, and the corner panels adjacent to second side flaps 121, 122 and half 146 may meet to form a substantially triangular second bottom flap 792. First bottom flap 791 and second bottom flap 792 may fold under bottom panel 140 (as shown more clearly shown in FIG. 12B), and first and second bottom flaps 791, 792 may be folded along a line substantially in parallel to scoreline 142 such that shipping container 10 can lay substantially flat in a collapsed, assembled configuration.

Figure 12A:
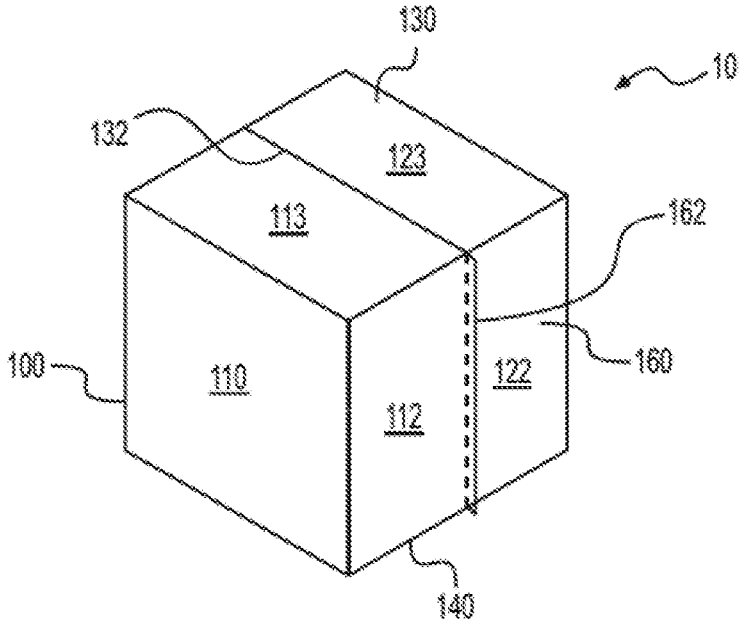
FIGS. 12A-12C show the expandable shipping container in an expanded configuration, in accordance with the exemplary embodiment shown in FIGS. 11A-11C. Specifically.
Figure 12B:
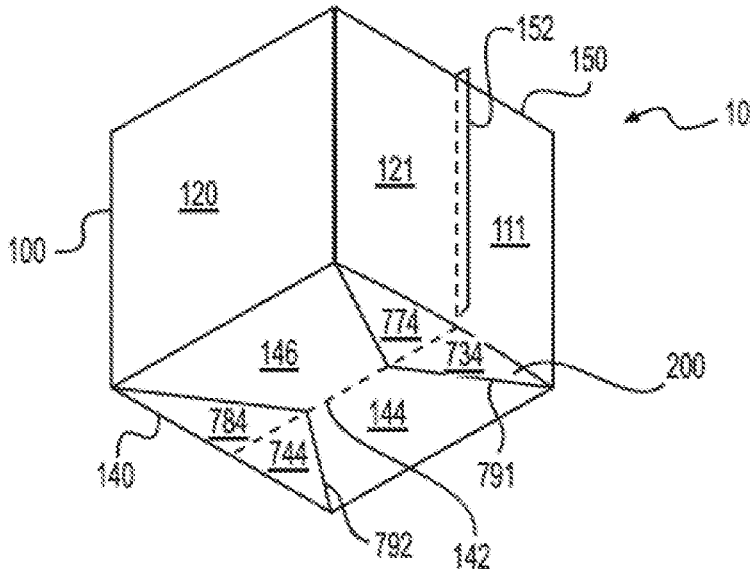
Figure 12C:
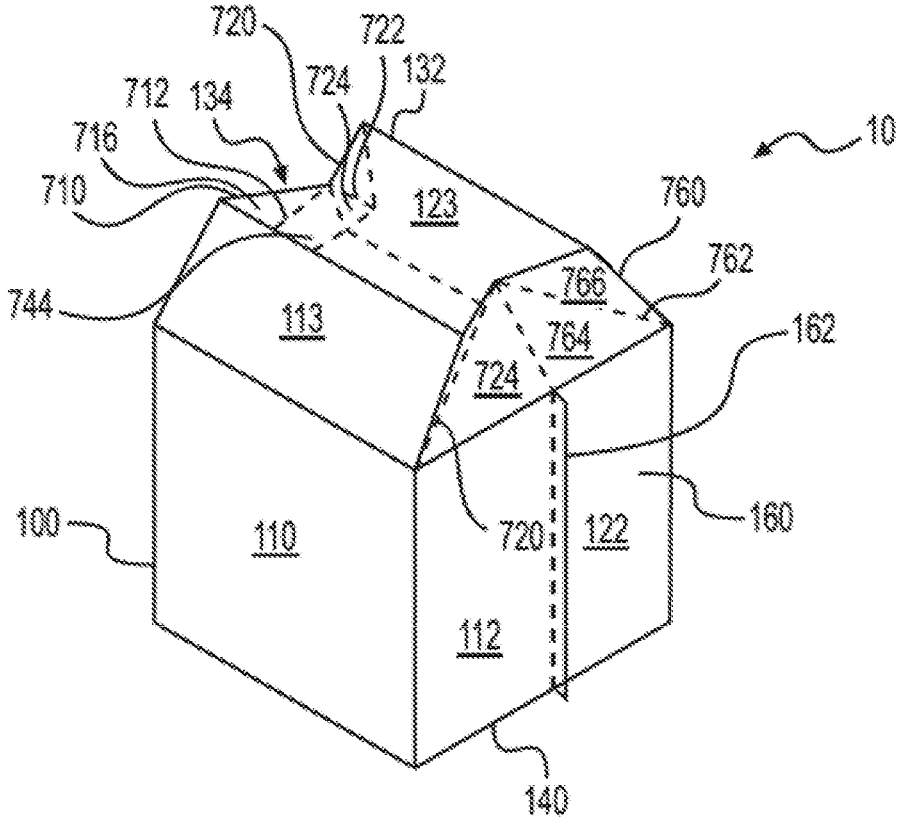

FIGS. 12A-12C are illustrations of expandable shipping container 10 in an expanded configuration, in accordance with some embodiments. When in the expanded configuration, expandable shipping container 10 forms a receptacle for holding one or more items for storage or shipment. FIGS. 12A-12B illustrate the expandable shipping container 10 in a closed position (e.g., with top seam 132 closed to seal off opening 134). Expandable shipping container 10 may be in a closed position when the pair of top flaps 113, 123, are positioned such that they are substantially perpendicular to first side panel 110 and second side panel 120 such that the edge of top flap 113 of first side panel 110 is adjacent to the edge of top flap 123 of second side panel 120, forming top seam 132. According to some embodiments, when the pair of top flaps 113, 123 are folded to the closed position, the corner panels 710, 720 adjacent to top flap 113 (and first side flap 111 and second side flap 112) and the corner panels 750, 760 adjacent to top flap 123 (and first side flap 121 and second side flap 122) can be folded along the corresponding diagonal scoreline 712, 722, 752, 762 such that at least a portion of the corresponding corner panel 710, 720, 750, 760 is folded underneath corresponding top flap 113, 123. For example, in some embodiments, corner panel 710 can be folded inwardly along diagonal scoreline 712 such that sections 714 and 716 fold together and are disposed inside container 10. Similarly, in some embodiments, corner panel 720 can be folded inwardly along diagonal scoreline 722 such that sections 724 and 726 fold together and are disposed inside container 10, corner panel 750 can be folded inwardly along diagonal scoreline 752 such that sections 754 and 756 fold together and are disposed inside container 10, and corner panel 760 can be folded inwardly along diagonal scoreline 762 such that sections 764 and 766 fold together and are disposed inside container 10. In some embodiments, one or more of the corner panels may provide structural support for top flap 113, 123, preventing top flap 113, 123 from bending into the internal area of shipping container 10 when shipping container 10 is in an expanded configuration. Although this description refers to the top flaps 113, 123 forming top seam 132, it should be understood that in some embodiments, because the flexible barrier 200 encloses the top flaps, the top seam 132 may actually be formed by portions of the flexible barrier 200 that contour the edges of the top flaps 113, 123. When the pair of top flaps 113, 123 are positioned in the closed position, top seam 132 may be sealed to securely close the expandable shipping container 10. According to some embodiments, top seam 132 may be sealed by being glued, stitched, stapled, taped, or any other known means or method of sealing two flaps. In certain embodiments, adhesive (e.g., an adhesive strip including a removable backing) may be positioned on an internal or external surface of top flap 113 or top flap 123 proximate seam 132. In some embodiments, adhesive may be positioned on an internal or external surface of one or more of the corner panels adjacent to top flap 113 (and first side flap 111 and second side flap 112) and the corner panels adjacent to top flap 123 (and first side flap 121 and second side flap 122).

According to some embodiments, when expandable shipping container 10 is in an expanded configuration, first side panel 110, second side panel 120, fourth side panel 140, fifth side panel 150, and sixth side panel 160 may each comprise a substantially flat, rectangular (e.g., square) shape that together form a set-up box. As will be described in greater detail below, fifth side panel 150 may be formed from first side flap 111 of first side panel 110 and first side flap 121 of second side panel, and sixth side panel 160 may be formed from second side flap 112 of first side panel 110 and second side flap 122 of second side panel. As shown in FIG. 12C, which illustrates expandable shipping container 10 in an open position (e.g., with top seam 132 open to allow access to opening 134), the third side (i.e., top) panel 130 may comprise two top flaps 113, 123 that may be selectively moved relative to one another to open or close top seam 132, thereby selectively opening and closing expandable shipping container 10. When in an open position, as shown in FIG. 12C, top flaps 113, 123 may be in a position that is non-perpendicular to first side panel 110 and second side panel 120, respectively, thereby providing an opening 134 at the top end of expandable shipping container 10 that provides access to the internal chamber of expandable shipping container 10.

Figure 13A:
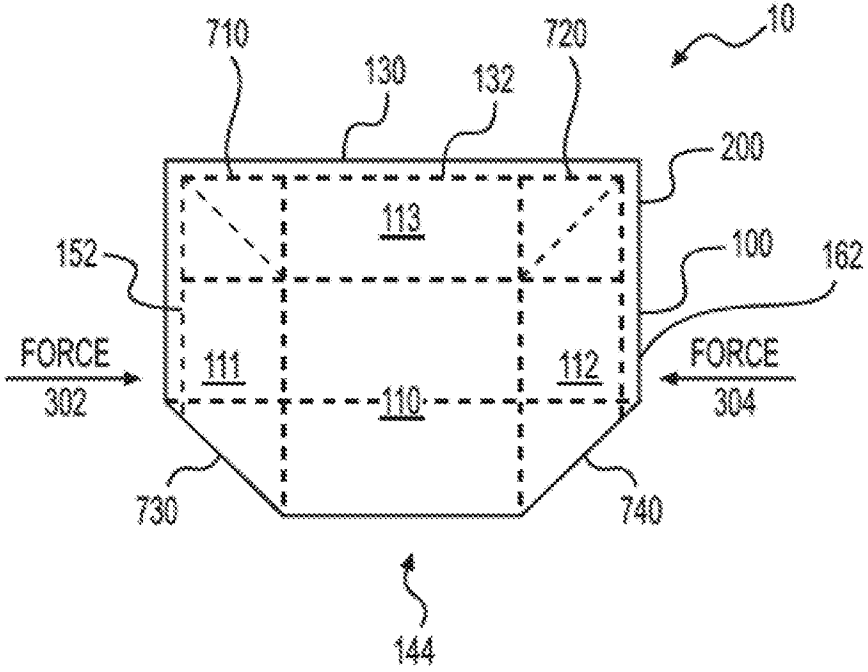
Figure 13D:
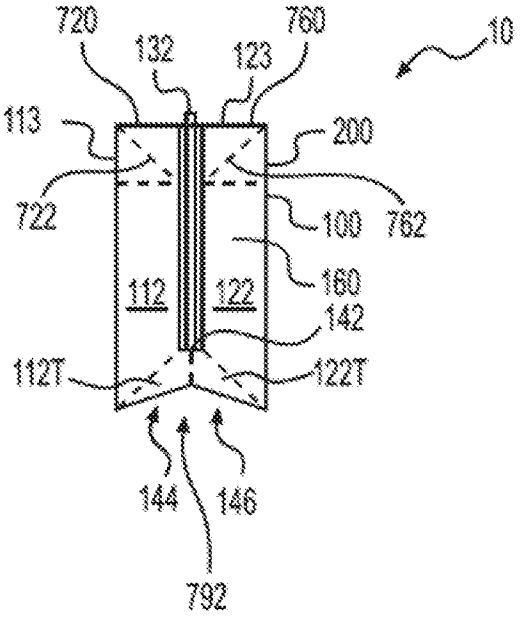
Figure 13C:
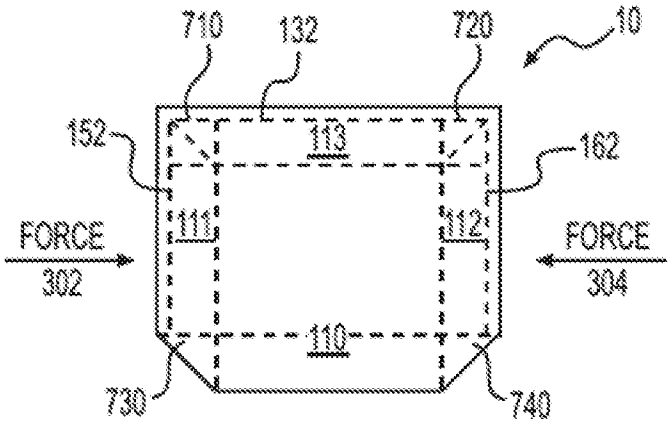
Figure 13F:
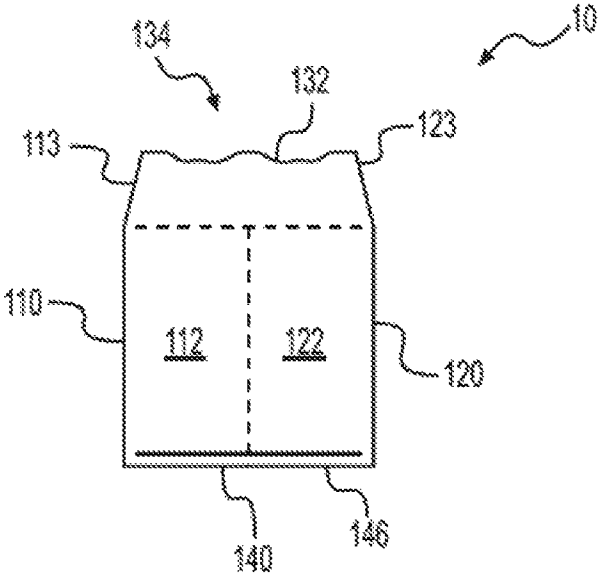
Figure 13E:
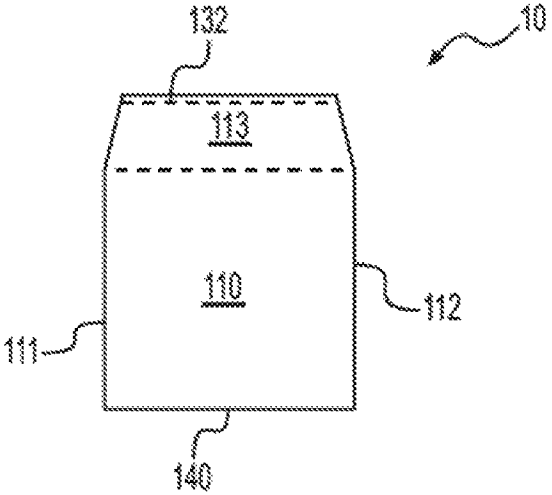

FIGS. 13A-13F are illustrations of expandable shipping container 10 as it transitions from the collapsed configuration to the expanded configuration, in accordance with some embodiments. FIGS. 13A-13B show expandable shipping container 10 in a collapsed configuration, FIGS. 13C-13D show expandable shipping container 10 in a partially expanded configuration, and FIGS. 13E-13F show expandable shipping container 10 in an expanded configuration. Expandable shipping container 10 may be transformed from the collapsed configuration into the expanded configuration in a matter of seconds and without the use of tools by applying force 302, 304 to two opposite sides of the expandable shipping container 10. For example, if opposing, inward forces 302, 304 are applied to fifth side panel 150 and sixth side panel 160, the applied force 302, 304 causes expandable shipping container 10 to expand from a substantially flat, collapsed, "storage" configuration to a substantially box-like, expanded, "in-use" configuration. Forces 302, 304 may be most effective if directed proximate a middle, central area of the fifth and sixth side panels 150, 160, where, as described in further detail below, seams 152, 162 allow for fifth and sixth side panels 150, 160 to bend. In other embodiments, suction devices may outwardly pull on faces 110, 120 to expand expandable shipping container 10 into the expanded configuration. In further embodiments, an inflatable module (e.g., an inflatable bag) may be inserted within expandable shipping container 10 and configured to form an expanded cavity whose expanded outer surfaces outwardly pushes the inner sidewalls of expandable foam container 10 until expandable foam container 10 enters the expanded configuration. The inflatable module may then deflate (e.g., by being popped or having a discharge valve opened) to return expandable foam container 10 to a collapsed configuration. But as will be appreciated by those skilled in the art, outwardly directed pressure applied within shipping container 10 are not necessary to fully transition shipping container 10 from a collapsed configuration to a fully expanded configuration. Indeed, shipping container 10 may be quickly and easily "popped" open merely by applying opposing, inward forces 302, 304 to fifth side panel 150 and sixth side panel 160.

According to some embodiments, when force 302 is applied to fifth side panel 150, it causes the pair of first side flaps 111, 121 to bend inwardly such that the outer edges of the pair of first side flaps 111, 121 move inwardly towards the center of expandable shipping container 10. Additionally, as the outer edges of the pair of first side flaps 111, 121 move inwardly towards the center of expandable shipping container 10 (and the first side flaps 111, 121 move toward substantial planar alignment to form fifth side panel 150), the lower portions 111T, 121T of first side flaps 111, 121 move outwardly away from the center of expandable shipping container 10, such that the lower portions 111T, 121T of first side flaps 111, 121 and the upper portions of first side flaps 111, 121 become substantially planarly aligned. Likewise, when force 304 is applied to sixth side panel 160, it causes the pair of second side flaps 112, 122, to bend inwardly such that the outer edges of the pair of second side flaps 112, 122 move inwardly towards the center of expandable shipping container 10. As the outer edges of the pair of second side flaps 112, 122 move inwardly towards the center of expandable shipping container 10 (and the second side flaps 112, 122 move toward substantial planar alignment to form fifth side panel 160), the lower portions 112T, 122T of second side flaps 112, 122 move outwardly away from the center of expandable shipping container 10, such that the lower portions 112T, 122T of second side flaps 112, 122 and the upper portions of second side flaps 112, 122 become substantially planarly aligned. Thus, upon application of opposing inward forces 302, 304 to the sides of expandable shipping container 10, the pairs of first side flaps 111, 121 and second side flaps 121, 122 bend from a position that is substantially parallel to first side panel 110 and second side panel 120 to a position that is substantially perpendicular to first side panel 110 and second side panel 120. Additionally, in some embodiments, application of opposing inward forces 302, 304 to the sides of expandable shipping container 10 pulls on flexible barrier 200 (or seams between side panels 150, 160 when barrier 200 is omitted) and in turn causes the two halves 144, 146 (and triangular flaps 791, 792 folded beneath and between halves 144, 146) of the bottom panel 140 to bend from a collapsed configuration position (i.e., with the halves 144, 146 disposed between first side panel 110 and second side panel 120 and positioned substantially parallel to first side panel 110 and second side panel 120) to an expanded position (i.e., with the halves 144, 146 outwardly moving to a position proximate a bottommost edge of first and second side panels 110, 120 and substantially perpendicular to first and second side panels 110, 120) in the expanded configuration.

FIGS. 14A-14E are illustrations of inner structure 100 for expandable shipping container 10 in various states of assembly, in accordance with some embodiments. Inner structure 100 may be formed by one or more layers of insulation materials or mediums. In some embodiments, inner structure 100 may be made from an insulating medium that may range from 0.125 inches to 3.0 inches in thickness. Inner structure 100 may have a density ranging from 1 OPSY to 10 OPSY in some embodiments, and from 1 OPSY to 50 OPSY in other embodiments. FIG. 14A shows inner structure 100 after being initially cut, before it has been scored or folded. It is contemplated that inner structure 100 may be made from a single, integrated piece of material, such as a single piece of curbside recyclable cornstarch panel, cardboard, wood, or insulation materials (e.g., the insulation panel disclosed in the U.S. Provisional Patent Application No. 62/491,666). Alternatively, as discussed in more detail in FIGS. 15A-15E, inner structure 100 may include multiple sub-structures. According to some embodiments, the single piece of material forming the inner structure 100 may have a shape similar to that shown in FIG. 14A, and include a first side panel 110S connected to a second panel 120S via a bottom panel 140S (corresponding to respective panels 110, 120, 140 of expandable container 10 once inner structure 100 is enclosed by flexible barrier 200, as shown in FIG. 14E). First side panel 110S may have a portion that extends from a side opposite bottom panel 140S that may be used as a top flap 113S, and may have portions extending from the other two opposing sides that may be used as a first side flap 111S and a second side flap 112S (corresponding to respective panels and flaps of expandable container 10 once inner structure 100 is enclosed by flexible barrier 200, as shown in FIG. 14E). A corner panel 710S may be disposed adjacent top flap 113S and first side flap 111S, and a corner panel 720S may be disposed adjacent top flap 113S and second side flap 112S. In some embodiments, corner panel 710S may include a diagonal scoreline 712, which may bisect corner panel 710S to separate sections 714S, 716S. In some embodiments, corner panel 720S may include a diagonal scoreline 722, which may bisect corner panel 720S to separate sections 724S, 726S. In some embodiments, second side panel 120S may be a similar configuration to first side panel 110, having portions that may be used as a first side flap 121S, a second side flap 122S, and a top flap 123S (corresponding to respective panels and flaps of expandable container 10 once inner structure 100 is enclosed by flexible barrier 200, as shown in FIG. 14E). A corner panel 750S may be disposed adjacent top flap 123S and first side flap 121S, and a corner panel 760S may be disposed adjacent top flap 123S and second side flap 122S. In some embodiments, corner panel 750S may include a bisecting diagonal scoreline 752 that separates sections 754S, 756S. In some embodiments, corner panel 760S may include a bisecting diagonal scoreline 762 that separates sections 764S, 766S.

As shown in FIG. 14B, inner structure 100 that is made from a single piece of material is scored to form bendable pieces, such as flaps. For example, first side panel 110S has a first side flap scoreline 411 to form first side flap 111S, a second side flap scoreline 412 to form second side flap 112S, a top flap scoreline 413 to form top flap 113S, and a bottom scoreline 444 between first side panel 110S and bottom panel 140S that may allow first side panel 110S to bend relative to bottom panel 140S. Diagonal scoreline 712 may extend diagonally from the intersection of scoreline 411 and scoreline 413 and across corner panel 710S to an outermost corner of corner panel 710S (i.e., aligned towards a center of first side panel 110S). Similarly, diagonal scoreline 722 may extend diagonally from the intersection of scoreline 412 and scoreline 413 and across corner panel 720S to an outermost corner of corner panel 720S (i.e., aligned towards the center of first side panel 110S). Second side panel 120S has a first side flap scoreline 421 to form first side flap 121S, a second side flap scoreline 422 to form second side flap 122S, a top flap scoreline 423 to form top flap 123S, and a bottom scoreline 446 between second side panel 120S and bottom panel 140 that may allow second side panel 110S to bend relative to bottom panel 140S. Diagonal scoreline 752 may extend diagonally from the intersection of scoreline 421 and scoreline 423 and across corner panel 750S to an outermost corner of corner panel 750S (i.e., aligned towards a center of second side panel 120S). Similarly, a diagonal scoreline 762 may extend diagonally from the intersection of scoreline 422 and scoreline 423 and across corner panel 760S to an outermost corner of corner panel 760S (i.e., aligned towards the center of second side panel 120S).

Bottom panel 140S may have a bisecting scoreline 142 that divides bottom panel 140S into a half 144S extending from first side panel 110 and a half 146S extending from second side panel 120. Bisecting scoreline 142 may enable one half 144S of bottom panel 140S to be bendable relative to the other half 146S of bottom panel 140. In some embodiments, bisecting scoreline 142 may extend from one edge of the material to the opposite edge of the material. In corner panel 730S (adjacent to first side panel 111S and half 144S), diagonal scoreline 732 may extend diagonally from the intersection of scoreline 411 and scoreline 444 across corner panel 730S to the intersection of scoreline 142 and the edge of the material (i.e., towards the center of first side panel 110S). Similarly, in corner panel 770S (adjacent to first side panel 121S and half 146S), diagonal scoreline 772 may extend diagonally from the intersection of scoreline 421 and scoreline 446 across corner panel 770S to the intersection of scoreline 142 and the edge of the material (i.e., towards the center of second side panel 120S). Likewise, in corner panel 740S (adjacent to second side panel 112S and half 144S), diagonal scoreline 742 may extend diagonally from the intersection of scoreline 412 and scoreline 444 across corner panel 740S to the intersection of scoreline 142 and the opposite edge of the material (i.e., towards the center of first side panel 110S). Similarly, in corner panel 780S (adjacent to second side panel 122S and half 146S), diagonal scoreline 782 may extend diagonally from the intersection of scoreline 422 and scoreline 446 across corner panel 780S to the intersection of scoreline 142 and the edge of the material (i.e., towards the center of second side panel 120S). In some embodiments, side panel 111S may include diagonal scoreline 111D, which may define lower portion 111T, side panel 112S may include diagonal scoreline 112D, which may define lower portion 112T, side panel 121S may include diagonal scoreline 121D, which may define lower portion 121T, and/or side panel 122S may include diagonal scoreline 122D, which may define lower portion 122T. In some embodiments, diagonal scoreline 111D may intersect with, and be disposed perpendicular to, diagonal scoreline 732. In some embodiments, diagonal scoreline 121D may intersect with, and be disposed perpendicular to, diagonal scoreline 772. In some embodiments, diagonal scoreline 112D may intersect with, and be disposed perpendicular to, diagonal scoreline 742. In some embodiments, diagonal scoreline 122D may intersect with, and be disposed perpendicular to, diagonal scoreline 782. In some embodiments, one, some, or all of diagonal scorelines 111D, 121D, 112D, 122D may extend to a midpoint of the exterior edge of first side flap 111S, first side flap 121S, second side flap 112S, or second side flap 122S, respectively.

As will be appreciated by those of skill in the art, each scoreline may be an impression or cut in inner structure 100 that allows a portion of the inner structure 100 to bend about the scoreline, and each scoreline may be angled to allow pieces of inner structure 100 to bend at the desired angle (e.g., at about 90°). For example, top flap scoreline 413 is scored to form angles greater than 30° in inner structure 100 to allow top flap 113S to bend about 90° relative to first side panel 110. Similarly, bisecting scoreline 142 may be scored to form angles greater than 60° in inner structure 100 to allow half 144S to bend about 180° relative to the other half 146S of bottom panel 140S. It is contemplated that inner structure 100 will have between five and ten scorelines in some embodiments, and between eight and nine scorelines in other embodiments. Scorelines may be formed by any known means, such as, for example, by a die cut or a flexo folder process.

FIG. 14C illustrates inner structure 100 in a partially assembled position. As shown, second side panel 120S may bend about 90° along bottom scoreline 446 so that second side panel 120S is perpendicular to bottom panel 140S. First side flap 121S and second side flap 122S may bend along first side flap scoreline 421 and second side flap scoreline 422, respectively, such that the first side flap 121S and second side lap 122S are perpendicular to both second side panel 120S and bottom panel 140S. A first area bordered by diagonal scoreline 111D, diagonal scoreline 732, and the edge of the material, a second area bordered by diagonal scoreline 121D, diagonal scoreline 772, and the edge of the material, a third area bordered by diagonal scoreline 112D, diagonal scoreline 742, and the edge of the material, and a fourth area bordered by diagonal scoreline 122D, diagonal scoreline 782, and the edge of the material can each be folded inwardly. In some embodiments, inward folding of the first and second areas can result in the outwardly visible portions of first side flaps 111S, 121S having a shape that is approximately a right trapezoid and can also result in first bottom flap 171 being formed adjacent to, and extending from, bottom panel 140. Similarly, in some embodiments, inward folding of the third and fourth areas can result in the outwardly visible portions of second side flaps 121S, 122S having a shape that is approximately a right trapezoid and can also result in second bottom flap being formed adjacent to, and extending from, bottom panel 140, opposite from first bottom flap.

As shown in FIG. 14D, first side panel 110S and its side flaps 111S, 112S may bend in a mirror image fashion to that of second side panel 120S such that the edge of both first side flaps 111S, 121S meet to form a seam 152 and the edge of both second side flaps 112, 122 meet to form a seam 162. The pairs of first side flaps 111S, 121S and second side flaps 122S may then be sealed together at their respective seams 152, 162 to form a fifth side panel 150S and a sixth side panel 160S, respectively. In some embodiments, the seams 152, 162 between the flaps may be sealed by heat sealing, being glued together, wire stitched together, stapled, taped, or joined in any other suitable fashion. In certain embodiments, first bottom flap and second bottom flap can fold under bottom panel 140.

FIG. 14D shows inner structure 100 in an assembled position as described above. According to some embodiments, an assembled inner structure 100 may include rigid first panel 110S, rigid second panel 120S, bottom panel 140S that may bend about bisecting scoreline 142, fifth side panel 150S that may bend about seam 152S, sixth side panel that may bend about seam 162S, and top panel 130S comprising a pair of top flaps 113S, 123S that may bend about top flap scorelines 413, 423 to enable the assembled, expanded container 10 to be selectively open or closed. In some embodiments, side seams 152S, 162S of the fifth and sixth side panels 150S, 160S and bisecting scoreline 142 of bottom panel 140S may enable inner structure 100 to bend to such that it may change between a collapsed configuration and an expanded configuration as shown in FIGS. 11A-12C.

As shown in FIG. 14E, flexible barrier 200 encloses the cut and scored inner structure 100 from FIG. 14B. Once enclosed by barrier 200, inner structure 100 can be folded as shown and described with respect to FIGS. 4C-4D to form the shape of expandable shipping container 10. In some embodiments, flexible barrier 200 is shrink-wrapped onto inner structure 100.

As an alternative embodiment of the single-piece inner structure 100 as shown in FIGS. 14A-14E, FIGS. 15A-15E provide illustrations of another exemplary multi-piece inner structure 500 for forming expandable shipping container 10 (e.g., as shown in the embodiments of FIGS. 11A-13E) in various states of assembly. As shown, inner structure 500 may include first sub-structure 502 and second sub-structure 504. First sub-structure 502 and second sub-structure 504 may be identical, allowing for more efficient manufacturing. In some embodiments, when placed adjacent to one another, such that the outer edge of half 144S extending from first side panel 110S aligns with the outer edge of half 146S extending from second side panel 120S, first sub-structure 502 and second sub-structure may collectively have the same shape and/or dimensions as the single piece of material used for an inner structure 100 shown in FIGS. 14A-14E. Further, expandable shipping container 10 may be assembled from first sub-structure 502 and second sub-structure 504 in the substantially the same manner described above with respect to inner structure 100 of FIGS. 14A-14E, except that the halves 144, 146 of the bottom panel 140 have to be sealed together at the bottom seam 240. According to some embodiments, bottom seam 240 may be sealed in a manner similar to that described above with respect to the sealing of seams 152, 162.

Figure 16:
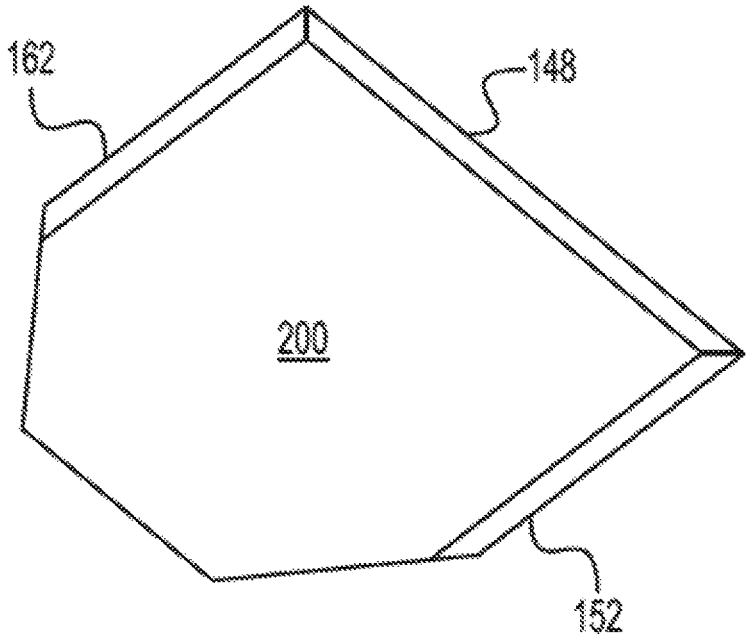
FIG. 16 shows a top isometric view of a flexible barrier of an expandable shipping container, in accordance with some exemplary embodiments.

FIG. 16 is an illustration of flexible barrier 200 of an expandable shipping container 10, in accordance with some embodiments. As shown, when devoid of inner structure 100 or 500, flexible barrier 200 may be substantially flat and have an approximately rectangular (e.g., square) shape, though flexible barrier 200 may take on other shapes to match the desired shape of expandable shipping container 10. After flexible barrier 200 encloses inner structure 100, as shown in FIGS. 14E and 15E, the combined structure 100 and barrier 200 may be folded in half (FIG. 14E) or the combined structures 502, 504 and respective barriers 200 may be paired (FIG. 15E) and one or more outer edges of flexible barrier 200 may be sealed (e.g., heat sealed or stitched) to form the expandable shipping container shown in FIGS. 11A-12C.

Shown in more detail in FIG. 16, the resulting seals along the outer edges of flexible barrier 200 may include top seam 132, fifth side seam 152, sixth side seam 162, and, as shown for exemplary purposes in FIG. 16 further to the embodiment shown in FIG. 15E, a fourth side seam 148 (which may be referred to as a bottom seam 148). As will be appreciated by one of skill in the art, seams 132, 152, 162, and 148 can be sealed by any known sealing means, including heat sealing and stitching. Top seam 132 may be an open seam forming opening 134 as shown in FIG. 12C. Bottom seam 148 may align with bisecting scoreline 142, fifth side seam 152 may be aligned between the pair of first side flaps 111, 121, and sixth side seam 162 may be aligned between the pair of second side flaps 112, 122. In some embodiments, flexible barrier 200 may be sealed on all sides but one, thereby forming an enclosure that may be accessed via opening 134.

According to some embodiments, flexible barrier 200 may be entirely made from kraft paper, such as laminated kraft paper. In some embodiments, flexible barrier 200 may be laminated or coated with one or more coating materials (e.g., a repulpable and curbside recyclable heat-activated coating or any hydrophobic coating that is repulpable and curbside recyclable) to provide water resistance properties. For example, kraft paper used to make flexible barrier 200 may be coated with a repulpable and curbside recyclable heat-activated coating in some embodiments or any organic hydrophobic coating that is repulpable and curbside recyclable in other embodiments. In some embodiments, the sealing of flexible barrier 200 on all sides, except the opening that may be sealed after packing, provides for a leak resistant enclosure, and in some cases, a leak proof enclosure. In some embodiments, flexible barrier 200 may be made of a material that is repulpable, recyclable, compostable, and/or water resistant. In some embodiments, flexible barrier 200 may be made of a material that may be heat sealed.

The design and functionality described in this application is intended to be exemplary in nature and is not intended to limit the instant disclosure in any way. Those having ordinary skill in the art will appreciate that the teachings of the disclosure may be implemented in a variety of suitable forms, including those forms disclosed herein and additional forms known to those having ordinary skill in the art. This disclosure is intended to cover various modifications and equivalent arrangements included within the scope of the appended claims. Although specific terms are employed herein, they are used in a generic and descriptive sense only and not for purposes of limitation.

It must also be noted that, as used in the specification and the appended claims, the singular forms "a," "an" and "the" include plural referents unless the context clearly dictates otherwise.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

As used herein, unless otherwise specified the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

As used herein, "bending" may refer to the ability of containerboard or combined board to be folded along scorelines without rupture of the surface fibers to the point of seriously weakening the structure.

As used herein, "biodegradable" may refer to a substance that is degradable over time by water and/or enzymes found in nature (e.g., compost), without harming, and in fact helping, the environment.

As used herein, "compostable" may refer to a product that will compost in such a manner that it is eligible for certification through the Vincott "OK Compost" labelling program.

As used herein, "compression strength" may refer to a corrugated box's resistance to uniformly applied external forces. Top-to-bottom compression strength is related to the load a container may encounter when stacked. End-to-end or side-to-side compression may also be of interest for particular applications.

As used herein, "corrugator" may refer to the machine that unwinds two or more continuous sheets of containerboard from rolls, presses flutes into the sheet(s) of corrugating medium, applies adhesive to the tips of the flutes and affixes the sheet(s) of linerboard to form corrugated board. The continuous sheet of board may be slit to desired widths, cut off to desired lengths and scored in one direction.

As used herein, "degradable" may refer to a substance that will undergo a process of deterioration or breaking-up by the action of natural forces (air, light, water) or by the addition of certain chemicals.

As used herein, "dimension" may refer to, for a regular slotted containers (RSC), box dimensions are expressed as length×width×height, always using inside dimensions.

As used herein, "facings" may refer to sheets of linerboard used as the flat outer members of combined corrugated board. Sometimes called inside and outside liners.

As used herein, "fiberboard" may refer to combined paperboard (corrugated or solid) used to manufacture containers.

As used herein, "flaps" may refer to an extension of the side wall panels that, when sealed, close the remaining openings of a box. Usually defined by one scoreline and three edges.

As used herein, "kraft" may refer to a German word meaning "strength"; designating pulp, paper or paperboard produced from wood fibers.

As used herein, "linerboard" may refer to the flat sheets of paper that comprise the outer surfaces of a sheet of corrugated board.

As used herein, "medium" may refer to the paperboard used to make the fluted layer of corrugated board.

As used herein, "overlap" may refer to a design feature wherein the top and/or bottom flaps of a box do not butt, but extend one over the other. The amount of overlap is measured from flap edge to flap edge.

As used herein, "panel" may refer to a "face" or "side" of a box.

As used herein, "paperboard" may refer to one of the two major product categories of the paper industry. Includes the broad classification of materials made of cellulose fibers, primarily wood pulp and recycled paper stock, on board machines.

As used herein, "recyclable" may refer to any product that is eligible for either curbside collection or for being accepted into recycling programs that use drop-off locations, particularly products granted permission to use the corrugated recycles symbol of the Fibre Box Association (FBA) in accordance with its guidelines (see, e.g., http://www.corrugated.org/wp-content/uploads/PDFs/Recycling/Vol_Std_Protocol_2013.pdf).

As used herein, "score" or "scoreline" may refer to an impression or crease in a rigid surface or board, made to position and facilitate folds.

As used herein, "score and slotted sheet" may refer to a sheet of corrugated fiberboard with one or more scorelines, slots or slits. May be further defined as a box blank, a box part, a tray or wrap, a partition piece, or an inner packing piece.

As used herein, "seam" may refer to the junction created by any free edge of a container flap or panel where it abuts or rests on another portion of the container and to which it may be fastened by tape, stitches or adhesive in the process of closing the container.

As used herein, "slit" may refer to a cut made in a fiberboard sheet without removal of material.

As used herein, "slit score" may refer to shallow knife cuts made in a box blank to allow its flaps and sides to be folded into a shipping box.

As used herein, "slot" may refer to a wide cut, or pair of closely spaced parallel cuts including removal of a narrow strip of material made in a fiberboard sheet, usually to form flaps and permit folding without bulges caused by the thickness of the material.

This written description uses examples to disclose certain embodiments of the technology and also to enable any person skilled in the art to practice certain embodiments of this technology, including making and using any apparatuses or systems and performing any incorporated methods. The patentable scope of certain embodiments of the technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. An expandable shipping container comprising:

a rectangular inner structure having a plurality of scorelines defining a plurality of rigid panels that are bendable relative to one another along one or more of the scorelines, the plurality of scorelines comprising a bisecting scoreline that divides the inner structure into mirroring halves, each half comprising:

a central rectangular face panel having top, left, right, and bottom sides;

a top rectangular partial face panel extending from the top side of the central face panel to an outermost top edge of the respective half of the inner structure;

a left rectangular partial face panel extending from the left side of the central face panel to an outermost left edge of the respective half of the inner structure;

a right rectangular partial face panel extending from the right side of the central face panel to an outermost right edge of the respective half of the inner structure;

a bottom rectangular partial face panel extending from the bottom side of the central face panel to the bisecting scoreline;

a first square-shaped corner panel adjacent the top partial face panel and the left partial face panel, the first corner panel being bisected by a first diagonal scoreline aligned towards a center of the central face panel;

a second square-shaped corner panel adjacent the top partial face panel and the right partial face panel, the second corner panel being bisected by a second diagonal scoreline aligned towards the center of the central face panel;

a third square-shaped corner panel adjacent the bottom partial face panel and the left partial face panel, the third corner panel being bisected by a third diagonal scoreline aligned towards the center of the central face panel; and a fourth square-shaped corner panel adjacent the bottom partial face panel and the right partial face panel, the fourth corner panel being bisected by a fourth diagonal scoreline aligned towards the center of the central face panel, wherein the left and right partial face panels have diagonal scorelines that parallel the first and second diagonal scorelines, respectively, and separate a triangular panel portion from a remainder panel portion; and a flexible barrier covering an entire exterior surface of the inner structure, the barrier forming a closed left face seam between the pairs of left partial face panels, first corner panels, and third corner panels of each half of the inner structure and a closed right face seam between the pairs of right partial face panels, second corner panels, and fourth corner panels of each half of the inner structure such that the container forms an enclosure having a single aperture defined between the pairs of top partial face panels, first corner panels, and second corner panels of each half of the inner structure, wherein the container is expandable between a collapsed configuration and an expanded configuration.

2. The container of claim 1, wherein the container is expandable between the collapsed configuration and the expanded configuration in response to inwardly directed pressure on the pair of central face panels of each half of the inner structure.

3. The container of claim 1, wherein the triangular panel portions of the left and right partial face panels and the bottom partial face panel of each half of the inner structure are inwardly foldable at least partially between the pair of central face panels of each half of the inner structure in the collapsed configuration.

4. The container of claim 1, wherein the central face panels of each half of the inner structure each comprise a cell core positioned between an outer liner and an inner liner, the cell cores comprising a plurality of cells arranged in a repeating geometric pattern, and one or more of the cells are at least partially filled with particulates comprising one or more insulating materials.

5. The container of claim 1, further comprising a removable sleeve wrapped around at least a portion of the barrier.

6. The container of claim 1, wherein the barrier comprises a leak-resistant material.

7. The container of claim 1, wherein the container is certified curbside recyclable.

8. The container of claim 1, wherein the inner structure and the barrier are made from one or more recyclable materials.

9. The container of claim 1, wherein the barrier comprises kraft paper.

10. The container of claim 9, wherein the barrier further comprises a coating.

11. The container of claim 1, wherein the barrier is repulpable, recyclable, compostable, and water resistant.

12. The container of claim 1, wherein the central face panels of each half of the inner structure each comprise a corrugated backing panel affixed to an insulation panel.

13. The container of claim 1, wherein the rectangular inner structure is formed by a single unitary piece.

14. An expandable shipping container comprising:

an inner structure having a plurality of rigid panels that are bendable relative to one another, the plurality of panels comprising:

a first side panel having a first bendable top flap, opposing bendable first and second side flaps, and opposing first and second square-shaped corner panels adjacent the first bendable top flap;

a second side panel having a second bendable top flap, opposing bendable third and fourth side flaps, and opposing third and fourth square-shaped corner panels adjacent the second bendable top flap;

a first bottom panel adjacent to the first side panel;

a second bottom panel adjacent to the second side panel, the second bottom panel being separated from the first bottom panel by an inwardly foldable bottom boundary;

and a flexible barrier encasing the inner structure, the barrier and the first and third side flaps forming a third side panel and the barrier and the second and fourth side flaps forming a fourth side panel, wherein the third side panel includes a third bendable top flap and the fourth side panel includes a fourth bendable top flap such that the first, second, third, and fourth bendable top flaps together define a single opening of the expandable shipping container, and wherein the expandable shipping container is expandable from a collapsed configuration to an expanded configuration in response to inwardly directed pressure on the third and fourth side panels.

15. The expandable shipping container of claim 14, wherein the third side panel includes a first bottom flap and the fourth side panel includes a second bottom flap, the first and second bottom flaps being disposed adjacent to the first and second bottom panels.

16. The expandable shipping container of claim 15, wherein the first and second bottom flaps are substantially triangular.

17. The expandable shipping container of claim 16, wherein the first and second bottom flaps are configured to extend outwardly from the expandable shipping container.

18. The expandable shipping container of claim 16, wherein the first and second bottom flaps are configured to fold under the first and second bottom panels.

19. The expandable shipping container of claim 18, wherein the expandable shipping container has an irregular hexagonal shape when the expandable shipping container is in the collapsed configuration.

20. The expandable shipping container of claim 19, wherein:

the bottom boundary is a score line, a fold line, a perforated line, a slit, or a cut; and the first bottom panel, a first half of the first bottom flap, and a first half of the second bottom flap collectively define a first bottom half;

the second bottom panel, a second half of the first bottom flap, and a second half of the second bottom flap collectively define a second bottom half; and the first and second bottom halves are configured to fold inwardly toward a center of the expandable shipping container.

21. The expandable shipping container of claim 18, wherein the first and second bottom flaps are substantially halved by the bottom boundary.

22. The expandable shipping container of claim 14, wherein, when the expandable shipping container is in the collapsed configuration, the first and second bottom halves are inwardly folded between the first and second side panels and the opposing bendable first and second side flaps and the opposing bendable third and fourth side flaps are outwardly extended from the first and second side panels.

23. The expandable shipping container of claim 14, wherein:

the first corner panel being bisected by a first diagonal scoreline aligned towards a center of the first side panel, the second corner panel being bisected by a second diagonal scoreline aligned towards a center of the first side panel, the third corner panel being bisected by a third diagonal scoreline aligned towards a center of the second side panel, and the fourth corner panel being bisected by a fourth diagonal scoreline aligned towards a center of the second side panel.

24. An expandable shipping container comprising:

a pair of joinable unitary square-shaped inner structures each comprising:

a central rigid square-shaped face panel having top, left, right, and bottom sides;

a top rigid rectangular partial face panel extending from the top side of the central face panel to an outermost top edge of the respective half of the inner structure;

a left rigid rectangular partial face panel extending from the left side of the central face panel to an outermost left edge of the respective half of the inner structure;

a right rigid rectangular partial face panel extending from the right side of the central face panel to an outermost right edge of the respective half of the inner structure;

a bottom rigid rectangular partial face panel extending from the bottom side of the central face panel to the bisecting scoreline;

a first square-shaped corner panel adjacent the top partial face panel and the left partial face panel, the first corner panel being bisected by a first diagonal scoreline aligned towards a center of the central face panel;

a second square-shaped corner panel adjacent the top partial face panel and the right partial face panel, the second corner panel being bisected by a second diagonal scoreline aligned towards the center of the central face panel;

a third square-shaped corner panel adjacent the bottom partial face panel and the left partial face panel, the third corner panel being bisected by a third diagonal scoreline aligned towards the center of the central face panel; and a fourth square-shaped corner panel adjacent the bottom partial face panel and the right partial face panel, the fourth corner panel being bisected by a fourth diagonal scoreline aligned towards the center of the central face panel, wherein the left and right partial face panels have diagonal scorelines that parallel the first and second diagonal scorelines, respectively, and separate a triangular panel portion from a remainder panel portion; and a flexible barrier covering an entire exterior surface of the joined pair of inner structures, the barrier forming a closed left face seam between the pairs of left partial face panels, first corner panels, and third corner panels of each half of the inner structure and a closed right face seam between the pairs of right partial face panels, second corner panels, and further corner panels of each of the inner structures such that the container forms an enclosure having a single aperture defined between the pairs of top partial face panels, first corner panels, and second corner panels of each of the inner structures, wherein the container is expandable between a collapsed configuration and an expanded configuration.

* * * * *